US011662192B2

(12) United States Patent
Rastegar

(10) Patent No.: US 11,662,192 B2
(45) Date of Patent: May 30, 2023

(54) MECHANICAL ENERGY HARVESTING DEVICES WITH SAFETY AND EVENT DETECTION FOR MUNITIONS AND THE LIKE

(71) Applicant: Omnitek Partners LLC, Ronkonkoma, NY (US)

(72) Inventor: Jahangir S Rastegar, Stony Brook, NY (US)

(73) Assignee: OMNITEK PARTNERS LLC, Ronkonkoma, NY (US)

( * ) Notice: Subject to any disclaimer, the term of this patent is extended or adjusted under 35 U.S.C. 154(b) by 214 days.

(21) Appl. No.: 17/151,319

(22) Filed: Jan. 18, 2021

(65) Prior Publication Data

US 2021/0285750 A1 Sep. 16, 2021

Related U.S. Application Data

(60) Provisional application No. 62/963,242, filed on Jan. 20, 2020.

(51) Int. Cl.

| | |
|---|---|
| ***F42C 15/24*** | (2006.01) |
| ***F42C 1/04*** | (2006.01) |
| ***F42C 11/00*** | (2006.01) |
| ***F42C 7/12*** | (2006.01) |
| ***F42C 9/02*** | (2006.01) |

(52) U.S. Cl.

CPC ..... *F42C 11/008* (2013.01); *F42C 1/04* (2013.01); *F42C 7/12* (2013.01); *F42C 9/02* (2013.01); *F42C 15/24* (2013.01)

(58) Field of Classification Search

CPC ..... F42C 1/04; F42C 7/12; F42C 9/02; F42C 11/008; F42C 15/24

USPC ..... 102/207, 247, 251, 252, 253

See application file for complete search history.

(56) References Cited

U.S. PATENT DOCUMENTS

| | | | | |
|---|---|---|---|---|
| 7,587,979 | B2 * | 9/2009 | Rastegar | F42C 9/02 102/222 |
| 8,191,476 | B2 * | 6/2012 | Rastegar | F42C 11/008 102/254 |
| 8,434,408 | B2 * | 5/2013 | Rastegar | F42C 11/008 102/221 |
| 9,057,592 | B2 * | 6/2015 | Rastegar | F42C 15/40 |
| 9,590,474 | B2 * | 3/2017 | Rastegar | H02K 7/1853 |

* cited by examiner

*Primary Examiner* — James S Bergin

(57) ABSTRACT

An energy storage device including: a first movable member configured to be movable in one direction relative to a base; a first biasing member configured to bias the first movable member in a second direction opposed to the first direction; a plurality of second movable members, each movable towards an engagement surface of the first movable member when subjected to a predetermined acceleration event in a direction offset from the first direction; and wherein the engagement surface having a portion which when pressed causes a movement of the first movable member in the one direction against a biasing force of the first biasing member; and the plurality of second movable members are configured to sequentially engage the engagement surface upon an increasing acceleration of the base such that energy is stored in the first biasing member.

19 Claims, 29 Drawing Sheets

MECHANICAL ENERGY HARVESTING DEVICES WITH SAFETY AND EVENT DETECTION FOR MUNITIONS AND THE LIKE

CROSS-REFERENCE TO RELATED APPLICATION

This application claims the benefit to U.S. Provisional Application No. 62/963,242, filed on Jan. 20, 2020, the entire contents of which is incorporated herein by reference.

BACKGROUND

1. Field

The present disclosure relates generally to low profile self-powered electrical initiators and electrical energy generation devices for munitions and the like with safety and firing event detection capability, and more particularly to devices that detect firing acceleration or target impact shock event without requiring external power sources and begin to generate electrical energy upon such shock loading events to initiate electrical initiators and/or power other system electronic and electrical circuits and devices.

2. Prior Art

All existing and future smart and guided gun-fired munitions and mortars that are equipped with electronics for fuzing or other similar purposes require electric power for their operation. Due to safety and the long shelf life of munitions, the electrical energy required for their operation is either provided by reserve batteries or onboard electrical generators. Reserve batteries, primarily the so-called liquid reserve and thermal batteries, are designed to be inert until they are activated. As a result, they have very long shelf life, sometimes well over 20 years that is required for most munitions power sources.

The amount of power required for proper operation of certain components in gun-fired munitions, for example for the operation of certain fuzing electronics, is small enough to be provided by harvesting electrical energy from firing setback and/or set-forward acceleration or from shock loading of target impact. The outset of the electrical energy generation by such devices may also be used as a signal indicating detection of the firing or target impact event for fuzing purposes and the like.

In general, such event detection and electrical energy generators harvest mechanical energy during the firing acceleration or target impact and store it as mechanical energy in certain mechanical energy storage devices as potential and/or kinetic energy and then convert it to electrical energy following the experienced shock loading event. The amount of electrical energy that such devices can provide is generally enough for initial powering of fuzing electronics until reserve power sources are activated and in some cases enough power is provided for the munitions entire mission.

Such event detection and electrical energy generators provide a very high degree of safety in munitions since they provide electrical energy that could operate onboard electronics only post firing. These devices therefore eliminate the need for a primary battery or a capacitor that needs to be charged on board munitions and their related safety and shelf life problems.

All weapon systems require fuzing systems for their safe and effective operation. A fuze or fuzing system is designed to provide as a primary role safety and arming functions to preclude munitions arming before the desired position or time, and to sense a target or respond to one or more prescribed conditions, such as elapsed time, pressure, or command, and initiate a train of fire or detonation in a munition.

Fuze safety systems consist of an aggregate of devices (e.g., environment sensors, timing components, command functioned devices, logic functions, plus the initiation or explosive train interrupter, if applicable) included in the fuze to prevent arming or functioning of the fuze until a valid environment has been sensed and the arming delay has been achieved.

Safety and arming devices are intended to function to prevent the fuzing system from arming until an acceptable set of conditions (generally at least two independent conditions) have been achieved.

A significant amount of effort has been expended to miniaturize munitions components to maximize their payload and their effectiveness. In the case of gun-fired munitions, it is highly desirable to have event detection and electrical energy generators that can be highly miniaturized and have minimal height. These devices are to harvest mechanical energy during the firing acceleration or target impact and store it as mechanical energy in mechanical energy storage devices as potential and/or kinetic energy. The device must then begin to generate electrical energy from the stored mechanical energy to electrical energy rapidly following gun firing or target impact event. The generated electrical voltage/current provides the event detection sensory functionality. The generated electrical energy can be used directly by the munition electronics and/or stored in certain electrical energy storage device such as a capacitor or super-capacitor for use during the flight and as required for the munitions mission.

A need therefore exists for the development of methods and devices that efficiently utilize the firing acceleration (or the target impact induced acceleration) to accumulate mechanical potential and/or kinetic energy in the device and only after the firing (target impact) event has ended, to rapidly begin to generate electrical energy. The generated electrical voltage/current can then be detected by the munition electronics and provide the firing (target impact) event detection sensory input to the munition electronics. The generated electrical energy is then used to power the munition electronics and other devices and stored in certain electrical storage devices for use post firing (target impact).

Piezoelectric-based mechanical event detection devices have also been developed that upon detection of the prescribed firing or target impact acceleration level and duration, i.e., the firing event or target impact, would harvest mechanical energy from firing setback or set-forward acceleration event and provide electrical energy to activate reserve batteries and/or for initial powering of fuzing electronics until reserve power sources are activated.

Piezoelectric-based energy harvesting device, however, can only generate a very small amount of electrical energy in munitions. This is the case since the firing setback acceleration provides a single shock loading pulse, which quickly deform the piezoelectric element to its maximum deformation level (harvested mechanical energy), i.e., the maximum generated charge level. For example, if the firing setback acceleration is 10-15 msec, the piezoelectric element deforms to its maximum allowable deformation level in a small fraction of one msec, and no mechanical energy is harvested during the remaining setback acceleration event time.

A need therefore exists for the development of methods and devices that can efficiently extract and accumulate a significant amount of mechanical energy during the entire period of setback acceleration (or the target impact induced acceleration) in the form of mechanical potential and/or kinetic energy that can then be used to generate electrical energy. The generated electrical energy may then be used to initiate reserve batteries and/or power the munition electronics and other devices and stored in certain electrical storage devices for use post firing (target impact). The generated electrical voltage/current may also be detected by the munition electronics as firing (target impact) event detection sensory input.

Such event detection and electrical energy generators provide a very high degree of safety in munitions since they provide electrical energy that could operate onboard electronics only post firing. These devices also eliminate the need for a primary battery or a capacitor that needs to be charged onboard munitions and their related safety and shelf life problems.

All weapon systems require fuzing systems for their safe and effective operation. A fuze or fuzing system is designed to provide the primary role of safety and arming functions to preclude munitions arming before the desired position or time, and to sense a target or respond to one or more prescribed conditions, such as elapsed time, pressure, or command, and initiate a train of fire or detonation in a munition.

The above fuzing functions require electrical energy to power the system sensory and related electronic and electrical devices. Event detection and electrical energy generators, particularly if they can generate significantly larger amounts of electrical energy that is possible with piezoelectric-based devices or other similar generators that cannot harvest and store the harvested mechanical energy during the entire setback acceleration cycle and convert the stored mechanical energy to electrical energy, would not only eliminate the need for a primary battery or a capacitor that needs to be charged onboard munitions before firing, but could also (at least partially) power the munitions electronics and electrical systems until onboard reserve batteries are activated. This is particularly beneficial for longer range munitions in which high electrical power that is supplied by the munition reserve batteries is needed only later during the flight. In such munition applications, the larger amounts of harvested electrical energy allow for the munitions reserve batteries to be activated later during the flight. As a result, the reserve battery rise time can be longer and significantly smaller thermal batteries would generally be required for the relatively long missions.

A significant amount of effort has been expended to miniaturize munitions components to maximize their payload and their effectiveness. In the case of gun-fired munitions, it is highly desirable to have safety and firing event detection, electrical reserve battery initiation and electrical energy generators that can be highly miniaturized. The achievement of this goal is greatly assisted by the development of devices that can harvest a significant amount of mechanical energy during the firing acceleration or target impact and store it as mechanical energy in mechanical energy storage devices as potential and/or kinetic energy for conversion to electrical energy. The generated electrical energy from the stored mechanical energy can then be used to power the system electronics, initiate reserve battery or initiation trains (with a prescribed delay if necessary), and/or store in a capacitor or super-capacitor for later use by munitions electronics and electrical devices.

A need therefore exists for the development of methods and devices that efficiently utilize the firing acceleration (or the target impact induced acceleration) to accumulate mechanical potential and/or kinetic energy in the device and only after the firing (target impact) event has ended, to rapidly begin to generate electrical energy.

The developed devices must not generate any electrical energy if the accelerations that do not correspond to the prescribed all-fire acceleration or target impact, i.e., a minimum acceleration threshold that lasts a prescribed period of time.

The generated electrical energy can then be used to initiate the device electrical initiator with or without a prescribed time delay or after receiving a command signal. The generated electrical voltage/current can also be detected by the munition electronics and provide the firing (target impact) event detection sensory input to the munition fuzing electronics. The remaining generated electrical energy may be used to power the munition electronics and/or stored in certain electrical storage devices for use post firing (target impact).

The developed devices must not accumulate any mechanical energy and generate no electrical energy if it is subjected to any accidental acceleration events, such as short duration but high acceleration levels due to accidental drops on hard surfaces or other object impacts (usually durations of the order of 0.5 msec or less) or low peak accelerations due to transportation vibration or the like.

A need also exists for the development of methods and devices that allow mechanical energy to be harvested from the munitions firing setback acceleration during essentially the entire duration of the setback acceleration to maximize the amount of mechanical energy available for conversion to electrical energy.

A need therefore exists for self-powered electrically initiated igniters for thermal batteries and the like, particularly for use in gun-fired smart munitions, mortars, small missiles and the like, that operate without external power sources and acceleration sensors and electrical and electronic circuit and incorporate the advantages of both electrical igniters with self-powered decision making electronics and microprocessors and inertial igniters that are currently available.

A need also exists for mechanical energy harvesting devices that can harvest mechanical energy from firing setback acceleration during essentially the entire duration of the setback acceleration and converting it to electrical energy upon the termination of the firing setback acceleration.

Such devices may also be used to harvest mechanical energy from firing set-forward acceleration in munitions and from impact induced accelerations.

A need also exists for self-powered munitions firing and impact event detection sensors for munitions fuzing applications.

Mechanical delay mechanisms for miniature inertial igniters have been described in U.S. Pat. Nos. 7,587,979 and 8,191,476 and 8,434,408, the entire disclosures thereof are incorporated herein by reference. This prior art mechanical delay mechanism and its operation is herein described by the "finger-driven wedge design" mechanism of FIGS. 1*a*-1*d*, which as can be seen is a multi-stage mechanical delay mechanism.

The schematic of the prior art three-stage embodiment 80 is shown in FIG. 1*a*. The device 80 can obviously be designed with as many fingers (stages) as is required to accommodate any desired delay time. The mechanism may have three fingers (stages) 81, 82 and 83, each of which provides a specified amount of delay when subjected to a certain amount of acceleration (in the vertical direction of the arrow 89 as viewed in FIG. 1*a*). The fingers are fixed to the mechanism base 84 on one end. Each finger is provided with certain amount of mass and deflection resisting elasticity (in this case in bending). Certain amount of upward preloading may also be provided (with preloaded springs—not shown) to delay finger deflection until a desired acceleration level is reached. When at rest, only the first finger 81 is resting on the sloped surface 87 of the delay wedge 85. The delay wedge 85 is provided with a resisting spring 88 to bring the system back to its rest position, if the applied acceleration profile is within the no-fire regime of the inertial igniter and to offer more programmability for the device. The delay wedge 85 is positioned in a guide 86 which restricts the delay wedge 85 motion along the guide 86.

The operation of the device 80 is as follows. At rest, the delay wedge 85 is biased to the right by the delay wedge spring 88, and the three fingers 81, 82 and 83 are biased upwards with some pre-load. The ratio of pre-load to effective finger mass will determine the acceleration threshold below which there will be no relative movement between components. The positions of the three fingers 81, 82 and 83 are such that finger 81 is above the sloped surface 87 of the delay wedge 85 and fingers 82 and 83 are supported by the top surface 90 of the delay wedge 85, and are prevented from moving until the delay wedge 85 has advanced the prescribed distance. This is illustrated in FIG. 1*a*.

If the device 80 experiences an acceleration in the direction 89 above the threshold determined by the ratio of initial resistances (elastic pre-loads) to effective component masses, the primary finger 81 will act against the sloped surface 87 of the delay wedge 85, advancing the delay wedge 85 to the left.

FIG. 1*b* shows the first finger 81 fully actuated and the delay wedge 85 advanced one-third of its total finger-actuated travel distance. At this instant, the second finger 82 is no longer supported by the top surface 90 of the delay wedge 85 and is free to move downwards provided that the acceleration is still sufficiently high to overcome the preload for the second finger 82 and the delay wedge spring 88 force at the aforementioned one-third travel distance.

If the acceleration continues at an all-fire profile, the second finger 85 will drive the delay wedge to two-thirds of its total finger-actuated travel distance, allowing the third finger 83 to act on the top surface 87 of the delay wedge 85. This is shown in FIG. 1*c*.

If the acceleration terminates or falls below the all-fire requirements, the mechanism will reverse until balance is achieved between the acceleration reaction forces and the elastic resistances. This may be a partial or complete reset from which the mechanism may be re-advanced if an all-fire profile is applied or resumed.

Full actuation of the mechanism will occur once all three fingers 81, 82 and 83 have driven the delay wedge 85 to its full travel in succession. This non-linear progression will be carried out as a continuation of the partial actuations described above. The full actuation of such a mechanism is shown in FIG. 1*d*.

Obviously, the amount of preloading and/or resistance to bending of the fingers 81, 82, 83 may vary such that the first finger 81 bends under a certain acceleration profile, finger 82 bends under a larger acceleration profile than the first finger 81 and the third finger 83 bends under the largest acceleration profile. Furthermore, the delay wedge 85 can be configured to provide the ignition of the thermal battery upon full activation.

The above multi-stage mechanical delay mechanism 80 may obviously be configured in a wide variety of configurations. This method of providing a mechanical time delay mechanism via sequential travel of inertial elements provides devices that occupy very short heights while achieving very long-time delays. The significance of the multi-stage design in reducing the height of the mechanical time delay mechanisms, thereby the size (particularly the height) of inertial igniters can be described as follows (U.S. Pat. Nos. 7,587,979 and 8,191,476 and 8,434,408).

The mathematical model that can be used to evaluate the delay time as a function of the total vertical distance that the inertial (mass) element(s) of the various mechanical delay mechanisms have to travel due to the vertical travel distance of the inertial elements of the device using the delay mechanism, i.e., the minimum height of the resulting device, is based on an expansion constrained mass-spring model as shown in FIG. 2, consisting of a mass (inertia) element 101 and spring element 102. The spring element 102 is attached to the base 103, which in turn is fixed to the accelerating platform 105. The spring element 102 is preloaded in compression and is constrained to expand from its preloaded position shown in FIG. 2 by the stop 107, which is fixed to the accelerating platform 105.

When the base is accelerated upwards in the direction of the arrow 106, the mass 101 will experience a reaction inertial force downward. Since the spring 102 is preloaded in compression, a threshold will exist below which the reaction force on the mass will not be high enough to deflect the spring from its preloaded position. Beyond this acceleration threshold, the mass 101 will move downward. For relatively high preloads and relatively small spring 102 deflections (such as those employed in the prior art embodiment of FIGS. 1*a*-1*d*), the spring 102 force can be assumed to be constant throughout the deflection. The net force on the mass is then equal to the difference between the reaction inertial force from the acceleration and the constant spring 102 force.

To generate a generic model applicable to a system without a predetermined mass or spring rate, the preload force may be expressed in terms of a force equivalent to the supported mass under some acceleration $$F_p = m\,A_p g$$

where $F_p$ is the preload force, $A_p$ is the equivalent preload acceleration magnitude in G's, and g is the gravitational acceleration constant. This acceleration, $A_p$, may now be subtracted from the acceleration which is producing the reaction force on the mass 101. In other words, we specify the preload not in terms of force, but in terms of the threshold of acceleration below which there will be no spring 102 deflection. If the net equivalent acceleration on the mass 101 in G's is A, the displacement of the mass 101, i.e., the deflection of the spring 102, y, as a function of time t, can be expressed as $$y = \tfrac{1}{2} A\,g\,t^2 \tag{1}$$

Now, from the equation (1) we can compare the necessary axial displacement of the inertial elements (mass 101 in the model of FIG. 2) in a single stage mechanical delay mechanism with the axial displacement of the inertial elements (mass 101 in the model of FIG. 2) in a multi-stage mechanical delay mechanism. In the plot of FIG. 3, a 2000 G pulse is considered to be applied to the base 103 in the direction of the arrow 106 for 0.5 millisecond duration. The mass elements 101 is supported by constant-force springs 102 with preload forces equivalent to a movement threshold of 700 G. The vertical displacement of the mass (inertial) elements 101 have been scaled such that the displacement of the mass 101 in the single-stage mechanical delay mechanism (indicated by the curve 110 in the plot of FIG. 3) at the end of the aforementioned acceleration pulse has a magnitude of one. Considering a three-stage mechanical delay mechanism, the vertical displacement of the first, second and third mass elements 101 of the first, second and third stages are shown in FIG. 3 by the curves 111, 112 and 113, respectively. The total vertical displacement required for the three stages (in fact for any number of stages) of a multi-stage mechanical delay mechanism is seen to be limited to the displacement of one of its stages alone. From the plot, the advantage of the three-stage design is clear: the total vertical displacement of a three-stage design nearly 90% smaller than that of the single-stage (currently available) designs.

It is noted that the reason behind a significant advantage of the disclosed multi-stage inertial mechanical delay mechanisms is the fact that for a single mass subjected to an acceleration, the resulting displacement is a quadratic function of the time of travel, equation (1). A quadratic function, curve 110 in FIG. 3, is more or less flat at the beginning, i.e., during the first relatively small intervals of time the displacement is small since the inertial element 101 has not gained a considerable amount of velocity. The present multi-stage inertial igniters take advantage of this characteristic of the aforementioned quadratic delay time vs. displacement relationship, equation (1), by limiting the total (vertical) displacement of the inertial elements 101 of each individual stage, thereby achieving very small vertical height requirement.

SUMMARY

Accordingly, methods and devices for harvesting and storing mechanical energy during essentially the entire duration or the desired portion of the duration of the firing setback acceleration or impact induced acceleration events is provided. The provided methods and devices may have the capability to ensure that mechanical energy is stored in the device and electrical energy is generated only if the device is subjected setback acceleration levels that are at or above the prescribed firing threshold or the prescribed impact induced acceleration threshold for the prescribed minimum durations and not when the device is subjected to any accidental acceleration events, such as short duration but high acceleration levels due to accidental drops on hard surfaces or other object impacts (usually durations of the order of 0.5 msec or less) or low peak accelerations due to transportation vibration or the like.

The generated electrical energy may then be used to initiate the provided electrical initiator(s) with or without a prescribed time delay. In which case, the device would thereby function as a self-powered electrical initiator with the added functionality of providing firing or impact event detection sensory input to the munitions fuzing and electrical energy to power munitions electronics and in some applications eliminate the need for onboard battery.

The device may also be provided with electronic circuit and logic and microprocessor(s) that can be programmed to initiate the provided electrical initiator(s) after certain amount of time or after receiving a command signal from the munitions control system or other sensory and the like inputs.

The device may also be used only for harvesting mechanical energy from the firing setback acceleration or impact events and generating electrical energy for direct use by the system electrical and electronics and/or storage in a storage device such as a capacitor or a super-capacitor. The device electrical output voltage/current may still be used to detect firing or impact events.

The device may also be used only for harvesting mechanical energy from the firing setback acceleration or impact events for direct use by the system mechanical systems such as safe and arm mechanisms following the detection of the prescribed all-fire or impact induced acceleration profile, i.e., a setback acceleration level that is at or above the prescribed firing acceleration threshold (or the prescribed impact induced acceleration threshold) for the prescribed minimum duration and not when the device is subjected to any accidental acceleration events, such as short duration but high acceleration levels due to accidental drops on hard surfaces or other object impacts or low peak accelerations due to transportation vibration or the like An objective is to provide a new class of "mechanical energy harvesting devices" that can efficiently harvest mechanical energy from acceleration events, such as the firing setback acceleration of munitions, and store it in a mechanical energy storage device for later conversion to electrical energy or for other purposes, such as for actuating certain mechanical mechanisms or devices.

The disclosed new classes of "mechanical energy harvesting devices" may be provided with the capability of differentiating a prescribed minimum acceleration level and its duration, such as all-fire conditions in munitions or impact induced minimum acceleration level and minimum duration, and then begin to generate electrical energy. The electrical energy may then be used to initiate an electrical initiator with or without time delay or other sensory or control signal input; or may be at least partially stored in an electrical energy storage device such as a capacitor or supercapacitor for powering certain electrical and/or electronics.

The disclosed "mechanical energy harvesting devices" that are designed to directly transfer their mechanical energy to an electrical generator to generate electrical energy and at least partially use the generated electrical energy to initiate an electrical initiator and are provided with the previously described all-fire event detection capability are hereinafter referred to as "self-powered electrically initiated inertial igniters". The "self-powered electrically initiated inertial igniters" may be provided with decision making electronics and/or microprocessors for initiating the electrical initiator, for example to activate a reserve battery or a munitions initiation train after certain time delay or when a sensory signal is received.

The disclosed "self-powered electrically initiated inertial igniters" utilize the firing acceleration to harvest mechanical energy and store it in a mechanical energy storage device and after the firing acceleration has ceased, convert it to electrical energy with the provided electrical generator(s) and at least partially use the generated electrical energy to initiate the provided electrical initiator.

The disclosed "self-powered electrically initiated inertial igniters" can be miniaturized and produced using available mass fabrication techniques and should therefore be low cost and reliable.

To ensure safety and reliability, all inertial igniters, including the disclosed "self-powered electrically initiated inertial igniters" must not initiate during acceleration events which may occur during manufacture, assembly, handling, transport, accidental drops, etc.

Additionally, once under the influence of an acceleration profile particular to the firing of the ordinance, i.e., a previously described all-fire condition, the igniter must initiate with high reliability. In many applications, these two requirements compete with respect to acceleration magnitude, but differ greatly in their duration. For example:

An accidental drop may well cause very high acceleration levels—even in some cases higher than the firing of a shell from a gun. However, the duration of this accidental acceleration will be short, thereby subjecting the "self-powered electrically initiated inertial igniters" to significantly lower resulting impulse levels.

It is also conceivable that the "self-powered electrically initiated inertial igniters" will experience incidental long-duration acceleration and deceleration cycles, whether accidental or as part of normal handling or vibration during transportation, during which it must be guarded against initiation. Again, the impulse input to the igniter will have a great disparity with that given by the initiation acceleration profile because the magnitude of the incidental long-duration acceleration will be quite low.

The need to differentiate accidental and initiation acceleration profiles by their magnitude as well as duration necessitates the employment of a safety system which is capable of allowing initiation of the "self-powered electrically initiated inertial igniters" only when all-fire acceleration profile conditions are experienced.

The need to differentiate accidental and initiation acceleration profiles by their magnitude threshold as well as minimum duration necessitates the employment of a safety system which is capable of allowing accumulation of mechanical energy and its conversion to electrical energy only when the aforementioned all-fire acceleration profile conditions are experienced In addition to having a required acceleration time profile as was previously described which should initiate generation of electrical energy and/or initiate an igniter, the all-fire and no-fire conditions may also be described by prescribed acceleration profiles, particularly for testing purposes. For example, the design requirements for initiation for one application may be summarized as:

1. The device must fire when given a half sine pulse firing setback acceleration with a peak acceleration of 1,200 G±200 G for 20 msec.
2. The device must not fire when subjected to a half since acceleration of 3000 G for 0.5 msec in any direction.

The individual components of the disclosed "mechanical energy harvesting devices", "electrical energy generator" and "self-powered electrically initiated inertial igniters" have been used in munitions, therefore the disclosed devices should be capable of readily satisfying most munitions requirement of 20-year shelf life and operation over the military temperature range of −65 to 165 degrees F., while withstanding high G firing accelerations.

Some of the features of the disclosed "electrically initiated inertial igniters" for use in reserve batteries, such as thermal batteries, initiation trains, and for providing electrical energy or all-fire detection functionality for gun-fired projectiles, mortars, sub-munitions, small rockets and the like include:

1. The disclosed "self-powered electrically initiated inertial igniters" are capable of being readily "programmed" to almost any no-fire and all-fire requirements or multiple predefined setback environments. For these reasons, the disclosed "self-powered electrically initiated inertial igniters" are ideal for almost any reserve battery and initiation train applications, including conformal small and low power reserve batteries for fuzing and other similar munitions applications.
2. The disclosed "self-powered electrically initiated inertial igniters" do not require any external power sources for their operation.
3. In those applications in which the reserve battery power is needed for guidance and control close to the target, the disclosed "self-powered electrically initiated inertial igniters" can be set (programmed) to initiate battery activation long after firing or be commanded by onboard control system or sensory input or the like to initiate battery activation, thereby significantly increasing the battery run time, particularly in the case of thermal batteries.
4. The disclosed "self-powered electrically initiated inertial igniters" are readily packaged in sealed housings using commonly used mass-manufacturing techniques. As a result, safety and shelf life of the igniter and the reserve battery and initiation train using the igniters and the projectile is significantly increased.
5. The design of the "self-powered electrically initiated inertial igniters" and their capability of being hermetically sealed should easily provide a shelf life of over 20 years and the components used in their design allow for their proper operation within the military temperature range of −65 to 165 degrees F.
6. The disclosed "self-powered electrically initiated inertial igniters" can be designed to withstand very high-G firing accelerations in excess of 50,000 Gs.
7. The disclosed "electrical energy harvesters" can be set (programed) to generate electrical energy when subjected to a prescribed all-fire event, i.e., a prescribed minimum acceleration level and minimum duration, and not generate any electrical energy when subjected to any no-fire acceleration events, such as the previously described no-fire conditions. The disclosed "electrical energy harvesters" can therefore be used for initiation of almost all available electrical initiation devices for reserve batteries, initiation trains or other similar applications.
8. The disclosed "self-powered electrically initiated inertial igniters", "mechanical energy harvesting devices" and "electrical energy harvesters" can be designed to conform to almost any geometrical shape of the available space in reserve batteries and munitions.

Accordingly, methods to design "mechanical energy harvesting devices" that harvest mechanical energy from the acceleration of the object to which they are attached, such as the firing setback acceleration of a gun-fired munition and store it in a mechanical energy storage device as potential and/or kinetic energy are provided.

Also provided are methods to design "mechanical energy harvesting devices" that can efficiently harvest mechanical energy from the acceleration of the object to which they are attached during almost the entire duration of the acceleration.

The "mechanical energy harvesting devices" may be provided with the means of differentiating a prescribed acceleration profile, with the prescribed acceleration profile being indicated as a minimum acceleration level and its duration, such as firing setback acceleration in munitions or target impact. In which case, if the prescribed acceleration profile is not detected, the "mechanical energy harvesting devices" either do not begin to harvest mechanical energy from the applied acceleration or discard the stored mechanical energy.

Also provided are "electrical energy generators" that use the above "mechanical energy harvesting devices" and convert the stored mechanical energy to electrical energy. Thereby providing "mechanical energy harvesting devices" that harvest mechanical energy from the acceleration of the object to which they are attached, such as the firing setback acceleration of a gun-fired munition, and convert the stored mechanical energy to electrical energy for direct use or for storage in an electrical energy storage device such as a capacitor and/or super-capacitor and/or rechargeable battery.

Also provided are "self-powered electrically initiated inertial igniters" that use the disclosed "mechanical energy harvesting devices" that are provided with the means of detecting prescribed acceleration profiles, with the prescribed acceleration profile being indicated as an acceleration level threshold and its minimum duration, such as firing setback acceleration in munitions or target impact, and upon detection of the prescribed acceleration profile would convert the stored mechanical energy to electrical energy, and use at least a portion of the generated electrical energy to initiate an electrical initiation device.

The electrical energy generating device can be an electromagnetic based electrical generator. The "mechanical energy harvesting device" may be provided with gearing and flywheel to increase the efficiency with which the stored mechanical energy is converted to electrical energy.

In addition, in certain applications, the electrical energy that is generated by the electrical energy generator of the "self-powered electrically initiated inertial igniter", for example an electromagnetic electrical generator, may be desired to be partially or completely stored in an electrical energy storage device such as a capacitor for later use by the system electronics or the like, such as for powering a timing and/or sensory circuitry for initiation of a reserve battery after a prescribed amount of time has elapsed and/or after a certain event has been detected. In such applications, it is highly desirable for the mechanical energy harvesting and the electrical energy generation be highly efficient to make it possible to minimize the size of the overall device.

It is appreciated by those skilled in the art that when harvesting mechanical energy from high G accelerations that last relatively long time, for example several thousand G over ten or more milliseconds, or other similar very high G and similar duration events, mechanical energy harvesting over close to the entire duration of the high G acceleration is very challenging. This is the case since mechanical energy is harvested by either displacement of a mass element or gained velocity, which would both be extremely high for a reasonably sized mechanical energy harvesting device. For example, if the firing acceleration is 4,000 G and its duration is 10 msec, the device mass would be displaced a distance d, given as:

$$d=(0.5)a\ t^2=(0.5)(4000\times 9.8)(0.010)^2=1.96m$$

And the final velocity V becomes:

$$V=a\ t=(4000\times 9.8)(0.010)=392\ \text{m/sec}$$

Thus, as can be seen, the resulting mass displacement and velocity are both too high for a direct mass displacement and/or velocity-based mechanism to be used for mechanical energy harvesting in munitions and almost all envisioned applications. In addition, currently used electrical energy collection and capacitor storage methods are inefficient when the input ("pulse") duration is very short.

Thus, methods and means are highly desirable to be developed for efficient harvesting of mechanical energy from short duration but high G accelerations and for storing the harvested mechanical energy in a mechanical energy storage device as potential and/or kinetic energy. The developed mechanical energy harvesting and storage devices must also be capable of transferring the stored mechanical energy to an electrical energy generator, such as an electromagnetic generator, to generate electrical energy for direct use and/or for storage in an electrical energy storage device such as a capacitor, super-capacitor or rechargeable battery.

Accordingly, methods and devices are provided for highly efficient harvesting of mechanical energy from short duration but high G accelerations and for storing the harvested mechanical energy in a mechanical energy storage device as potential and/or kinetic energy. Such short duration and high G accelerations are routinely encountered in munitions due to firing setback and target impact. The provided methods and devices provide the capability of transferring the stored mechanical energy to an electrical energy generator, such as an electromagnetic generator, to generate electrical energy for direct use and/or for storage in an electrical energy storage device such as a capacitor, super-capacitor or rechargeable battery.

There is also a need for methods for the design of devices that could detect prescribed acceleration event, the prescribed acceleration event defined as an acceleration level threshold and its minimum duration, and upon detection of the prescribed acceleration event to begin to generate electrical energy, the voltage and/or current produced by the generate electrical generator of the device may be used to provide the sensory input to the system electronics as the indication of the detection of the prescribed acceleration event, i.e., the all-fire condition in munitions.

Accordingly, methods and devices are provided for detecting prescribed acceleration events, the prescribed acceleration event defined as a minimum acceleration level and its duration, and upon the detection of the prescribed acceleration event to begin to generate electrical energy, the voltage and/or current produced by the generate electrical generator of the device would then provide the sensory information to the system electronics as an indication of the detection of the prescribed acceleration event.

A need also exists for methods to design battery-free inertially activated electrical initiation devices (i.e., the previously described "self-powered electrically initiated inertial igniters") with integrated safety to differentiate prescribed initiation acceleration profiles, defined as a minimum acceleration level and its duration (all-fire condition in munitions) from all accidental or short duration and large magnitude accelerations, such as those experienced in accidental drops, or long duration and low magnitude accelerations, such as those experienced during transportation (no-fire conditions in munitions). The said "self-powered electrically initiated inertial igniters" may be required to ignite the device pyrotechnic material a certain amount of time following detection of the aforementioned prescribed initiation acceleration profile (all-fire conditions in gun-fired munitions or after target impact), i.e., be provided with a time delay mechanism.

Accordingly, methods and devices are provided for "self-powered electrically initiated inertial igniters" that with integrated safety that can differentiate prescribed initiation acceleration profiles by their magnitude level threshold as well as minimum duration from all accidental or other short duration and large magnitude accelerations or long duration and low magnitude accelerations. The devices may be provided with ignition time delay capability.

In addition, there is a need for the said battery-free inertially activated electrical initiation devices ("self-powered electrically initiated inertial igniters") be capable of being miniaturized and protected from electromagnetic interference (EMI) and electromagnetic pulse (EMP).

Still further provided is methods for detecting the aforementioned prescribed initiation acceleration events by their magnitude threshold and minimum duration and then generating electrical energy and the onset of the generated electrical energy (usually detected voltage or current through a load element) indicating the detection of the said prescribed initiation acceleration event (firing event for the case of munitions or target impact), and providing electrical power to an internal component of the munition.

BRIEF DESCRIPTION OF THE DRAWINGS

These and other features, aspects, and advantages of the apparatus of the present embodiments will become better understood with regard to the following description, appended claims, and accompanying drawings where:

DETAILED DESCRIPTION

It is appreciated that the prior art method and devices disclosed in the U.S. Pat. Nos. 7,587,979 and 8,191,476 and 8,434,408, and as described above with regard to FIGS. 1*a*-1*d*, were developed for the design of mechanical delay mechanisms that are compact, low height, and that can be used for initiation of pyrotechnic materials or percussion caps or for performing electrical switching actions upon the detection of a prescribed minimum acceleration level with minimum duration (prescribed firing setback acceleration profile in munitions) and not when the device is subjected to any accidental acceleration events, such as short duration but high acceleration levels due to accidental drops on hard surfaces or other object impacts or low peak accelerations due to transportation vibration or the like.

In the present disclosure, a method of providing for sequential travel of mass elements of a multi-stage mechanism as the mechanism is subjected to an acceleration event is used to develop novel "mechanical energy harvesting devices" for efficiently harvesting mechanical energy from acceleration and storing it in mechanical energy storage devices; "electrical energy generators" that convert the mechanical energy stored in the "mechanical energy harvesting devices" to electrical energy for direct use by system electrical and electronic devices; and "self-powered electrically initiated inertial igniters" that use a portion of the electrical energy generated by the "electrical energy generators" to initiate electrical initiators directly or with a time delay or upon command from a sensory device or system controls.

Figure 1A:
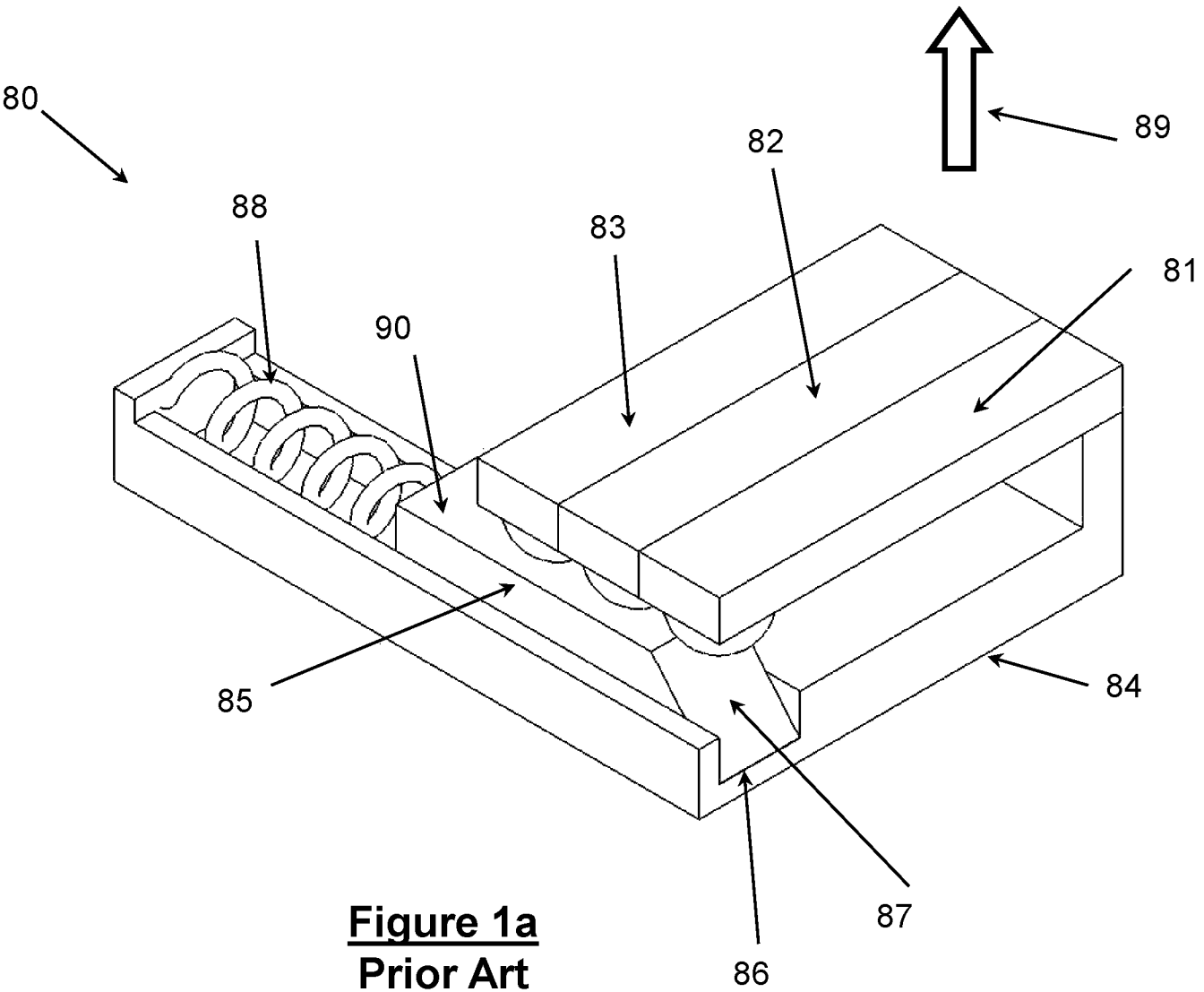
Figure 1a Prior Art
FIG. 1*a* illustrates an isometric view of a prior art embodiment of a multi-stage mechanical delay mechanism.
Figure 1C:
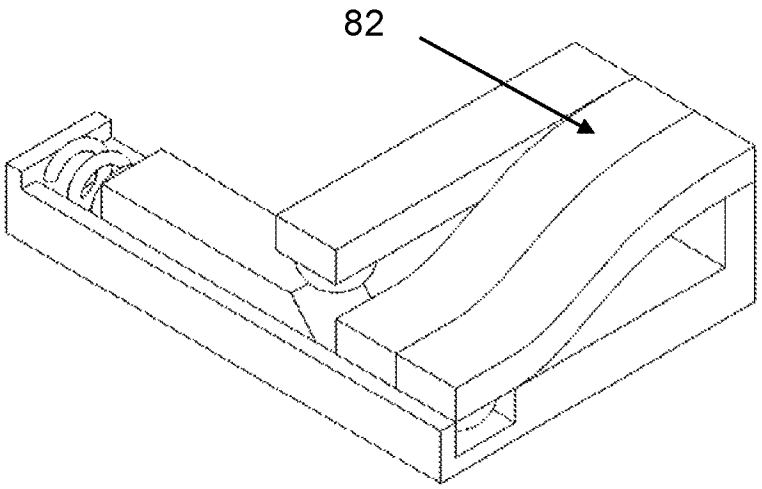
Figure 1c Prior Art
FIGS. 1*b*-1*d* illustrate the prior art multi-stage mechanical delay mechanism of FIG. 1*a* in various stages of acceleration.
Figure 1B:
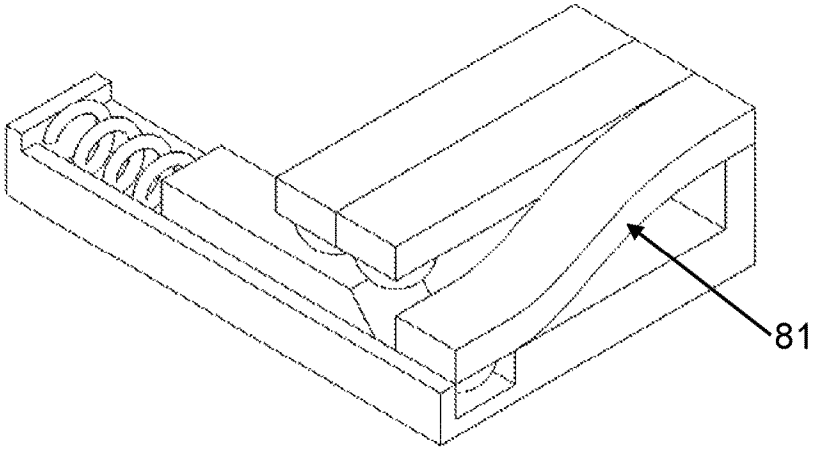
Figure 1b Prior Art
Figure 1D:
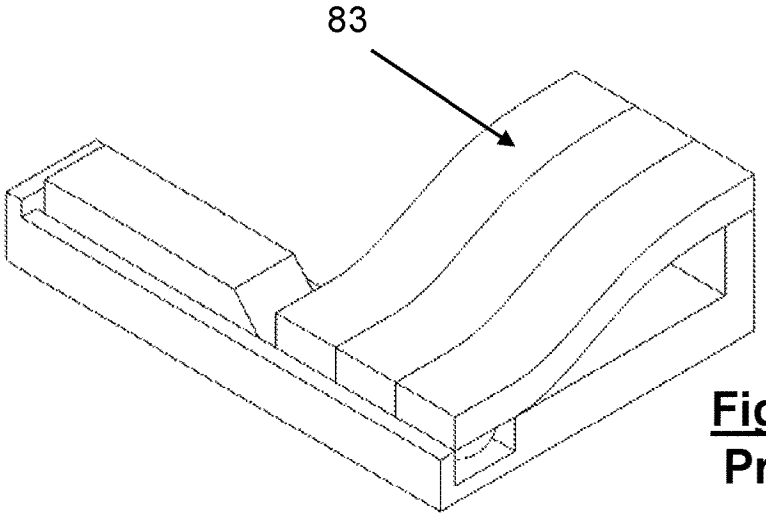
Figure 1d Prior Art
Figure 2:
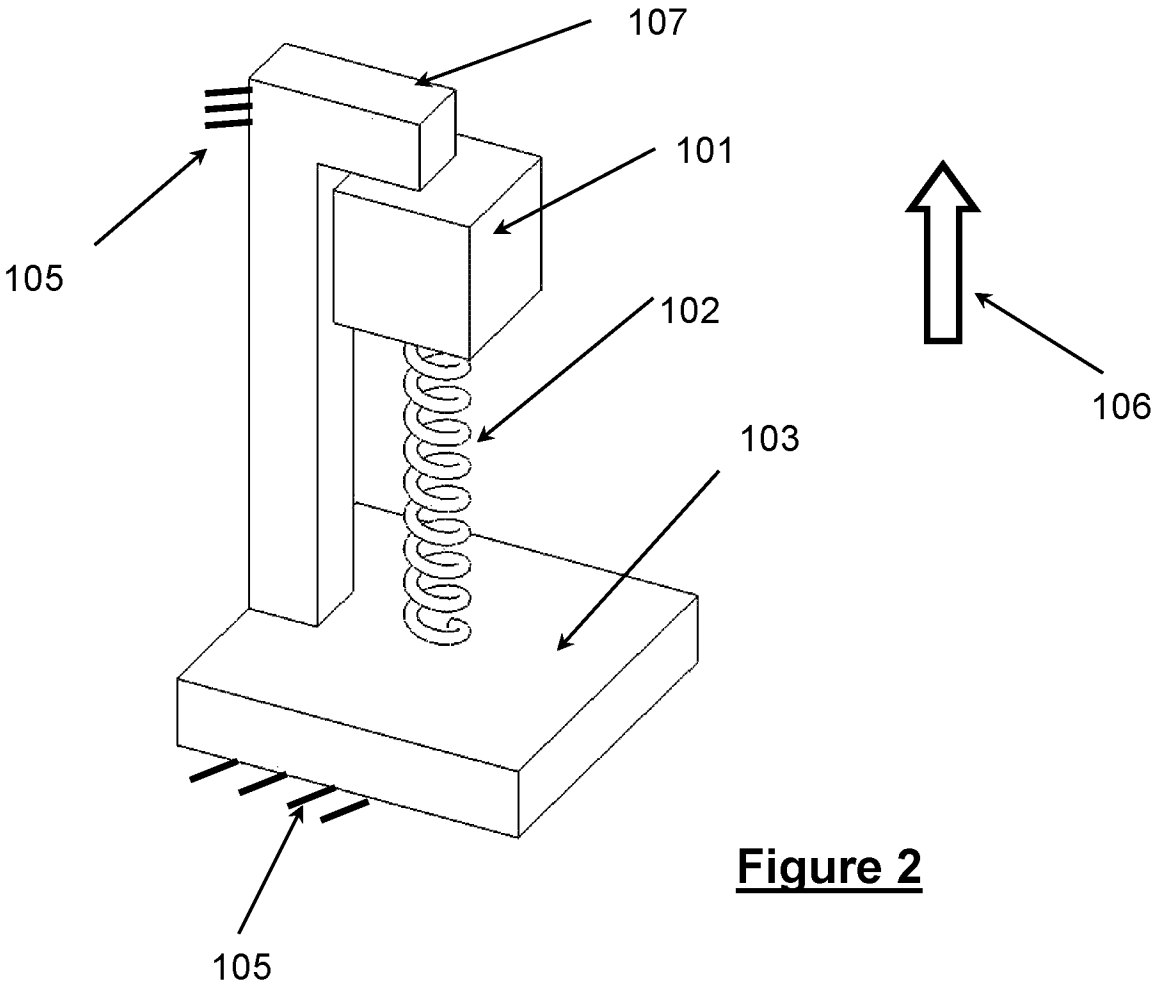
FIG. 2 illustrates an expansion constrained mass-spring model for evaluating delay time as a function of total vertical distance that the inertial (mass) element(s) of the various mechanical delay mechanisms have to travel.
Figure 3:
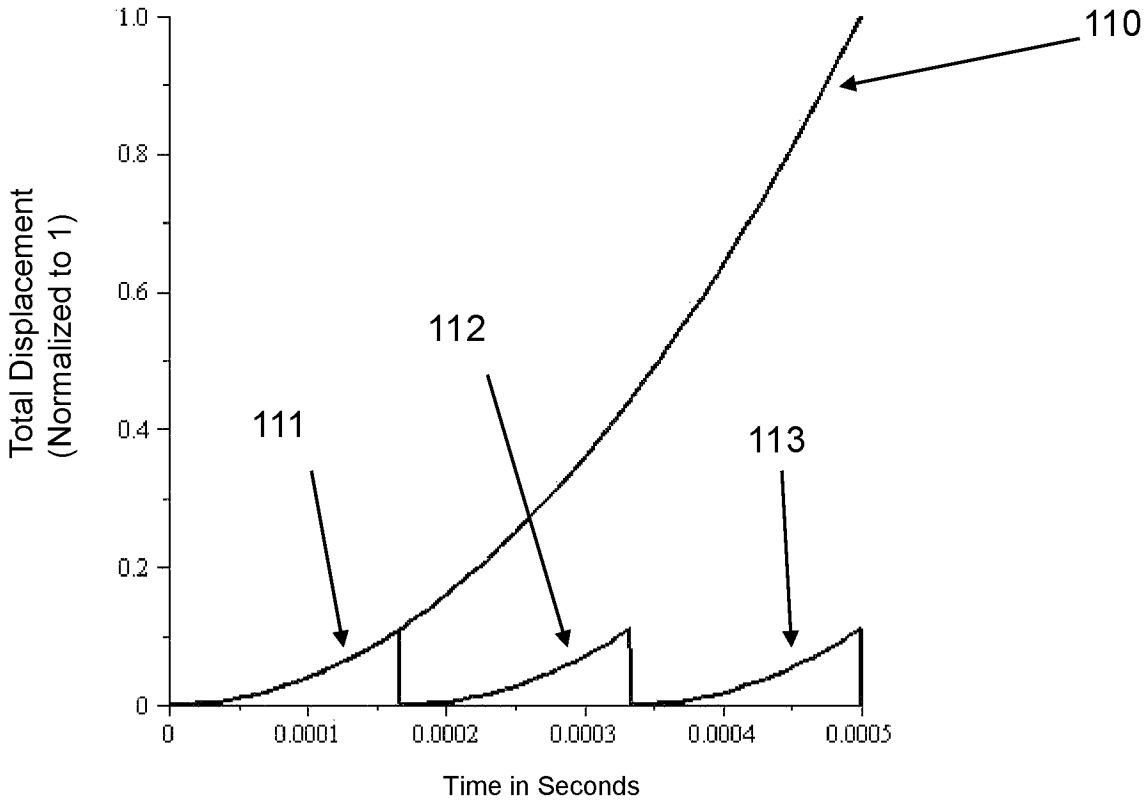
FIG. 3 illustrates a plot of the expansion constrained mass-spring model of FIG. 2 where a 2000 G pulse is applied to the base for 0.5 millisecond duration.

Now consider the mass-spring shown in the schematic of FIG. 2. The compressive spring 102 is considered to have a constant spring rate k. The spring is constrained in its preloaded position by the stop 107. Let the mass of the element 101 be indicated by m. Now when the base 103 of the unit is subjected to an acceleration $\alpha$ in the direction of the arrow 106, the acceleration a acts on the mass m of the element 101, applying a downward force F to the mass m equal to:

$$F=m\alpha \tag{2}$$

If the spring 102 is preloaded to a force $F_p$, then if the acceleration $\alpha$ is high enough to generate a downward force F that is larger than the preload force $F_p$, then the element 101 is displaced down a distance d to balance the downward force F, where the displacement d is determined from:

$$F-F_p=kd \tag{3}$$

Figure 4:
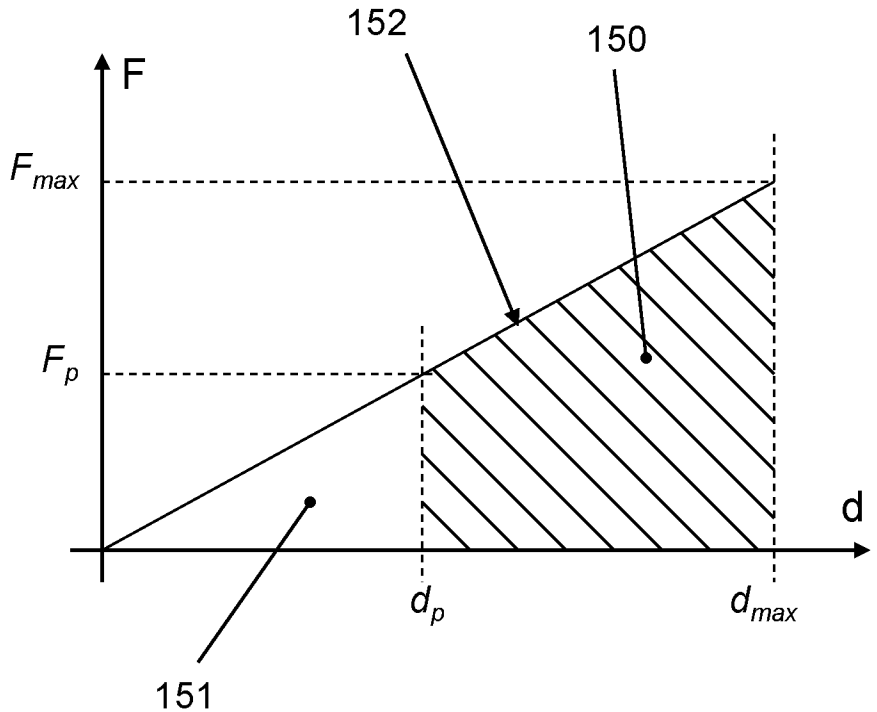
FIG. 4 illustrates a plot of the force vs. displacement of the mass-spring of FIG. 2 as the unit is subjected to increasing acceleration.

If we now plot the force F as a function of the spring deflection d from its free length, i.e., no preload condition) to its maximum deflection allowed by the 103 of the unit, FIG. 2, the plot of FIG. 4 is then obtained. In the plot of FIG. 4, the $d_p$ is the deflection of the spring 102 from its free length due to the applied preloading force $F_p$ and the deflection $d_{max}$ is considered to be the maximum deflection that the spring 102 can undergo due to the available space of the unit structure, at which time the maximum spring force $F_{max}$ is reached. It is appreciated by those skilled in the art that in the plot of FIG. 4, the deflection of the spring 102 from its free length to the deflection $d_p$ is due to the preloading of the spring 102 and the deflection from $d_p$ to $d_{max}$ is due to the acceleration $\alpha$ in the direction of the arrow 106 acting on the mass m of the element 101 as indicated by the equation (2).

In the plot of FIG. 4, the preloading deflection $d_p$ is set as half of the maximum possible deflection $d_{max}$ of the spring 102 for the purpose of making it easier to show the advantage of preloading springs in "mechanical energy harvesting devices" to be described later in this disclosure. Here, since the spring constant k of the spring 102 is considered to be constant, the spring force and deflection relationship is linear and is shown with the line 152 in FIG. 4. The area under the line 152 also indicates the amount of the work that is done on the spring to achieve the indicated spring deflection. For example, the area 151 is the amount of the work done by the force F to deflect the spring 102 distance $d_p$ from its free length, at which point the force has a magnitude of $F_p$. Once the spring is deflected a distance $d_p$, the work done by the force F to deflect the spring is stored in the spring as mechanical potential energy $E_p$ as:

$$E_p=(1/2)F_p d_p \tag{4}$$

However, if the spring 102 is preloaded by deflecting it a distance $d_p$ and is then deflected the same amount (as was assumed above that $d_{max}=2\ d_p$), then the area under the line 150 (cross hatched), i.e., the work done by the force to deflect the spring 102 from the deflection position $d_p$ to $d_{max}$ will be three times larger than that area 151, i.e., three times more mechanical potential energy is stored in the spring 102 for the same amount of spring deflection.

As a result, when vertical height of the "mechanical energy harvesting device" is desired to be low, then preloaded spring elements should be used for harvesting mechanical potential energy from acceleration events.

The method being disclosed for the design of "mechanical energy harvesting devices" that harvest mechanical energy from acceleration of the object to which they are attached can be used to store the harvested mechanical energy in linear springs or torsional (power) springs. Herein, the method is described by its application to a "mechanical energy harvesting device" that harvests mechanical energy from acceleration and stores it in a linear spring. This embodiment 160 of the "mechanical energy harvesting device" is shown schematically in FIG. 5.

Figure 5:
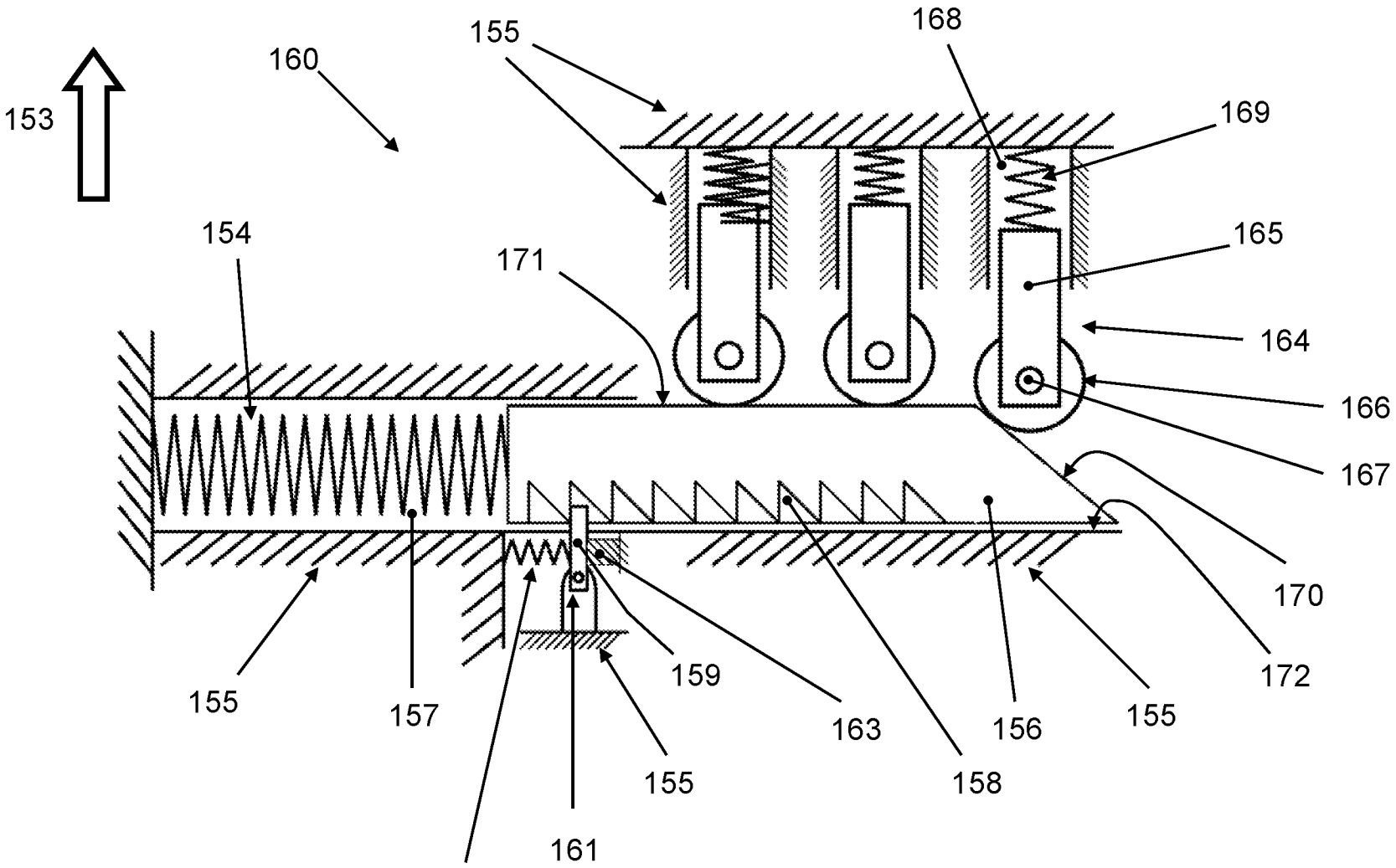
FIG. 5 illustrates the schematic of the first "mechanical energy harvesting device" embodiment.

The "mechanical energy harvesting device" embodiment 160 of FIG. 5 is designed to harvest mechanical energy from acceleration of the object to which the device is attached in the direction of the arrow 153 and store it in the compressive spring 154 as mechanical potential energy. The compressive spring 154 is appropriately preloaded as is described later in this enclosure to maximize the amount of mechanical energy that can be harvested from the acceleration.

The "mechanical energy harvesting device" embodiment 160 consists of a sliding member 156 that can slide in the provided guide 157 in the body 155 of the device. The sliding member 156 is provided with the notches 158 on at least one of its sliding surfaces as shown in FIG. 5. The notches 158 are used to engage the pawl 159, which is attached to the device body by the hinge 161 and is provided with the biasing compressively preloaded spring 162 that in normal conditions presses it against the provided stop 163, which is provided in the device body 155. The pawl 159 and its assembly with the spring 162 and stop 163 and the notches 158 that are provided on the sliding surface of the member 156 constitute a well-known ratchet mechanism that allows for the movement of the member 156 to the left as seen in the view of FIG. 5, i.e., in the direction of deflecting (i.e., compressing) the mechanical potential energy storage spring 154 of the device, but prevents its movement to the right.

The "mechanical energy harvesting device" embodiment 160 is also provided with multiple "mechanical energy collecting" units 164 (in the schematic of FIG. 5 three of such units are shown). The "mechanical energy collecting" units 164 may be identical, but as is described later in this disclosure, for optimal mechanical energy transfer and storage in the mechanical potential energy storage spring 154 they may have different effective mass and/or springs 169 with different levels of preloading.

Each "mechanical energy collecting" units 164 consists of a sliding member 165, which is free to slide up or down as viewed in the schematic of FIG. 5 in the guides 168 provided in the structure of the "mechanical energy harvesting device" embodiment 160. On the sliding member 156 side, the sliding members are provided with rollers 166, which are free to rotate about the shaft 167 that attaches them to the sliding member 165. On the opposite side of the sliding members 165, compressive springs 169 may be provided to keep the roller 166 in contact with a surface 170, 171 of the sliding member 156 as shown in FIG. 5. The compressive spring 169 can be selected to have low spring rate and can be slightly preloaded in compression to ensure roller contact with the top surface of the sliding member 156.

The "mechanical energy harvesting device" embodiment 160 functions as follows. Initially, the roller 166 of the first (right-most) "mechanical energy collecting" units 164 is in contact with the inclined surface 170 of the sliding member 156, while the other "mechanical energy collecting" units 164 (second and third from the right in FIG. 5) are in contact with the top straight surface 171 of the sliding member 156. When the object to which the device is attached is accelerated in the direction of the arrow 153, the acceleration acts on the total mass (inertia) of the sliding member 165 and roller 166 assembly and the contributing (equivalent) mass of the spring 169, resulting in a dynamic force (mass times acceleration) that in addition to the preloading force of the compressive spring 169 is applied by the roller 166 to the inclined surface 170 of the sliding member 156. The horizontal component (as seen in the view of the FIG. 5) of the dynamic and preloaded spring force applied by the roller 166 to the inclined surface 170 will then tend to displace the sliding member 156 to the left, thereby further deflecting the mechanical potential energy storage spring 154 in compression. The work done by the roller 166 force on the sliding member 156 is thereby stored in the spring 154 as mechanical potential energy.

In the meanwhile, the pawl 159 of the aforementioned ratchet mechanism is moved to one or more notches 158 of the sliding member 156 to the right. Thereby, if at this point of time the acceleration of the object to which the "mechanical energy harvesting device" embodiment 160 is attached is ceased, the said ratchet mechanism would prevent the sliding member 156 from returning to its initial position. The mechanical potential energy that is harvested from the acceleration of the said object would therefore stay stored in the mechanical potential energy storage spring 154.

Then as the roller 166 of the first "mechanical energy collecting" units 164 nears the bottom surface 172 of the guide 157 of the sliding member 156, the roller of the next "mechanical energy collecting" units 164 is positioned on the inclined surface 170 of the sliding member 156 and, if the acceleration continues, the roller of the next "mechanical energy collecting" units 164 continues to similarly force the sliding member to the left and further compress the mechanical potential energy storage spring 154, thereby storing more mechanical potential energy in the mechanical potential energy storage spring 154. In the meanwhile, the pawl 159 advances further to the notches 158 that are closer to the sliding surface 170, thereby preventing the mechanical potential energy stored in the mechanical potential energy storage spring 154 to be released when the acceleration in the direction of the arrow has ceased or has dropped below the level at which the pressing roller 166 cannot overcome the opposing force of the mechanical potential energy storage spring 154.

Then when the acceleration in the direction of the arrow 153 has ceased or has dropped below the level at which the pressing roller 166 cannot overcome the opposing force of the mechanical potential energy storage spring 154, the mechanical potential energy stored in the spring 154 is available for the intended function(s). These functions may include: (1) conversion to electrical energy; (2) transfer of the stored mechanical energy to another device, such as accelerating a striker mass to impact a percussion primer to initiate it, or displacing or rotating a link or an object; or (3) a combination of the two. Examples of embodiments performing such functions are described later in this disclosure.

It is appreciated by those skilled in the art that after the "mechanical energy harvesting device" embodiment 160 of FIG. 5 is subjected to an acceleration event in the direction of the arrow 153 that is strong enough and lasts long enough to actuate at least one of the device "mechanical energy collecting" units 164, the mechanical potential energy stored in the mechanical potential energy storage spring 154 is retained by the action of the "ratchet" mechanism of the notches 158 and pawl 159. Therefore, if the "mechanical energy harvesting device" is subjected to a next similar acceleration event, the mechanical potential energy gets accumulated in the mechanical potential energy storage spring 154 until the device reaches its maximum limit, generally when the last "mechanical energy collecting" unit 164 has been actuated as shown in FIG. 6 or when the storage spring 154 is fully engaged (i.e., compressed).

Such "mechanical energy harvesting devices" are suitable for many applications. For example, for applications in which the device is subjected to numerous acceleration events with high enough levels and duration and the amount of stored mechanical potential energy has to reach a certain threshold level before it should be transferred to another device for performing certain task(s). Examples include devices used to generate electrical energy and that a minimum amount of electrical energy is needed to perform a certain task or for the electrical generator to operate efficiently.

Figure 6:
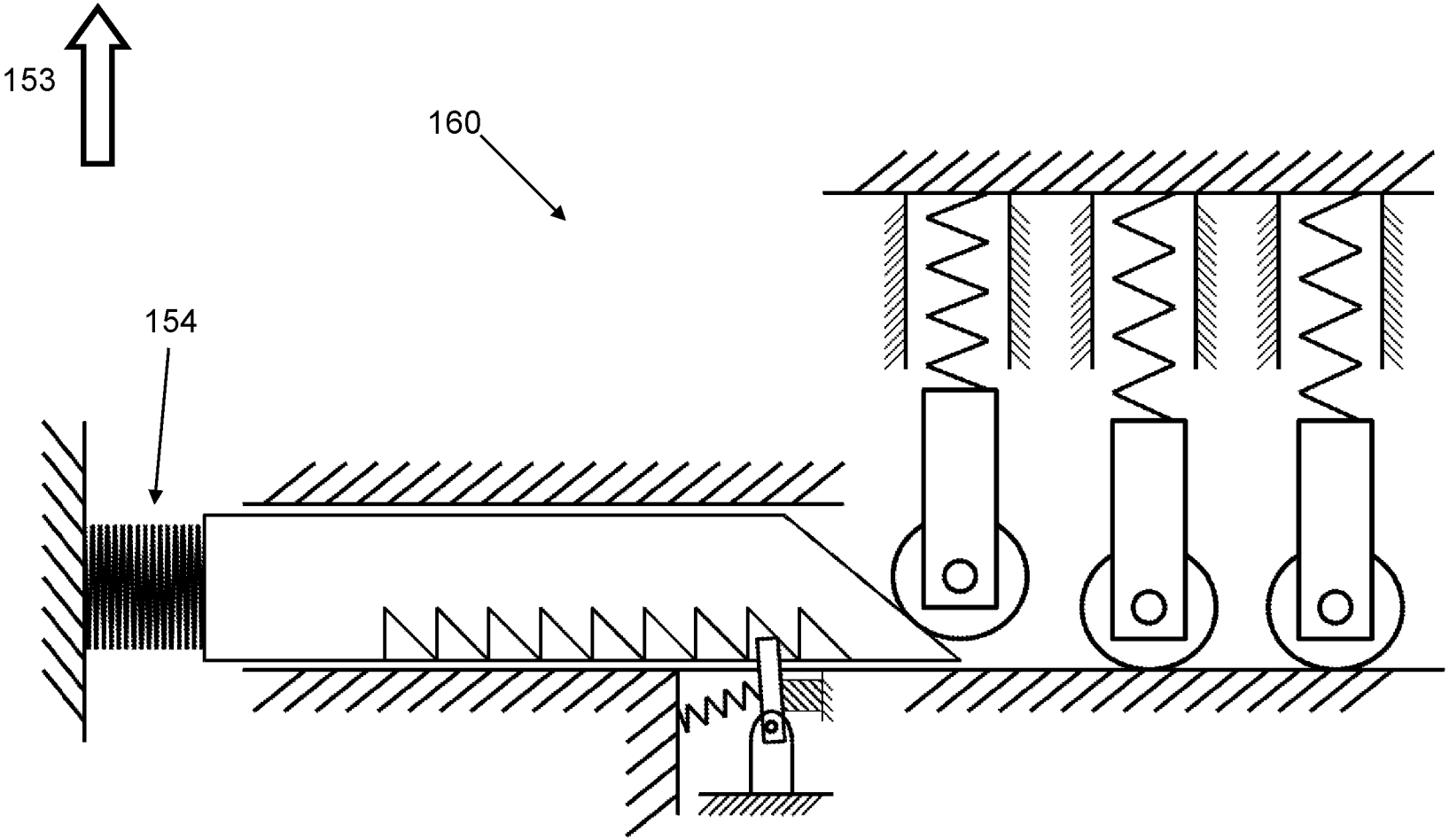
FIG. 6 illustrates the schematic of the first "mechanical energy harvesting device" embodiment of the FIG. 5 after harvesting mechanical energy from the applied acceleration.
Figure 7:
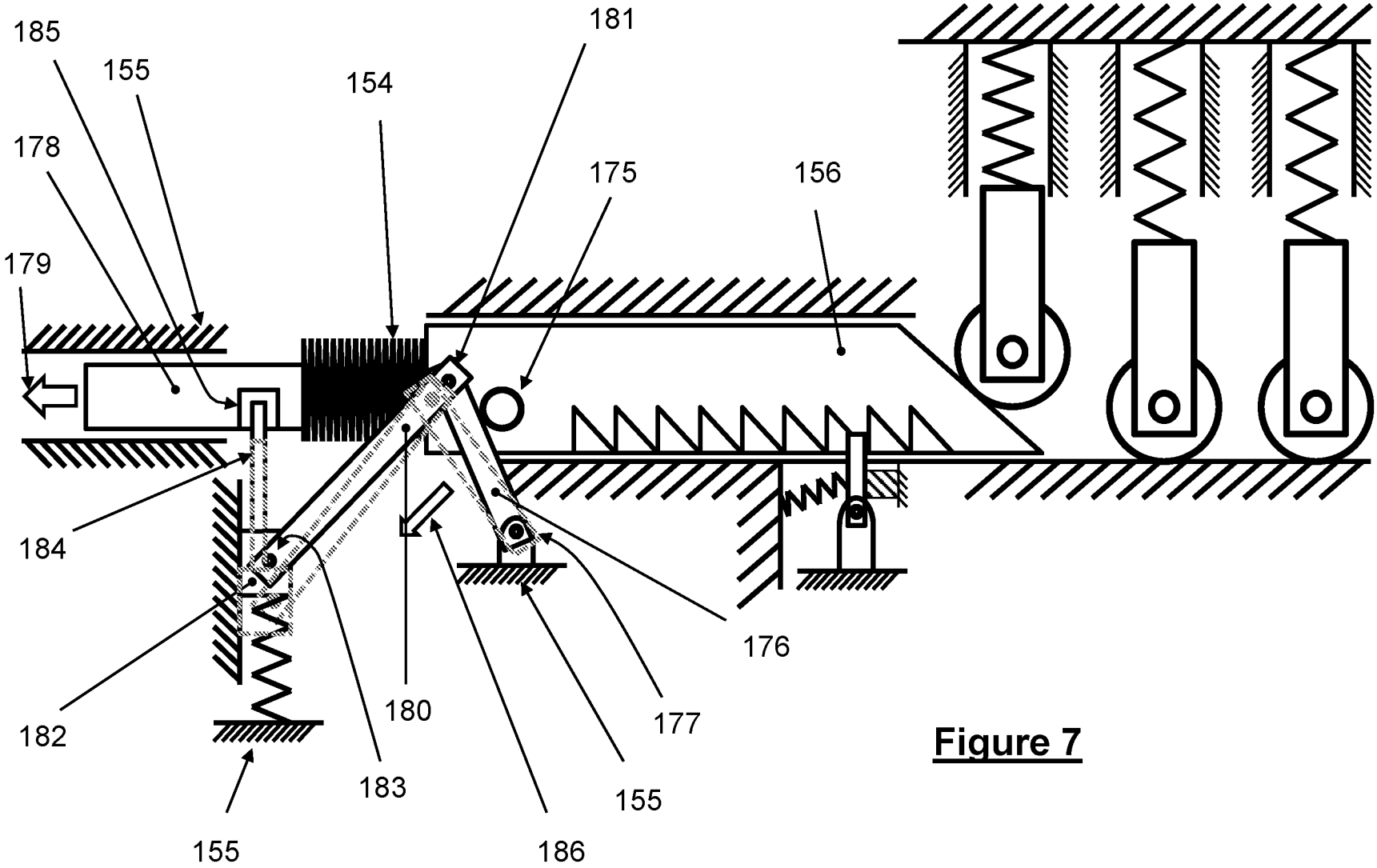
FIG. 7 illustrates the schematic of the first "mechanical energy harvesting device" embodiment of the FIG. 5 with a mechanism for releasing the stored mechanical energy.

One mechanism for releasing the mechanical energy stored in the mechanical energy storage spring 154, FIG. 6, is shown in the schematic of FIG. 7. In this embodiment, the mechanical energy stored in the mechanical energy storage spring 154 is intended to be released and transferred to the sliding member 178, which is free to slide in the direction arrow 179, The sliding member 178 is then used to perform one or more functions, such as generating electrical energy or performing other intended tasks.

In the embodiment of FIG. 7, the sliding member 156 is provided with an actuating pin 175 which is used to drive the mechanism that would release the mechanical energy stored in the storage spring 154. The release mechanism consists of the link 176, which is attached to the device body 155 by the rotary joint 177. A link 180 is then attached to the free end of the link 176 via the joint 181 on one end and to the sliding block 182 via the joint 183 on the other end. The block 182 is provided with a guide (not show) that restricts it to movement against the device body as shown in FIG. 7. The member 184 is fixedly attached to the block 182 as shown in FIG. 7, which engages a slot 185 provided in the sliding member 178, preventing its movement while the mechanical energy storage spring being compressed by the sliding member 156 as a result of the device acceleration in the direction of the arrow 153, FIG. 5, as was previously described.

In the configuration of FIG. 7, the sliding member 156 is shown to have been pushed to the left by the previously described action of the "mechanical energy collecting" units 164 so that the actuating pin 175 has come into contact with the link 176. Now further leftward movement of the sliding member 156 by the engaging "mechanical energy collecting" unit, FIG. 7, would cause the link 176 to be rotated in the counter-clockwise direction as shown by the arrow 186, thereby forcing the block 182 to be moved downward by the connecting link 180, thereby disengaging the member 184 from the slot 185 in the sliding member 178, thereby allowing the mechanical energy stored in the mechanical energy storage spring 154 to be transferred to the sliding member 178. The sliding member could then transfer the mechanical energy to other devices and/or perform certain function that requires mechanical energy input.

In certain applications, such as in gun-fired munitions applications, the "mechanical energy harvesting device" must be capable of differentiating a prescribed minimum acceleration level with minimum duration (prescribed firing setback acceleration profile in munitions) from all accidental acceleration events, such as short duration but high acceleration levels due to accidental drops on hard surfaces or other object impacts (usually durations of the order of 0.5 msec or less) or low peak accelerations due to transportation vibration or the like. Such a capability is readily provided to the "mechanical energy harvesting device" embodiment 160 of FIG. 5 by the simple modification to the sliding member 156 as shown in the schematic of FIG. 8A.

Figure 8A:
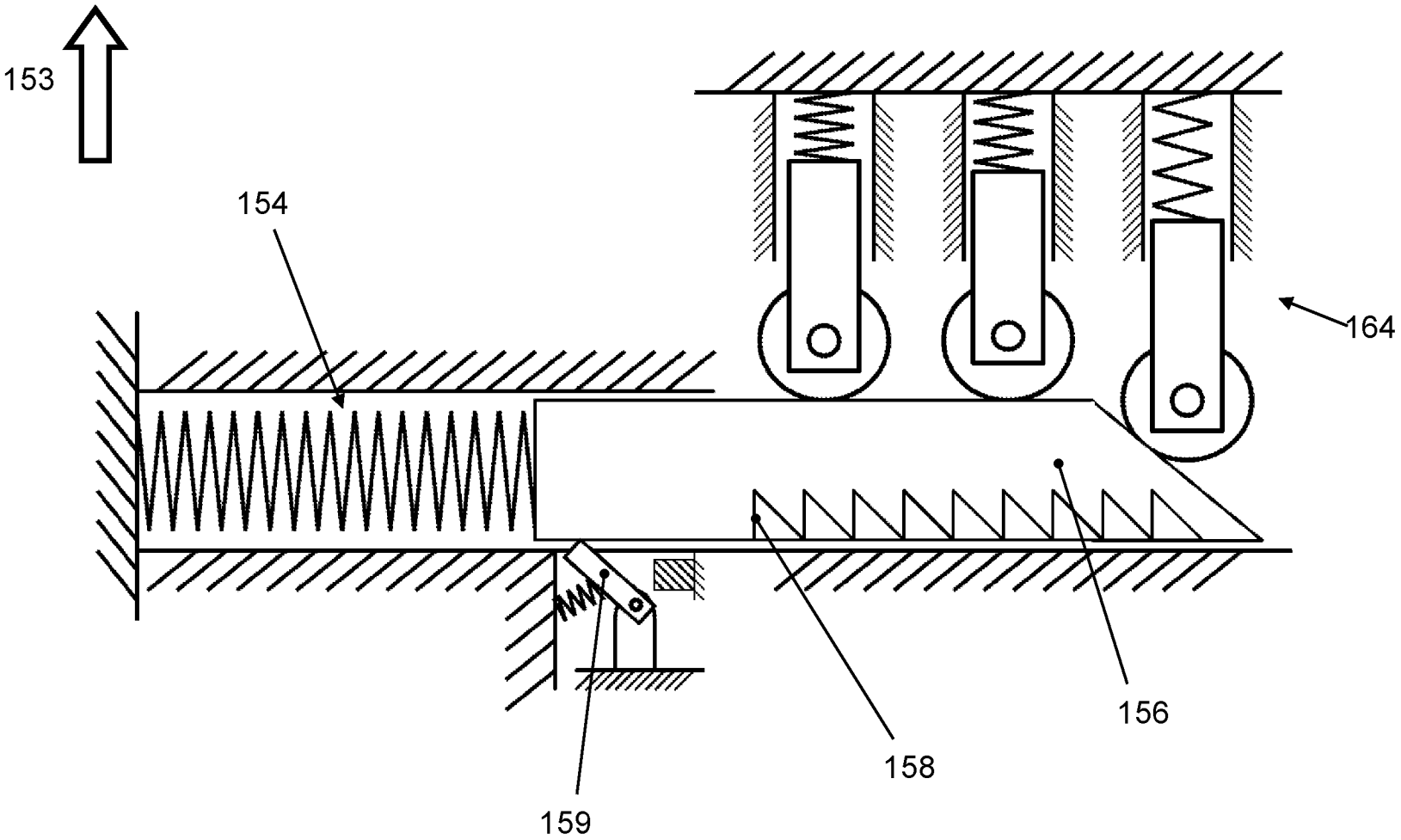
FIGS. 8A-8B illustrates the schematic of a modified "mechanical energy harvesting device" embodiment of FIG. 5 that is designed to release the stored mechanical potential energy if a prescribed acceleration level and its duration is not detected.
Figure 8B:
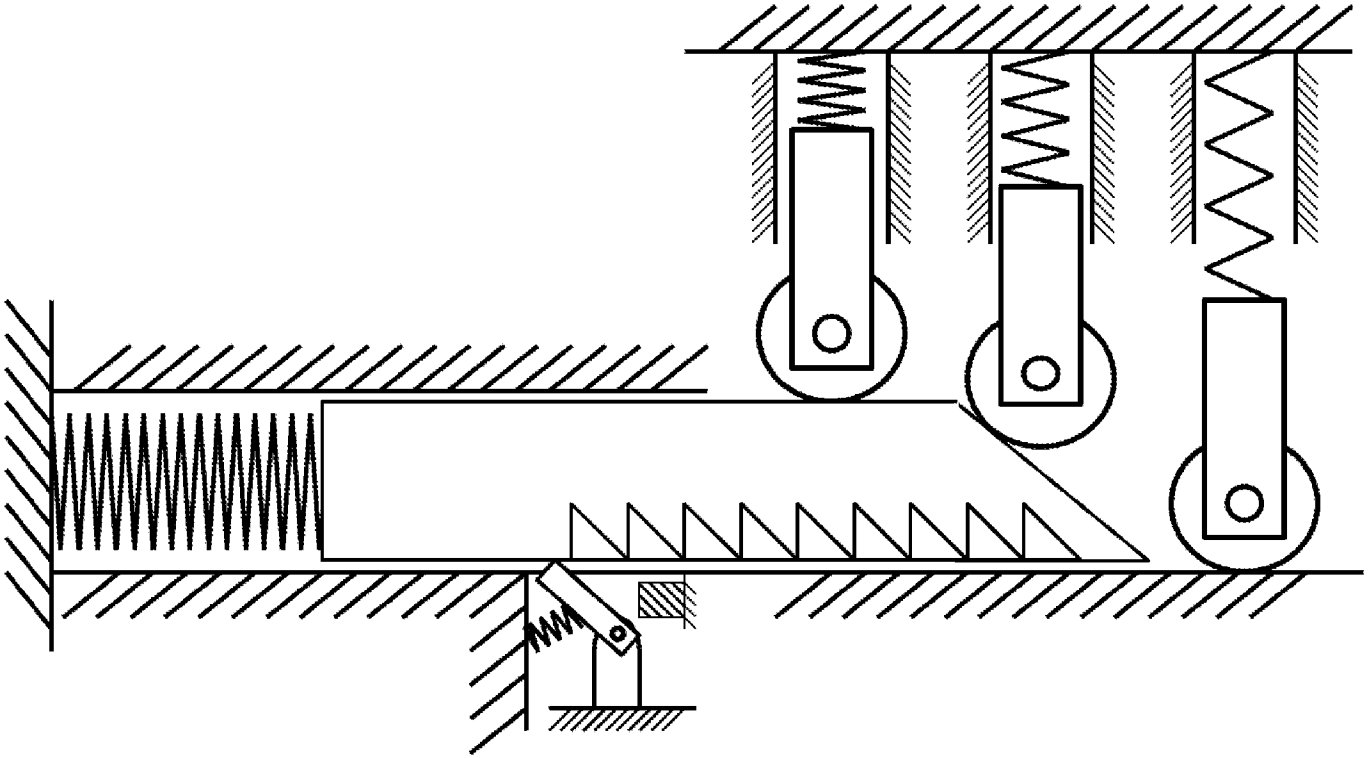

In the modified "mechanical energy harvesting device" embodiment 160 of FIG. 5, notches 158 are positioned in the sliding member 156 away from the pawl 159 enough so that if the prescribed acceleration threshold and its duration are not reached, the "mechanical energy collecting" units 164 would not displace the sliding member 156 to the left as viewed in the schematic of FIG. 8 enough for the pawl 159 to engage the first notch 158, such as shown in FIG. 8B. In the schematic of FIG. 8B, the first "mechanical energy collecting" units 164 is shown to be fully actuated and the second "mechanical energy collecting" units 164 is half-way actuated under the applied acceleration to the device in the direction of the arrow 153, FIG. 5. At this point, the acceleration has dropped or ceased so that the sliding member 156 cannot be further displaced to the left, FIG. 8B. Once the acceleration in the direction of the arrow 153 has ceased or dropped further, the mechanical energy storage spring 154 would force the sliding member 156 to return to its initial positioning of FIG. 8A. As a result, if the device is not subjected to the prescribed acceleration threshold and its duration (all-fire condition in munitions), no mechanical energy would remain stored in the mechanical energy storage spring 154.

Now consider the mechanical energy harvesting embodiment of FIG. 7. It is appreciated by those skilled in the art that once the sliding member 178 is released, the mechanical potential energy stored in the "mechanical energy storage" spring 154 begins to be transferred to the sliding member 178 via the spring 154 force acting on the mass (inertia) of the sliding member 178. The sliding member 178 may then be used to perform certain tasks, such as actuate certain mechanism or transfer the mechanical energy to an electrical generator to generate electrical energy. Examples of such use of the released mechanical energy, particularly for switching or initiation of certain actions are described below.

Figure 9B:
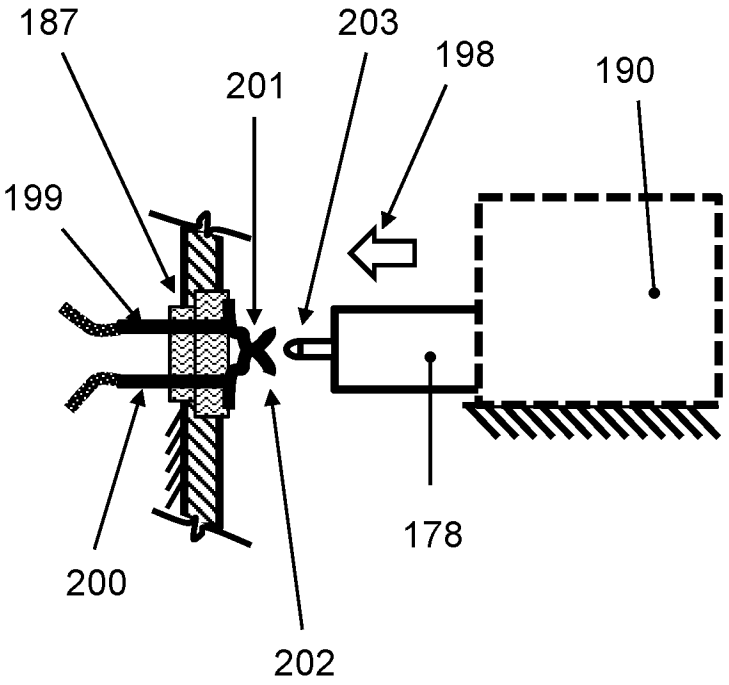
FIG. 9B illustrates the schematic of the normally closed electrical switch embodiment constructed with the "mechanical energy harvesting device" embodiment of FIG. 7.
Figure 9A:
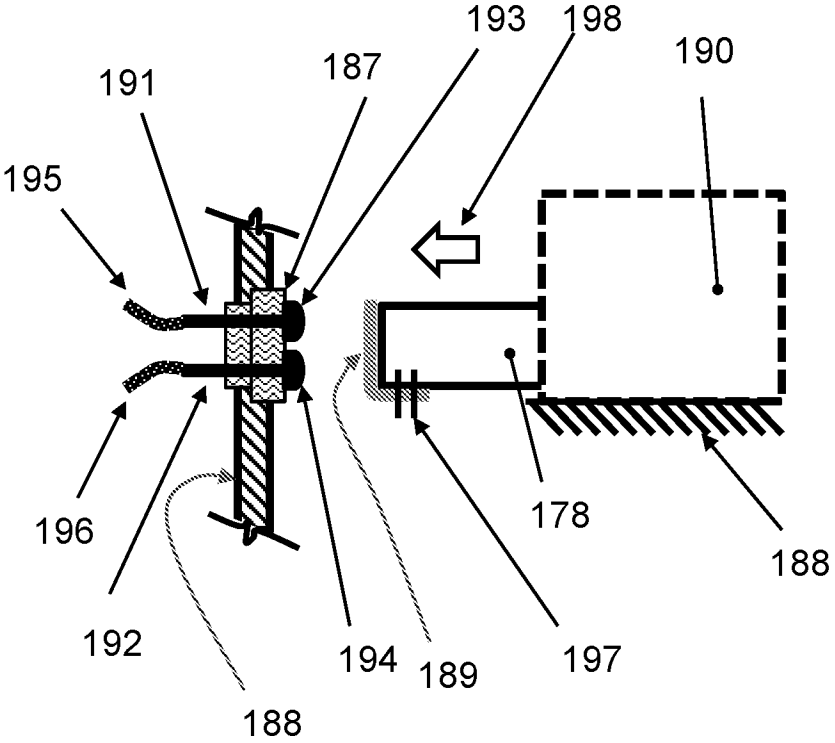
FIG. 9A illustrates the schematic of the normally open electrical switch embodiment constructed with the "mechanical energy harvesting device" embodiment of FIG. 7.

In one such embodiment, the mechanical energy harvesting embodiment of FIG. 7 is used to close or open an electrical switch as shown in FIGS. 9A and 9B, respectively. In FIGS. 9A and 9B, the mechanical energy harvesting embodiment of FIG. 7 is shown as a dotted box and is indicated by the numeral 190, except for the sliding member 178 which is released following the previously described process of actuation by the "mechanical energy collecting" units 164 and forced out in the direction of the arrow 179 (198 in FIGS. 9A and 9B) by the "mechanical energy storage" spring 154.

In the schematic of FIG. 9A, the normally open electrical switch is configured to close an electrical circuit once the sliding member 178 of the mechanical energy harvesting embodiment of FIG. 7 is released. In the normally open electrical switch of FIG. 9A, an element 187, which is constructed of an electrically non-conductive material is fixed to the device structure 188 (155 in FIG. 7). The element 187 is provided with two electrically conductive elements 191 and 192 with contact ends 193 and 194, respectively. The electrically conductive elements 191 and 192 may be provided with extended ends as shown in FIG. 9A to form contact "pins" for direct insertion into provided holes in a circuit board or may alternatively be provided with wires 195 and 196 for connection to appropriate circuit junctions. The sliding member 178 is then provided with a flexible strip of electrically conductive material 189, which is fixed to the sliding member as shown in FIG. 9A by the fasteners 197 or other commonly known method in the art.

The normally open electrical switch of FIG. 9A functions as follows. Once the sliding member 178 of the mechanical energy harvesting embodiment of FIG. 7 is released, the mechanical energy storage spring 154 would force the sliding member 178 to move in the direction of the arrow 198 until the flexible electrically conductive strip 189 come into contact with the contacts 193 and 194, thereby causing the circuit through the wires 195 and 196 (or electrically conductive elements 191 and 192) to close.

The normally open electrical switch of FIG. 9A can be readily modified to provide a "normally closed" electrical switch. All the components of the "normally closed" electrical switch embodiment of FIG. 9B are the same as those of the "normally open" embodiment of FIG. 9A, except the following electrical circuit closing elements. The "normally closed" electrical switch of FIG. 9B is provided with two electrically conductive contact elements 199 and 200, which are fixed to the electrically non-conductive member 187, which is fixed to the device structure 188 as shown in FIG. 9A. The electrically conductive contact elements 199 and 200 are similarly provided with the extended ends or wires 195 and 196, FIG. 9A, for connection to appropriate circuit junctions.

To the electrically conductive contact elements 199 and 200 are fixedly attached flexible conductive strips 201 and 202 as shown in FIG. 9B, which are normally in contact, thereby causing the contact elements 199 and 200 (and wires 195 and 196, FIG. 9A, when provided) to close the electrical circuit to which they are connected to. The sliding member 178 is provided with a non-conductive element 203 as shown in FIG. 9B.

The normally closed electrical switch of FIG. 9B functions as follows. Once the sliding member 178 of the mechanical energy harvesting embodiment of FIG. 7 is released, the mechanical energy storage spring 154 would force the sliding member 178 to move in the direction of the arrow 198 until the non-conductive element 203 come into contact with the flexible conductive strips 201 and 202 and inserting the non-conductive element 203 between the contacting surfaces of the flexible conductive strips 201 and 202, thereby rendering their contacts open, thereby opening the electrical circuit to which the contact elements 199 and 200 (and wires 195 and 196, FIG. 9A, when provided) are connected.

The electrical contacts can also be provided directly on an electronic/electrical device and the wiring can be integrally formed on a substrate in or on the device.

Figure 9C:
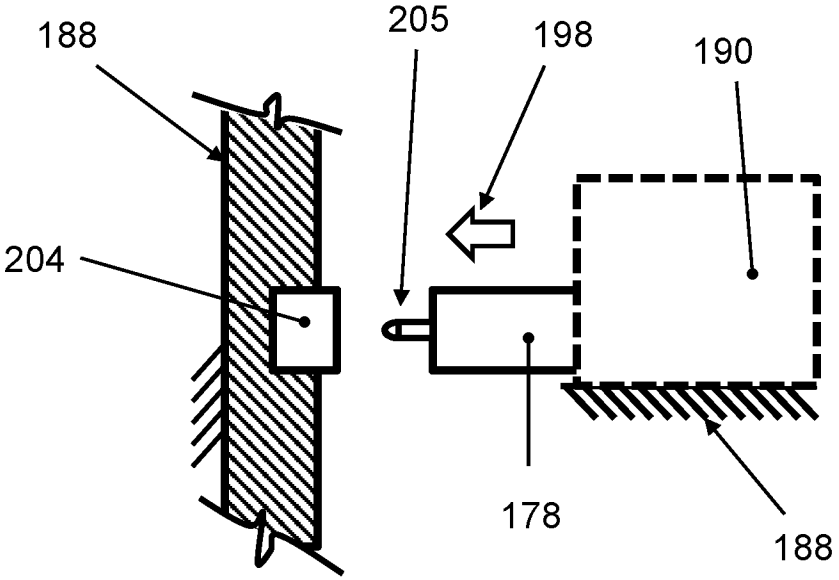
FIG. 9C illustrates the schematic of percussion primer initiator embodiment constructed with the "mechanical energy harvesting device" embodiment of FIG. 7.

In another embodiment, the mechanical energy harvesting embodiment of FIG. 7 is used to initiate a percussion primer (or other similarly provided pyrotechnic material) as shown in FIG. 9C. In FIG. 9C the mechanical energy harvesting embodiment of FIG. 7 is still shown as a dotted box and is indicated by the numeral 190, except for the sliding member 178 which is released following the previously described process of actuation by the "mechanical energy collecting" units 164 and forced out in the direction of the arrow 179 (198 in FIG. 9C) by the "mechanical energy storage" spring 154, FIG. 7.

In the schematic of FIG. 9C, the percussion primer initiator is configured to ignite the percussion primer 204 once the sliding member 178 of the mechanical energy harvesting embodiment of FIG. 7 is released. In the percussion primer initiator of FIG. 9C, a percussion primer (or similar impact-initiated igniter) is fixed to the device structure 188 (155 in FIG. 7) or to another element, such as a thermal battery. The element 187 is provided with a tip element 205 that is sized to ignite the percussion primer 204 upon impact.

The percussion primer initiator embodiment of FIG. 9C functions as follows. Once the sliding member 178 of the mechanical energy harvesting embodiment of FIG. 7 is released, the mechanical energy storage spring 154 would force the sliding member 178 to move in the direction of the arrow 198 and gain speed until the tip element 205 impacts the percussion primer 204 and causes it to ignite. If element 188 is another device, the same can have a hole behind the primer 204 such that, when ignited, flame/sparks can pass through the hole to another device, such as the thermal battery.

Figure 9D:
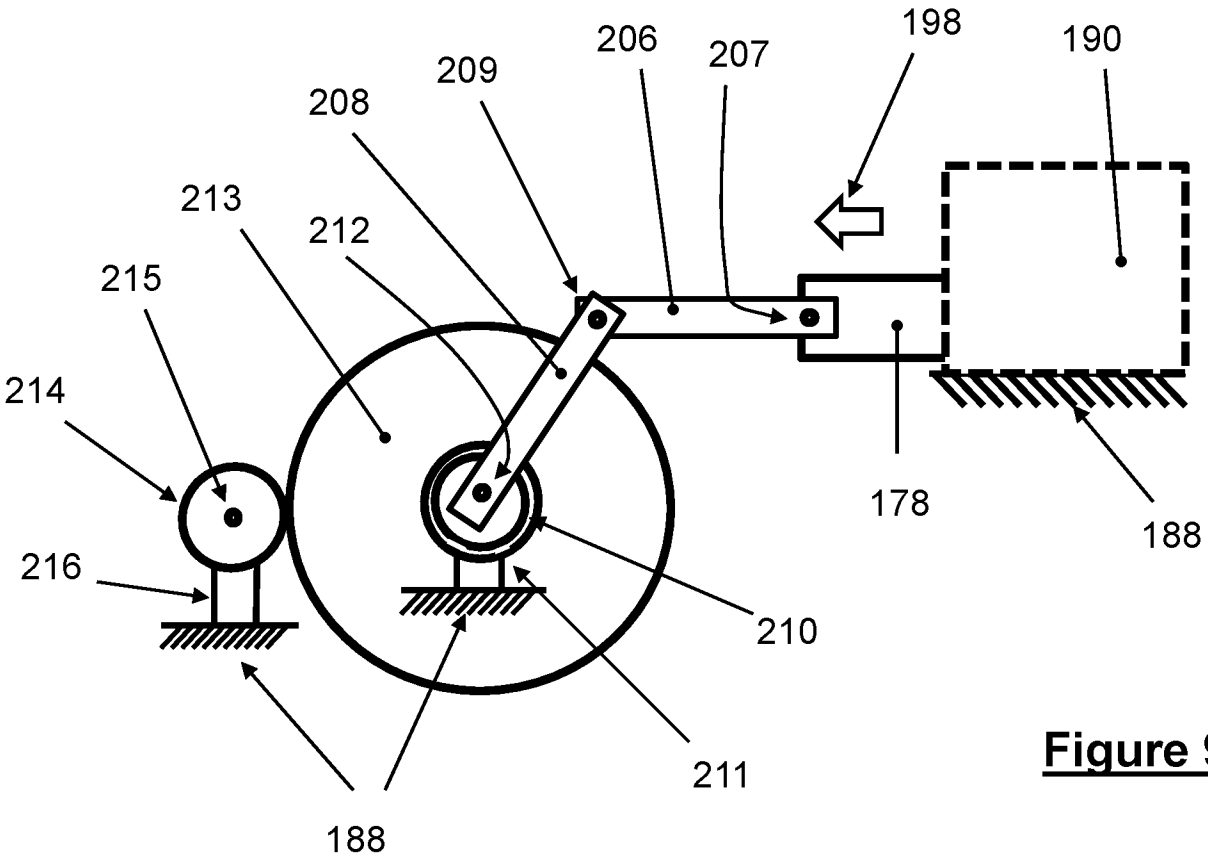
FIG. 9D illustrates he schematic of an electrical energy harvesting embodiment constructed with the "mechanical energy harvesting device" embodiment of FIG. 7.

In yet another embodiment, the mechanical energy harvesting embodiment of FIG. 7 is used to generate electrical energy as shown in FIG. 9D. In FIG. 9D the mechanical energy harvesting embodiment of FIG. 7 is still shown as a dotted box and is indicated by the numeral 190, except for the sliding member 178 which is released following the previously described process of actuation by the "mechanical energy collecting" units 164 and forced out in the direction of the arrow 179 (198 in FIG. 9D) by the "mechanical energy storage" spring 154, FIG. 7.

In the schematic of FIG. 9D, the sliding member 178 is attached to a link 206 via a rotary joint 207. The other end of the link 206 is attached to another link 208 via a rotary joint 209. The other end of the link 208 is then fixedly attached to the inner rotating component of a rotary one-way clutch 210, which is attached to the support member 211 via the shaft 212. The support member 211 is fixedly attached to the device structure 188. The outer race of the one-way clutch 210 is fixedly attached to a flywheel member 213. The one-way clutch 210 is mounted such that the counter-clockwise rotation of the link 208 would engage the clutch and force the flywheel 213 to rotate in the counter-clockwise direction, but clockwise rotation of the link 208 relative to the flywheel 213 causes the clutch 210 to disengage. As a result, the flywheel 213 is always free to rotate in the counter-clockwise direction. The flywheel 213 is provided with an engaging surface, such as a gear (not shown and can be on the outside diameter of the flywheel 213), which engages a corresponding surface of a pinion 214 (such as mating gear teeth, not shown), which is free to rotate about the shaft 215, which is mounted in a bearing in the support member 216, which is fixedly attached to the device structure 188. The gear 214 is then use to drive an electrical generator (not shown), which might be integral to the gear or driven by the shaft 215 that is connected fixedly to the gear 214 or via another engaging gear as are all well known in the art.

The electrical energy generator embodiment of FIG. 9C functions as follows. Once the sliding member 178 of the mechanical energy harvesting embodiment of FIG. 7 is released, the mechanical energy storage spring 154 would force the sliding member 178 to move in the direction of the arrow 198. The sliding member 178 would then begin to drive the link 206, which would then drive the link 208, thereby transferring the mechanical energy stored in the mechanical energy storage spring 154 to the flywheel 213 as mechanical kinetic energy. Once the sliding member 178 has reached its maximum extent, which is can be configured to be before the links 206 and 208 become lined-up, the one-way clutch 210 would allow the flywheel 213 to continue to rotate in the counter-clockwise direction and for the flywheel (through its attached engagement surface or gear previously described) to rotate the pinion 214, thereby the electrical generator is driven by the pinion 214. The mechanical kinetic energy of the flywheel 213 is thereby transferred into electrical energy that can be used directly or stored in an electrical energy storage device such as a capacitor or a rechargeable battery for later use.

It is appreciated that the "mechanical energy harvesting device" embodiment 160 of FIG. 5 uses multiple "mechanical energy collecting" units 164 (in the schematic of FIG. 5 three of such units are shown) to force the sliding member 156 to compress the mechanical potential energy storage spring 154 when the device 160 is subjected to high enough acceleration in the direction of the arrow 153 to store mechanical potential energy in the spring 154 as was previously described. The same function of harvesting mechanical energy from the device acceleration and storing it in a mechanical energy storage spring can be performed by using mechanisms other than the previously described "mechanical energy collecting" units 164. One example of such an alternative "mechanical energy collecting" mechanism is shown in the schematic of FIG. 10.

Figure 10:
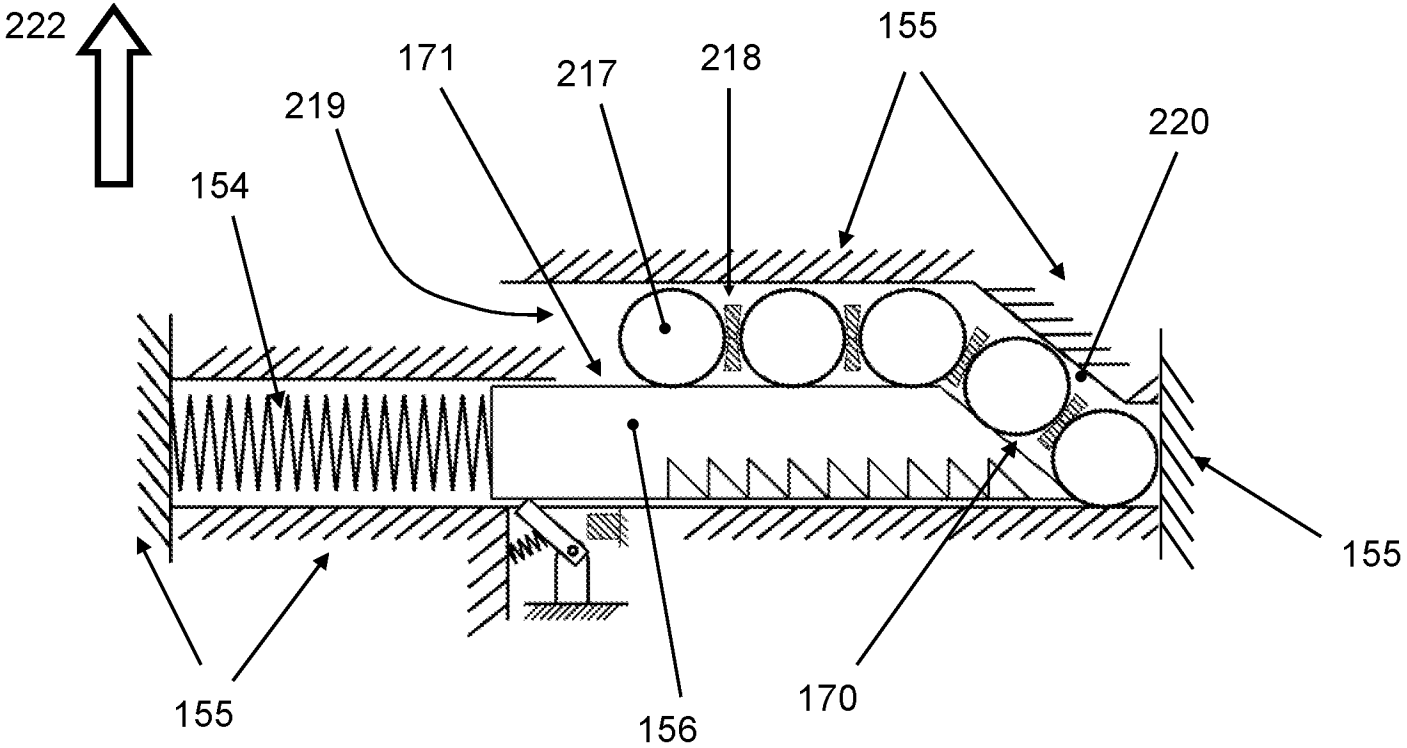
FIG. 10 illustrates the schematic of the second "mechanical energy harvesting device" embodiment.

The "mechanical energy harvesting device" embodiment of FIG. 10 is constructed by the modification of the embodiment of FIG. 8A. In the embodiment of FIG. 10, the "mechanical energy collecting" units 164 are replaced by rollers or balls (four of which are shown in FIG. 10) as described below. The remaining elements of the embodiments of FIG. 10 are identical to those of the embodiment of FIG. 8A and perform the same functions, except for the added elements that are herein described. The rollers (balls) 217 can be kept apart by a "cage" member 218, as is commonly used in roller (ball) linear and circulating bearings. The rollers (balls) are free to move in the guide 219 above the sliding member 156 provided in the device structure 155. The guide 219 in the structure 155 of the device is continued as indicated by numeral 220 which ends as can be seen in FIG. 10 inside the device structure 155.

The "mechanical energy harvesting device" embodiment of FIG. 10 is also configured to harvest mechanical energy from acceleration of the object to which the device is attached in the direction of the arrow 222 (153 in FIG. 8A) and store it in the compressive spring 154 as mechanical potential energy. The compressive spring 154 is appropriately preloaded as was previously described to maximize the amount of mechanical energy that can be harvested from the device acceleration.

The "mechanical energy harvesting device" embodiment of FIG. 10 functions as follows. Initially, the right most roller (ball) 217 is in contact with the inclined surface 170 of the sliding member 156, while the other rollers (second to fifth in FIG. 10) are in contact with the top straight surface 171 of the sliding member 156. When the object to which the device is attached is accelerated in the direction of the arrow 222, the acceleration acts on the mass (inertia) of the roller (ball) 217, resulting in a dynamic force (mass times acceleration) that is applied by the roller (ball) 217 to the inclined surface 170 of the sliding member 156. The horizontal component (as seen in the view of the FIG. 10) of the dynamic force applied to the inclined surface 170 will then tend to displace the sliding member 156 to the left, thereby further deflecting the mechanical potential energy storage spring 154 in compression. The work done by the roller (ball) 217 force on the sliding member 156 is thereby stored in the spring 154 as mechanical potential energy.

In certain applications, such as in gun-fired munitions applications, the "mechanical energy harvesting device" must be capable of differentiating a prescribed minimum acceleration level with minimum duration (prescribed firing setback acceleration profile in munitions) from all accidental acceleration events, such as short duration but high acceleration levels due to accidental drops on hard surfaces or other object impacts or low peak accelerations due to transportation vibration or the like. Such a capability is provided for the "mechanical energy harvesting device" embodiment of FIG. 10 as was described for the embodiment of FIG. 8A. If such a feature is not desired, then the notches 158 in the sliding member 156 can be arranged as shown in the embodiment 160 of FIG. 5 to allow accumulation of the harvested mechanical energy.

It is appreciated that the "mechanical energy harvesting device" embodiments of FIGS. 5, 8A and 10 are designed to linearly displace a sliding member 156 to deform the compressive spring 154 (however, a linear tensile spring may also be used but needs to be attached to the opposite end of the sliding member 154, i.e., to the side of the inclined surface 170), thereby harvesting mechanical energy from the acceleration of the device and store it in the spring 154 as mechanical potential energy.

Figure 11:
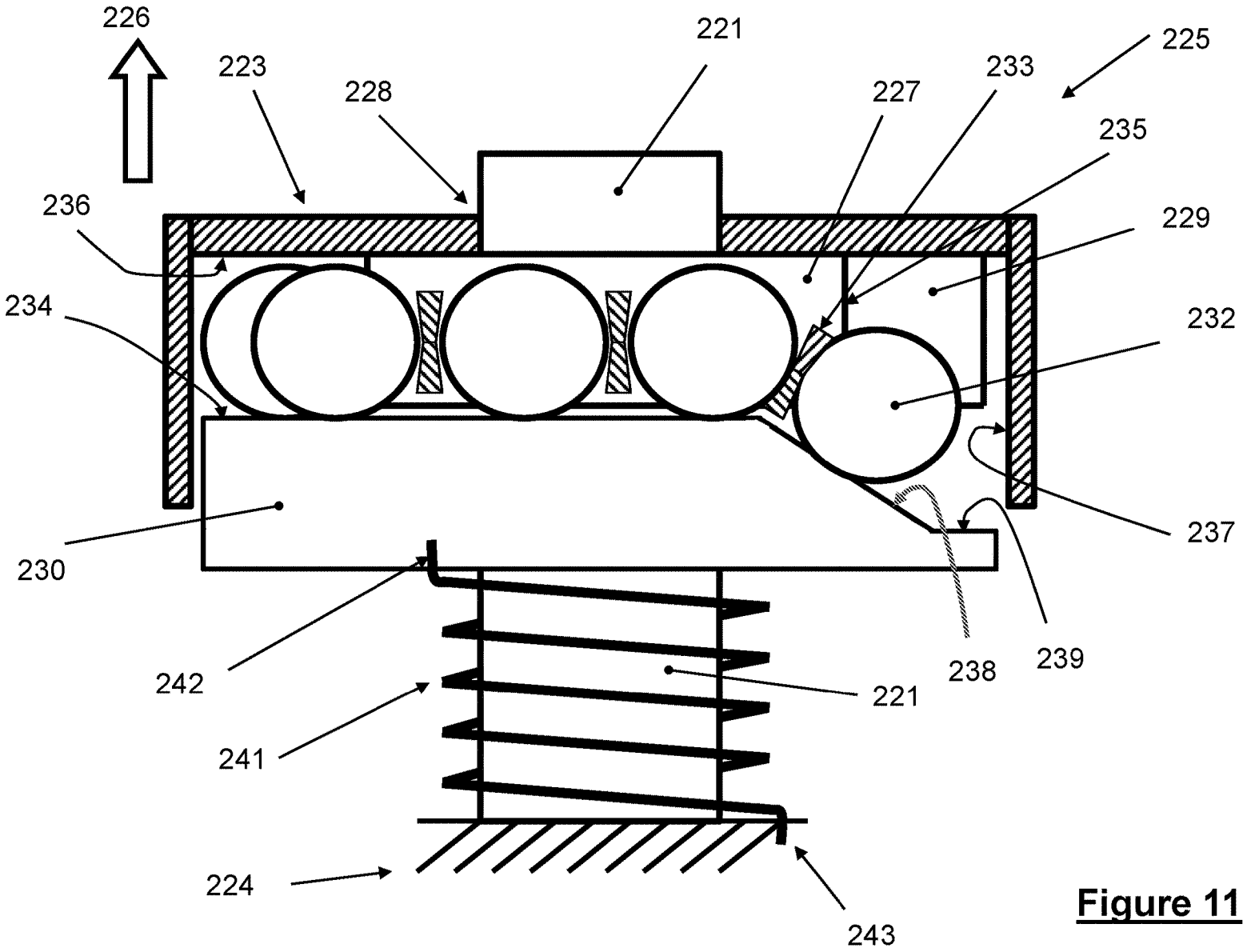
FIGS. 11 and 12 illustrates the schematic of the third "mechanical energy harvesting device" embodiment.
Figure 12:
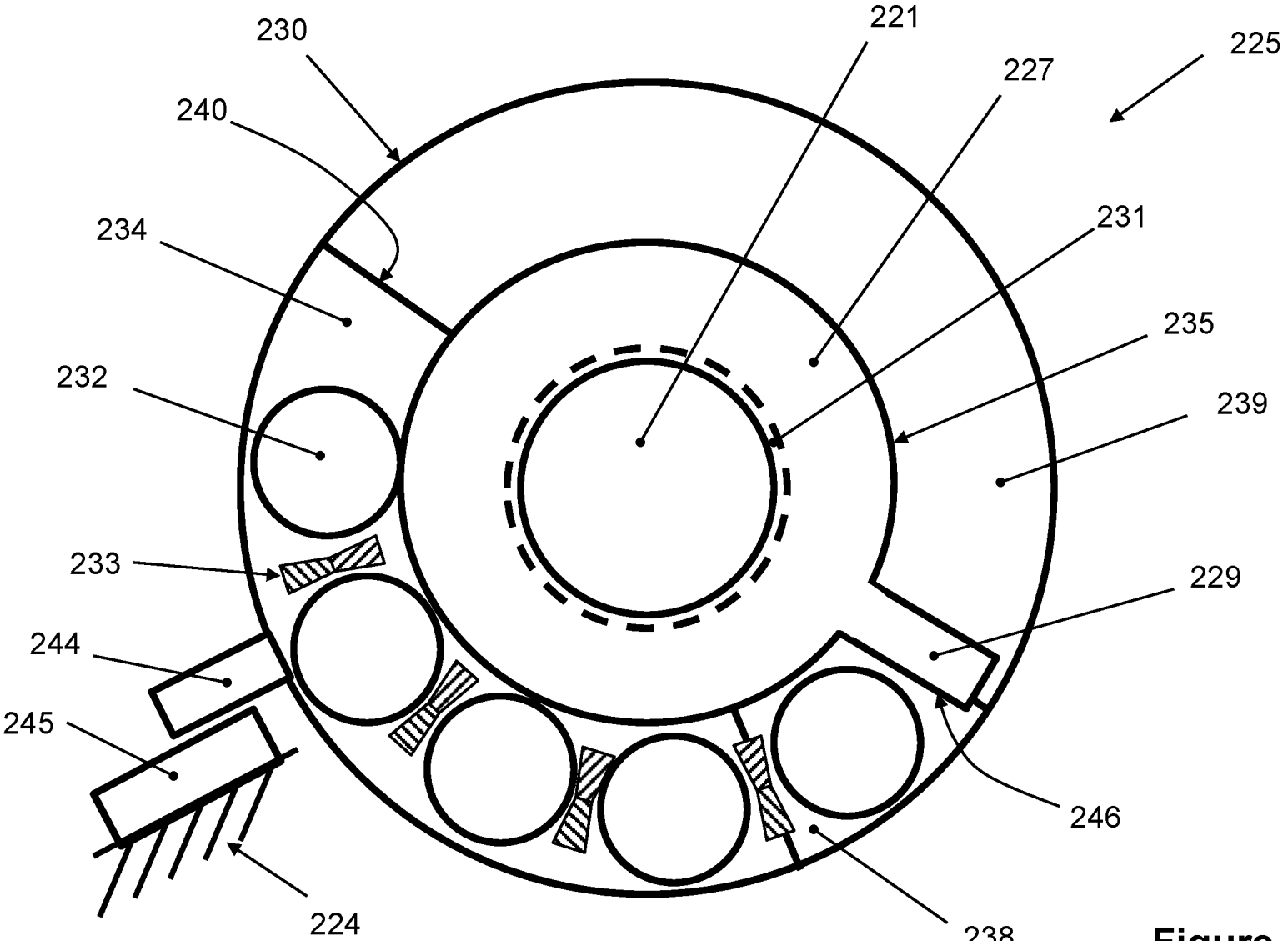

A "mechanical energy harvesting device" operating on the same principle may, however, be configured with a rotary sliding member to harvest mechanical energy from the acceleration of device and store the harvested mechanical energy in a torsion or linear spring as mechanical potential energy. Such an embodiment 225 of a rotary type "mechanical energy harvesting device" is shown in the schematics of FIGS. 11 and 12. An advantage of using a rotary type as compared to the previously disclosed linear type "mechanical energy harvesting device" is that they can be configured to be significantly smaller. In addition, rotary type devices can be less prone to friction related energy losses and geometrical design restrictions.

FIG. 11 shows the schematic of the side view of the "mechanical energy harvesting device" embodiment 225. FIG. 12 shows the top view of the embodiment 225 as herein described. The "mechanical energy harvesting device" 225 consists of a main shaft 221. The shaft 221 is fixedly attached on one end to the intended object 224, which is subjected to the acceleration in the direction of the arrow 226, from which mechanical energy is intended to be harvested. On the other end, the shaft 221 is fixedly attached to a "cylindrical cup" shaped cover 223, the cross-section of it is shown in the schematic of FIG. 11 so that the internal components of the mechanical energy harvesting device can be seen. The shaft 221 is provided with a step member 227, over which the cylindrical cover 223 is shown to rest. The step member 227 is provided with an extended member 229, which is more clearly seen in the top view of FIG. 12.

It is appreciated that the shaft 221, the step member 227 and the cylindrical cover may be integral, but for manufacturing considerations, the cylindrical cap 223 may be a separate element with the central hole 228, which is positioned over the step member 227 and fixedly attached to the shaft by welding or other known methods in the art.

In the top view of the "mechanical energy harvesting device" embodiment 225 shown in the schematic of FIG. 12, the cylindrical cap 223 is not shown so that the internal components of the device can be clearly seen. The step member 227 is provided with an extended member 229, FIGS. 12 and 11.

The "mechanical energy harvesting device" embodiment 225 is provided with the member 230, FIGS. 11 and 12, which is attached to the shaft 221 by a bearing 231, allowing it to rotate freely around the shaft 221, which is fixedly attached to the device 224 to which the "mechanical energy harvesting device" embodiment 225 is attached. The bearing 231 may be ball or other type of anti-friction bearing or formed by providing a small clearance between the shaft 221 and the inside diameter of the member 230, in which case a thrust bearing or the like should be provided to prevent displacement of the member 230 along the shaft 230. In general, particularly when high acceleration levels in the direction of the arrow 226 are involved, a ball or roller thrust bearing combination or properly mounted tapered roller bearing can be for mounting the member 230 on the shaft 221.

The "mechanical energy harvesting device" embodiment 225 is provided with "actuating" balls 232 (similar to the balls 217 in the embodiment of FIG. 10), which can be kept apart by the "cage" members 233, as is commonly used in roller (ball) linear and circulating bearings. The balls 232 are free to move on the surface 234 of the member 230 in the configuration shown in FIGS. 11 and 12 as guided by the outer surface 235 of the step member 227, the bottom surface 236 and inner surface 237 of the cylindrical cap 223 (FIG. 11). The top surface 234 of the member 230 is provided with a sloped portion 238 which drops to the surface 239 as shown in FIGS. 11 and 12, which continues up to the step 240 (FIG. 12), which rises back to the top surface 234 of the member 230. It is noted that in the schematics of FIGS. 11 and 12, five balls 232 are shown, the right most of which as viewed in these schematics is positioned on the sloped portion 238. A torsion spring 241 is provided and is fixedly attached to the member 230 on one end 242 and to the device 224 on the other end 243.

The "mechanical energy harvesting device" embodiment 225 shown in FIGS. 11 and 12 is configured to harvest mechanical energy from acceleration of the object to which the device is attached in the direction of the arrow 226 and store it in the torsion spring 241 as mechanical potential energy. The torsion spring 241 may be preloaded as was previously described for the embodiment of FIG. 5 to maximize the amount of mechanical energy that can be harvested from the device acceleration. In which case, a stop extension 244 can be provided on the member 230 that is pressed against a provided member 245 on the structure of the device 224 to which the embodiment 225 is attached to prevent counter-clockwise rotation (as viewed in FIG. 12) of the member 230 relative to the device 224 to relieve the preloading of the torsion spring 241.

The "mechanical energy harvesting device" embodiment 225 of FIGS. 11 and 12 functions as follows. Initially, the right most ball 232 is in contact with the inclined surface 238 of the member 230, while the other balls (second to fifth in FIGS. 11 and 12) are in contact with the top straight surface 234 of the member 230. When the object to which the device is attached (indicated by the ground 224) is accelerated in the direction of the arrow 226, the acceleration acts on the mass (inertia) of the balls 232, resulting in a dynamic force (mass times acceleration) that is applied by the balls on the contacting surfaces of the member 230, including the ball 232 that is positioned on its inclined surface 238. The tangential component (tangent to the circle centered at the center of the shaft 221 with a radius equal to the distance from the center of the shaft 221 to the point of contact between the ball 232 and the inclined surface 238) as seen in FIG. 12 of the dynamic force applied to the inclined surface 238 will then tend to rotate the member 230 in the clockwise direction, while the ball 232 presses against the surface 246 of the extended member 229 of the step member 227, FIG. 12. The torsion spring 241 is thereby wound and the work done by the ball 232 force on the member 230 is stored in the torsion spring 241 as mechanical potential energy. The first ball 232 would then reach the surface 239, FIGS. 11 and 12, at which time the second ball 232 is positioned over the inclined surface 238 and as long as the acceleration in the direction of the arrow 226 persists and is high enough to overcome the resisting force of the torsion spring 241, would keep forcing the member 230 to rotate in the clockwise direction, thereby adding more potential mechanical energy to the torsion spring 214 to store.

It is appreciated by those skilled in the art that a ratchet mechanism similar to those shown for the embodiments of FIGS. 5 and 8A may also be provided between the member 230 and the shaft 221 to perform the same tasks for the embodiment 225 of FIGS. 11 and 12. It is appreciated that in certain applications, such as in gun-fired munitions applications, the "mechanical energy harvesting device" must be capable of differentiating a prescribed minimum acceleration level with minimum duration (prescribed firing setback acceleration profile in munitions) from all accidental acceleration events, such as short duration but high acceleration levels due to accidental drops on hard surfaces or other object impacts or low peak accelerations due to transportation vibration or the like. Such a capability is provided for the "mechanical energy harvesting device" embodiment of FIGS. 11 and 12 with the added ratchet mechanism (not shown) as was described for the embodiment of FIG. 8A. If such feature is not desired, then the ratchet mechanism notches (158 in FIG. 5) would be arranged as shown in the embodiment 160 of FIG. 5 to allow accumulation of the harvested mechanical energy.

Figure 13:
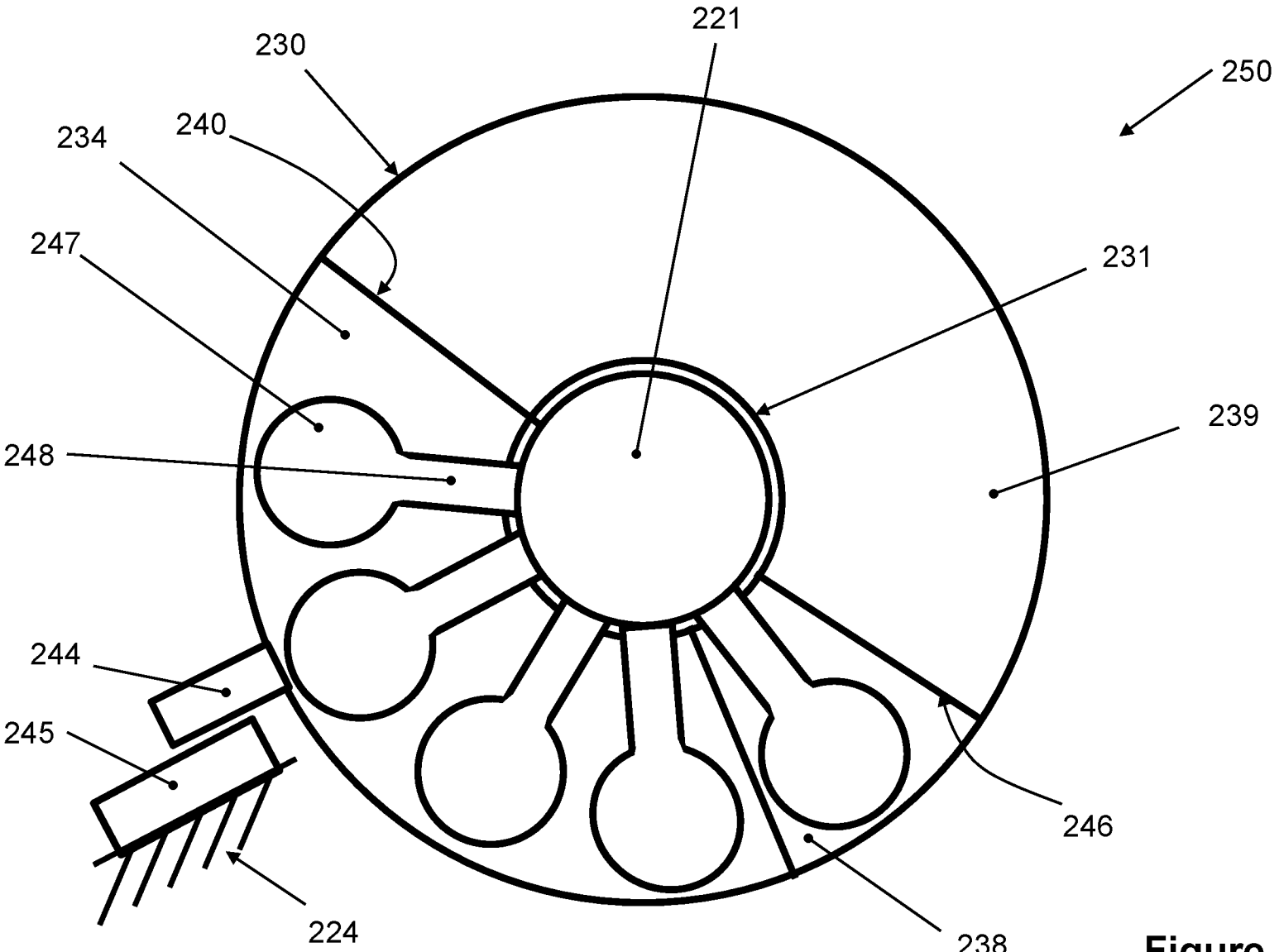
FIGS. 13 and 14 illustrates the schematic of the fourth "mechanical energy harvesting device" embodiment.
Figure 14:
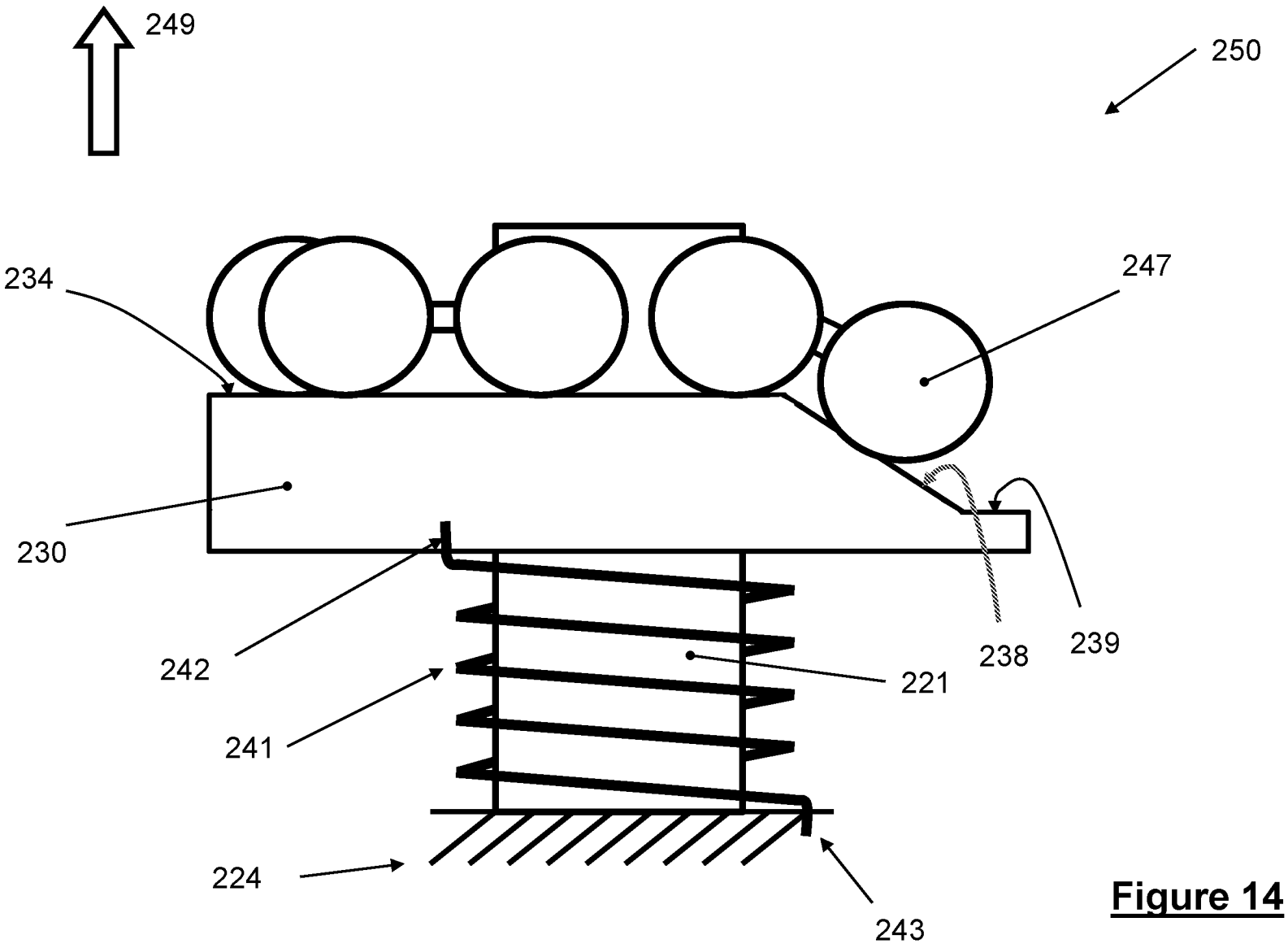

The "mechanical energy harvesting device" embodiment 225 of FIGS. 11 and 12 may be modified as shown in the schematics of FIGS. 13 and 14 and identified as the "mechanical energy harvesting device" embodiment 250. The embodiment 250 is intended to be constructed with fewer parts and occupy a smaller volume, which is of much interest in applications such as munitions.

The construction of the "mechanical energy harvesting device" embodiment 250 shown in the top and side views of FIGS. 13 and 14, respectively, is identical to that of the embodiment 225 shown in FIGS. 11 and 12, except for the following modifications. Firstly, the cylindrical cap 223 and the step member 227, FIG. 11, are eliminated as can be seen in the schematic of FIG. 14. Secondly, the balls 232 of the embodiment 225, FIG. 12, are replaced by "contact members" 247, which are fixedly attached to the shaft 221 by members 248, which are flexible in bending (in and out of the plane of the view of FIG. 13), but relatively rigid in bending sideways. The configuration options for the shape and size of the "contact members" 247 and the flexible members 248 are described below.

FIG. 14 shows the schematic of the side view of the "mechanical energy harvesting device" embodiment 250. Similar to the embodiment 225 of FIGS. 11 and 12, the "mechanical energy harvesting device" 250 is fixedly attached to the intended object 224, which is subjected to the acceleration in the direction of the arrow 249, from which mechanical energy is intended to be harvested.

The "mechanical energy harvesting device" embodiment 250 is provided with the same member 230 as the embodiment 225 of FIGS. 11 and 12, which is also attached to the shaft 221 by a bearing 231, allowing it to rotate freely around the shaft 221. The bearing 231 may be ball or other type of anti-friction bearing or formed by providing a small clearance between the shaft 221 and the inside diameter of the member 230, in which case a thrust bearing or the like should be provided to prevent displacement of the member 230 along the shaft 230. In general, particularly when high acceleration levels in the direction of the arrow 249 are involved, a ball or roller thrust bearing combination or properly mounted tapered roller bearing can be for mounting the member 230 on the shaft 221.

As was shown in the embodiment 225 of FIGS. 11 and 12, the top surface 234 of the member 230 is provided with the same sloped portion 238, which drops to the surface 239 and continues up to the step 240, which rises back to the top surface 234 of the member 230. It is noted that in the schematics of FIGS. 13 and 14, five "contact members" 247, which are fixedly attached to the shaft 221 by members 248 are shown, the right most of which as viewed in FIG. 14 is positioned on the sloped portion 238. A torsion spring 241 is similarly provided and is fixedly attached to the member 230 on one end 242 and to the device 224 on the other end 243, FIG. 14.

The "mechanical energy harvesting device" embodiment 250 of FIGS. 13 and 14 is also configured to harvest mechanical energy from acceleration of the object to which the device is attached in the direction of the arrow 249 and store it in the torsion spring 241 as mechanical potential energy. The torsion spring 241 may be preloaded as was previously described for the embodiment 225 of FIGS. 11 and 12 to maximize the amount of mechanical energy that can be harvested from the device acceleration. In which case, the stop extension 244 is also provided on the member 230 that is pressed against a provided member 245 on the structure of the device 224 to which the embodiment 250 is attached to prevent counter-clockwise rotation (as viewed in FIG. 13) of the member 230 relative to the device 224 to relieve the preloading of the torsion spring 241.

The "mechanical energy harvesting device" embodiment 250 of FIGS. 13 and 14 functions as follows. Initially, the right most "contact member" 247 is in contact with the inclined surface 238 of the member 230, while the other contact members (second to fifth in FIGS. 13 and 14) are in contact with the top straight surface 234 of the member 230. When the object to which the device is attached (indicated by the ground 224) is accelerated in the direction of the arrow 249, the acceleration acts on the mass (inertia) of the contact member 247 (neglecting the inertia of the flexible connecting member 248), resulting in a dynamic force that is applied by the contact members to the surfaces of the member 230, including the contact member 247 that is positioned on its inclined surface 238. The tangential component (tangent to the circle centered at the center of the shaft 221 with a radius equal to the distance from the center of the shaft 221 to the point of contact between the contact member 247 and the inclined surface 238) as seen in FIG. 13 of the dynamic force applied to the inclined surface 238 will then tend to rotate the member 230 in the clockwise direction as viewed in the schematic of FIG. 13. The torsion spring 241 is thereby wound and the work done by the contact member 247 on the member 230 is stored in the torsion spring 241 as mechanical potential energy. The first contact member 247 would then reach the surface 239, FIGS. 13 and 14, at which time the second contact member 247 is positioned over the inclined surface 238 and as long as the acceleration in the direction of the arrow 249 persists and is high enough to overcome the resisting force of the torsion spring 241, would keep forcing the member 230 to rotate in the clockwise direction, thereby adding more potential mechanical energy to the torsion spring 214 to store.

In a modification of the "mechanical energy harvesting device" embodiment 250 of FIGS. 13 and 14, at least one of the (five) "contact members" 247 are hinged (instead of being fixedly attached) to the shaft 221, allowing the contact member 247 and the connecting member 248 to rotate in and out of the plane of view of FIG. 13, thereby performing the same function as described above.

It is appreciated by those skilled in the art that a ratchet mechanism similar to those shown for the embodiments of FIGS. 5 and 8A may also be provided between the member 230 and the shaft 221 to perform the same tasks for the embodiment 250 of FIGS. 13 and 14. It is appreciated that in certain applications, such as in gun-fired munitions applications, the "mechanical energy harvesting device" must be capable of differentiating a prescribed minimum acceleration level with minimum duration (prescribed firing setback acceleration profile in munitions) from all accidental acceleration events, such as short duration but high acceleration levels due to accidental drops on hard surfaces or other object impacts or low peak accelerations due to transportation vibration or the like. Such a capability can also be provided for the "mechanical energy harvesting device" embodiment of FIGS. 13 and 14 with the added ratchet mechanism (not shown) as was described for the embodiment of FIG. 8A. If such is feature is not desired, then the ratchet mechanism notches (158 in FIG. 5) would be arranged as shown in the embodiment 160 of FIG. 5 to allow accumulation of the harvested mechanical energy.

Figure 14A:
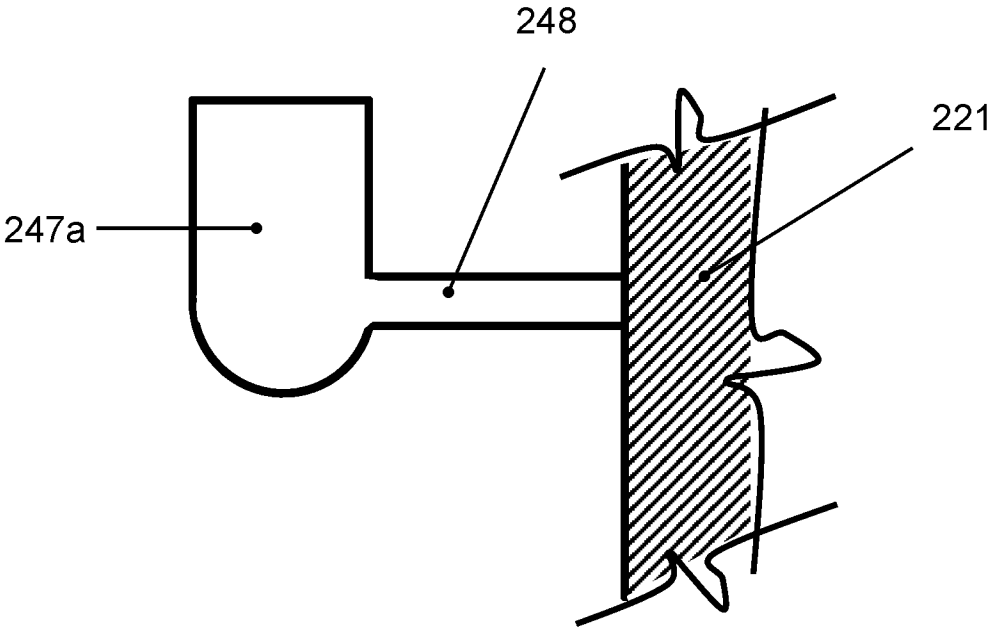
FIG. 14A illustrates the schematic of a mechanical energy collecting unit for the embodiments of FIGS. 5 and 8A with increased mass.

In the schematics of the "mechanical energy harvesting device" embodiment 250 of FIGS. 13 and 14, the contact members 247 are shown as a ball, which are connected to the shaft 221 by the member 248, which is relatively flexible in up and down bending (in the direction parallel to the axis of the shaft 221) and relatively rigid in lateral bending. The ball shaped depiction of the contact members is only for the purpose of showing similarity of this embodiment to that of the embodiment 225 of FIGS. 11 and 12. It is appreciated by those skilled in the art that the contact members 247 may be configured in almost any shape as long as their center of mass is nearly located along the neutral axis of the member 248 so that the applied acceleration in the direction of the arrow 249 would not generate a twisting torque on the connecting members (beams) 248 and that the surfaces of the contact members with the surfaces of the member 230 is close to being spherical to minimize contact friction. As an example, a possible side view of the contact member 247 and the connecting member 248 is shown in FIG. 14A, in which the lower section of the contact member is spherical, while the top has a square cross-section. Such designs would allow the designer to choose a desired mass for the contact member 247 (such as indicated by the numeral 247*a* in FIG. 14A) to achieve the desired dynamic force based on the applied acceleration level in the direction of the arrow 249 and also vary the contact mass (usually increase) sequentially as the mechanical energy storage spring 241 is wound to counter its increasing resistance to wounding.

It is appreciated that when the "mechanical energy harvesting device" embodiments of FIGS. 5 and 8A are subjected to accelerations in the direction of the arrow 153, the acceleration acts on the combined inertia of the "mechanical energy collecting" units 164 and apply the resulting dynamic force to the sliding member 156 by the roller 166. The provided preloaded compressive spring 169 applies an additional preloading force to the sliding member 156. This is also the case for the "mechanical energy harvesting device" embodiment 250 of FIGS. 13 and 14 and when the device is subjected to acceleration in the direction of the arrow 249, the dynamic force due to the inertia of the contact member 247 is applied to the surface of the member 230. It is also appreciated that the flexible connecting member (beam) 248 may also be preloaded to keep the contact member 247 in contact with the surface of the member 230 and apply a desired level of force to the surface at all times.

It is, however, appreciated that in some applications, such is in many munitions applications, it is highly desirable that the "mechanical energy collecting" units 164 of the "mechanical energy harvesting device" embodiments of FIGS. 5-9 to begin to apply force to the sliding member 156 or the contact member 247 of the embodiment 250 of FIGS. 13 and 14 to begin to apply force to the surface of the member 230 after a certain acceleration level threshold has been reached. It is appreciated that the prescribed acceleration threshold may be the same for all "mechanical energy collecting" units 164 and contact member 247 or may be different for each of the units. The following modifications to the design of the "mechanical energy collecting" units 164 and the contact member 247 and its connecting member 248 described below provides the above capability to the related "mechanical energy harvesting device" embodiments.

Figure 15:
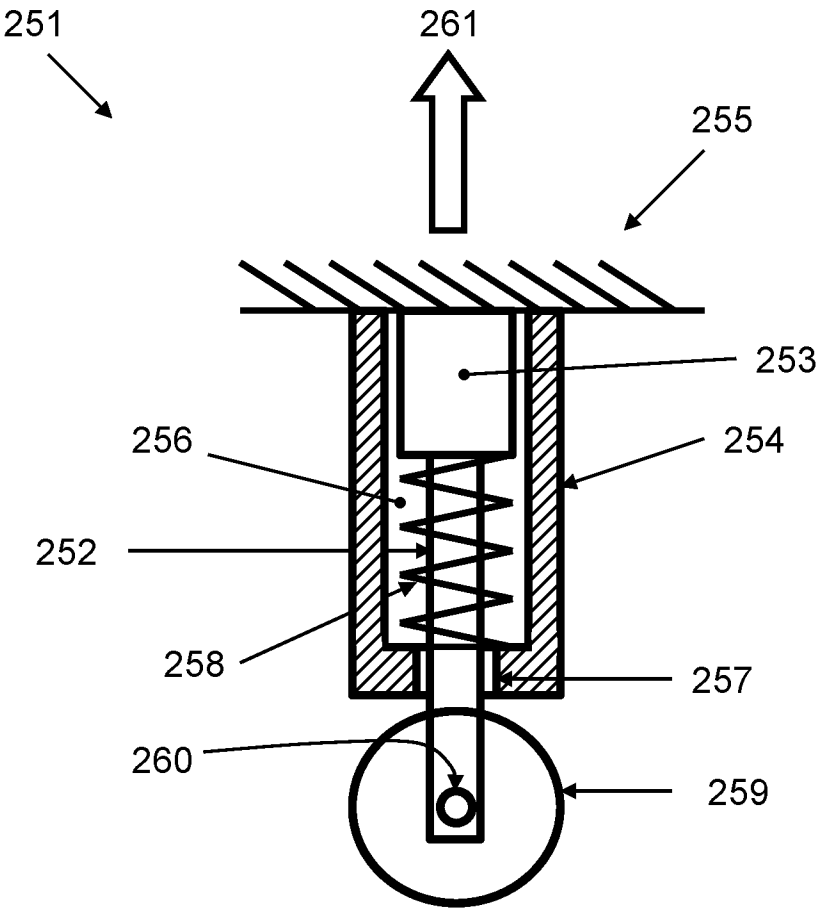
FIG. 15 illustrates the schematic of a mechanical energy collecting unit for the embodiments of FIGS. 5 and 8A that begin energy harvesting only after an acceleration threshold has been reached.

To prevent the "mechanical energy collecting" units 164 from applying a force to the sliding member 156 before a prescribed acceleration threshold has been reached, the configuration of the units can be modified as shown in the schematic of FIG. 15 and indicated by the numeral 251. The "mechanical energy collecting" unit 251 consists of a member 252, to one end of it the sliding member 253 is fixedly attached. The sliding member 253 is free to move in the guide 256 that is provided inside the housing 254, which is fixedly attached to the structure 255 of the "mechanical energy harvesting device" (for example, the structure 155 of the embodiment 160 of FIG. 5). As can be seen in FIG. 15, the member 252, which is smaller in diameter, passes through a smaller diameter hole 257 that is provided at the bottom of the guide 256 of the housing 254. A preloaded compressive spring 258 is positioned between the sliding member 253 and the bottom of the guide 256 to bias the sliding member 253 against the structure 255 of the device 251 as can be seen in FIG. 15. On the other end of the member 252 that is extended outside the housing 254, a roller 259 is provided that is free to rotate about the shaft 260.

The "mechanical energy collecting" unit 251 will then function as follows. When the "mechanical energy harvesting device" in which the units 251 are used to actuate their sliding members, for example the sliding members 156 of the embodiment of FIG. 5 or 8A, is subjected to acceleration in the direction of the arrow 261, the acceleration acts on the effective inertia of the entire moving assembly of the "mechanical energy collecting" unit 251, i.e., the members 253, 252, wheel 256 and pin 260 and the contribution of the inertia of the spring 258, and generate a dynamic force that is applied to the compressively preloaded spring 258. If the level of acceleration in the direction of the arrow 261 is below the preloading level of the compressive spring 258, i.e., below the previously indicated prescribed acceleration threshold, the preloading force of the compressive spring 261 will not be overcome and the roller 259 is not displaced downward. However, if the level of acceleration is above the prescribed acceleration threshold, the preloading force level of the spring 261 is overcome, and the roller 259 begins to be displaced downward and if the acceleration level is high enough, the roller 259 will reach the surface of the sliding member 156 and begins to cause mechanical potential energy to be accumulated in the device as was previously described for the embodiments of FIGS. 5 and 8A. As a result, the "mechanical energy harvesting device" embodiments would harvest mechanical energy only if the applied acceleration is above the prescribed threshold.

Figure 16:
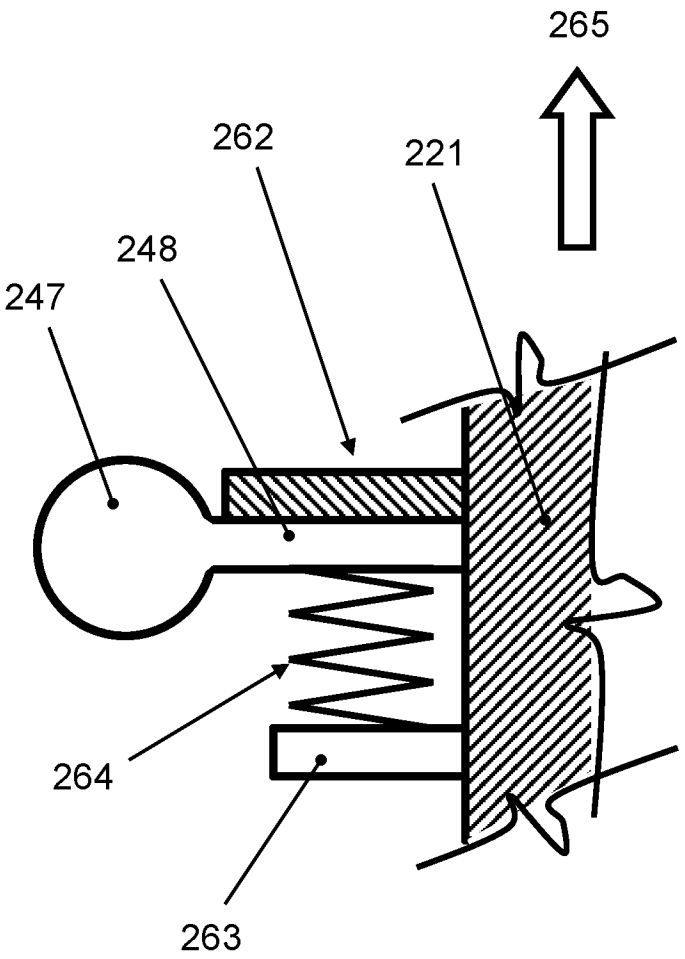
FIG. 16 illustrates the schematic of a mechanical energy collecting unit for the embodiment of FIGS. 13 and 14 that begin energy harvesting only after an acceleration threshold has been reached.

To prevent the contact member 247 from applying a force to the member 230 before a prescribed acceleration threshold has been reached, the design of the contact member 247 and connecting member 248 assembly can be modified to as shown in the schematic of FIG. 16. The contact member 247 and connecting member 248 assembly is provided with a stop member 262, which is also fixedly attached to the device shaft 221 (FIG. 13), which prevents their upward deflection as seen in the view of FIG. 16. Another member 263, which is also fixedly attached to the shaft 221 is provided a certain distance below the connecting member 248 as can be seen in FIG. 16. A preloaded compressive spring 264 is positioned between the member 263 and the connecting member 248.

The contact member 247 and connecting member 248 assembly of FIG. 16 will then function as follows. When the "mechanical energy harvesting device" embodiment of FIGS. 13 and 14 in which the assembly is used is subjected to acceleration in the direction of the arrow 265, the acceleration acts on the effective inertial of the entire moving assembly, i.e., the members 247 and 248, and generate a dynamic force, which would tend to cause the connecting member 248 to bend downward. If the level of acceleration in the direction of the arrow 265 is below the preloading level of the compressive spring 264, i.e., below the previously indicated prescribed acceleration threshold, the preloading force of the compressive spring 264 will not be overcome and the connecting member 248 will stay unmoved against the stop member 262 as shown in the configuration of FIG. 16. However, if the level of acceleration is above the prescribed acceleration threshold, the preloading force level of the spring 264 is overcome, and the connecting member 248 will begin to bend downward, displacing the contact member 247 downward and if the acceleration level is high enough, the contact member 247 will reach the surface of the member 230 and begins to cause mechanical potential energy to be accumulated in the device as was previously described for the embodiments of FIGS. 13 and 14. As a result, the "mechanical energy harvesting device" embodiments would harvest mechanical energy only if the applied acceleration is above the prescribed threshold.

It is appreciated by those skilled in the art that the mechanical potential energy stored in the mechanical energy storage spring 241 of the embodiments 225 and 250 of FIGS. 11 and 14, respectively, may then be released to perform a desired function, such as generate electrical energy, for example, by retracting the stop 245 (FIGS. 12 and 13), to allow the mechanical energy storage spring 241 to transfer the stored mechanical potential energy to the member 230, which could act as a "flywheel" to rotate a pinion with a provided gear (not shown) to rotate an electrical generator to generate electrical energy. In another example, the base of the shaft 221 (FIGS. 11 and 14) are provided with a ratchet or a one-way clutch (not shown), that once released would transfer the mechanical potential energy stored in the spring 241 to a flywheel, which would rotate an electrical generator to generate electrical energy. Such arrangements for transferring stored mechanical potential energy in torsion springs to electrical energy generation devices are well known in the art.

It is appreciated by those skilled in the art that the flexible connecting member 248 may also be preloaded in bending and kept in its preloaded condition by the stop member 262 as shown in FIG. 16. In which case, the total preloading forces of the connecting member 248 and the compressive spring 264 determines the acceleration preloading that has to be overcome by the device acceleration in the direction of the arrow 265 before the contact member 247 would start to move downward.

Figure 17:
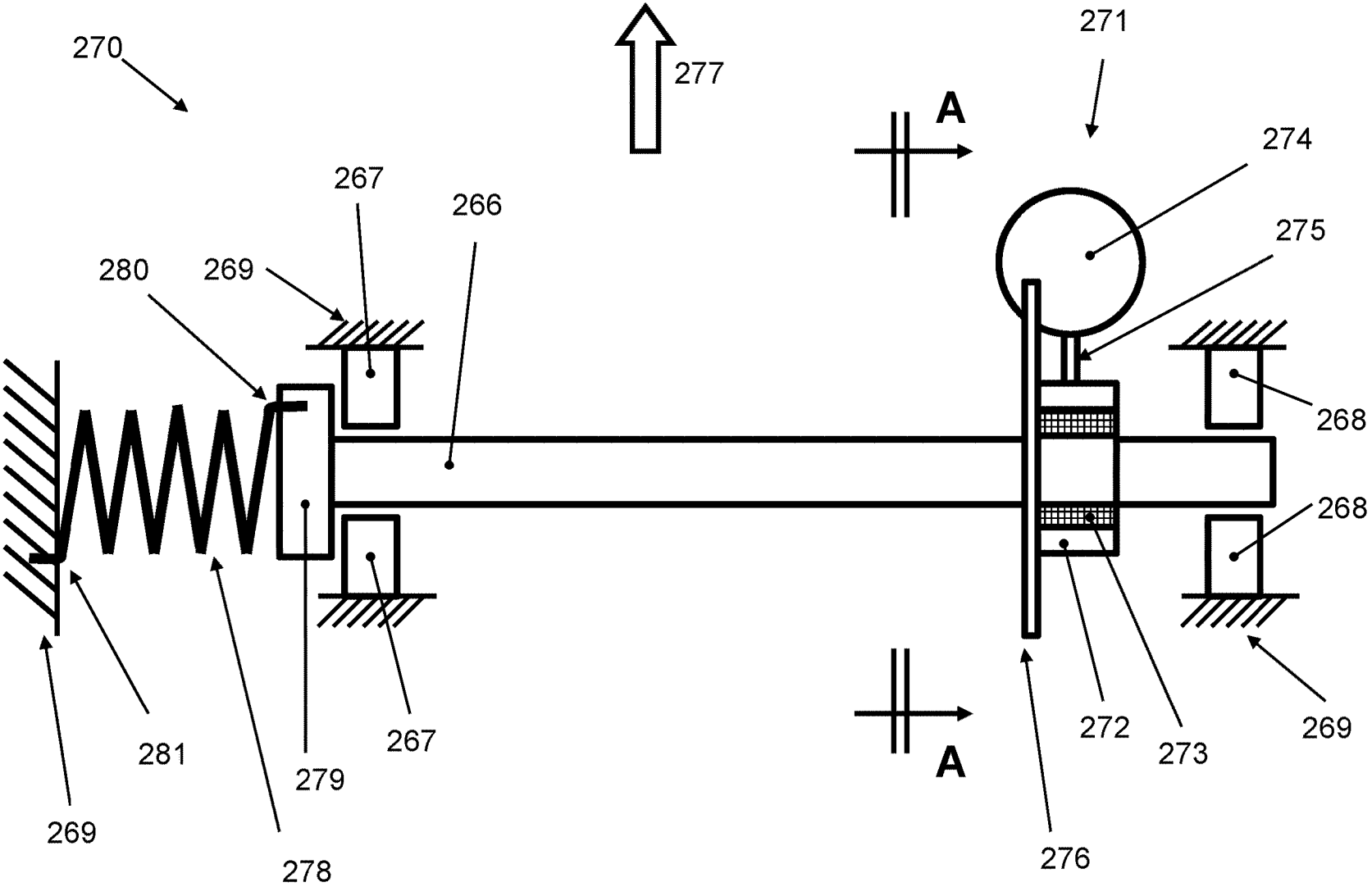
FIG. 17 illustrates the schematic of the fifth "mechanical energy harvesting device" embodiment.

The fifth embodiment 270 of the "mechanical energy harvesting device" is shown in the schematic of FIG. 17. The embodiment 270 is with rotary "mechanical energy collecting" units rather than linearly displacing units such as those of the embodiment of FIG. 5.

The construction of the "mechanical energy harvesting device" embodiment 270 is shown in the side view of FIG. 17. As can be seen in the schematic of FIG. 17, the embodiment 270 consists of a shaft 266, which is mounted in the bearings 267 and 268, which are in turn fixedly attached to the structure of the "mechanical energy harvesting device" embodiment 270 as indicated as ground 269. The bearings 267 and 268 may be sleeve type or anti-friction type such as ball bearing or the like, which are intended to indicate that they allow for free rotation of the shaft 266, while allowing its minimal longitudinal displacement.

Figure 18:
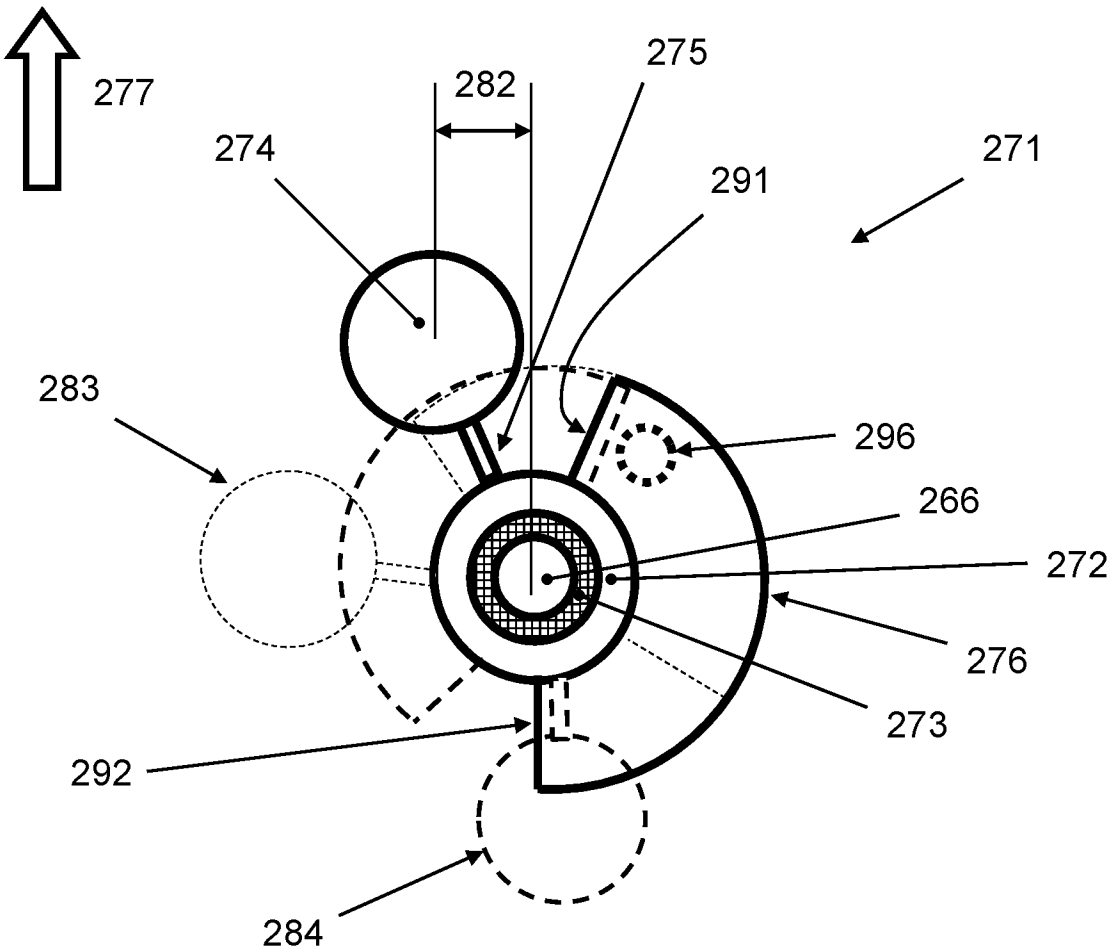
FIG. 18 illustrates the side view of one of the mechanical energy collecting units of the "mechanical energy harvesting device" embodiment of FIG. 17.

Mounted on the shaft 266 are "mechanical energy collecting" units 271, FIG. 17. In the schematic of FIG. 17 only one unit 271 is shown for the sake of clarity, but in general several such units can be mounted on the shaft 266 and interact for sequential action as is described below. The view A-A of the "mechanical energy collecting" unit 271 is shown in FIG. 18. Each unit consists of a cylindrical sleeve 272, which is mounted on the shaft 266 via a one-way clutch 273, which allows the shaft 266 to turn in the counter-clockwise direction with respect to the unit 271 as viewed in the schematic of FIG. 18. The "mechanical energy collecting" unit 271 is provided with a mass element 274, which is fixedly attached to the cylindrical sleeve 272 by the relatively rigid member 275. In the configuration of the "mechanical energy harvesting device" embodiment 270 shown in the schematic of FIG. 17, the mass element 274 is positioned as shown in the view A-A of FIG. 18, as slightly to the left of a vertical plane passing through the center of the shaft 266. A relatively rigid but thin and lightweight "release" plate 276 is also fixedly attached to the cylindrical sleeve 272 as shown in FIGS. 17 and 18. At least on one end of the shaft 266 is provided with a member 279 (such as a disc shaped member), to which one end 280 of a torsion spring 278 is fixedly attached. The other end 281 of the torsion spring 278 is attached to the structure 269 of the "mechanical energy harvesting device" embodiment 270 as shown in FIG. 17.

The "mechanical energy harvesting device" embodiment 270 is considered to be fixedly attached to the intended object 267, which is subjected to the acceleration in the direction of the arrow 277 as shown in the schematic of FIG. 17, from which mechanical energy is to be harvested.

The "mechanical energy harvesting device" embodiment 270 of FIGS. 17 and 18 is also designed to harvest mechanical energy from acceleration in the direction of the arrow 277, FIG. 17, of the object to which the device is attached and store it in the torsion spring 278.

The "mechanical energy harvesting device" embodiment 270 of FIGS. 17 and 18 functions as follows. Here, the operation of the embodiment 270 with only one "mechanical energy collecting" unit 271 is described and its operation with multiple units 271 is described below. Initially, the one "mechanical energy collecting" unit 271 is in the configuration shown in FIG. 18, i.e., with the mass element 274 slightly to the left of the axis of the shaft 266. When the object to which the device is attached (indicated by the ground 269 in FIG. 17) is accelerated in the direction of the arrow 277, the acceleration acts on the mass (inertia) of the mass element 274 (neglecting the inertia of the connecting member 275 and the release plate 276), resulting in a dynamic force that is applied to the center of mass of the mass element 274, generating a torque that tends to rotate the shaft 266 in the counter-clockwise direction as viewed in FIG. 18. It is noted that as can be seen in the schematic of FIG. 18, the distance between the center of mass of the mass element 274 and the center of the shaft 266, i.e., the moment arm of the generated dynamic force (indicated by the numeral 282) is relatively small, thereby causing the acceleration in the direction of the arrow 277 to generate a relatively small torque, but the moment arm increases as the shaft 266 is rotated by the generated torque, reaching a peak at the mass element position 283 (when the moment arm is perpendicular to the direction of the applied acceleration) and diminishing as the moment arm becomes parallel to the direction of acceleration at the mass element position 284. The torsion spring 278 is thereby wound and the work done by the generated dynamic force is stored in the torsion spring 278 as mechanical potential energy.

Figure 19:
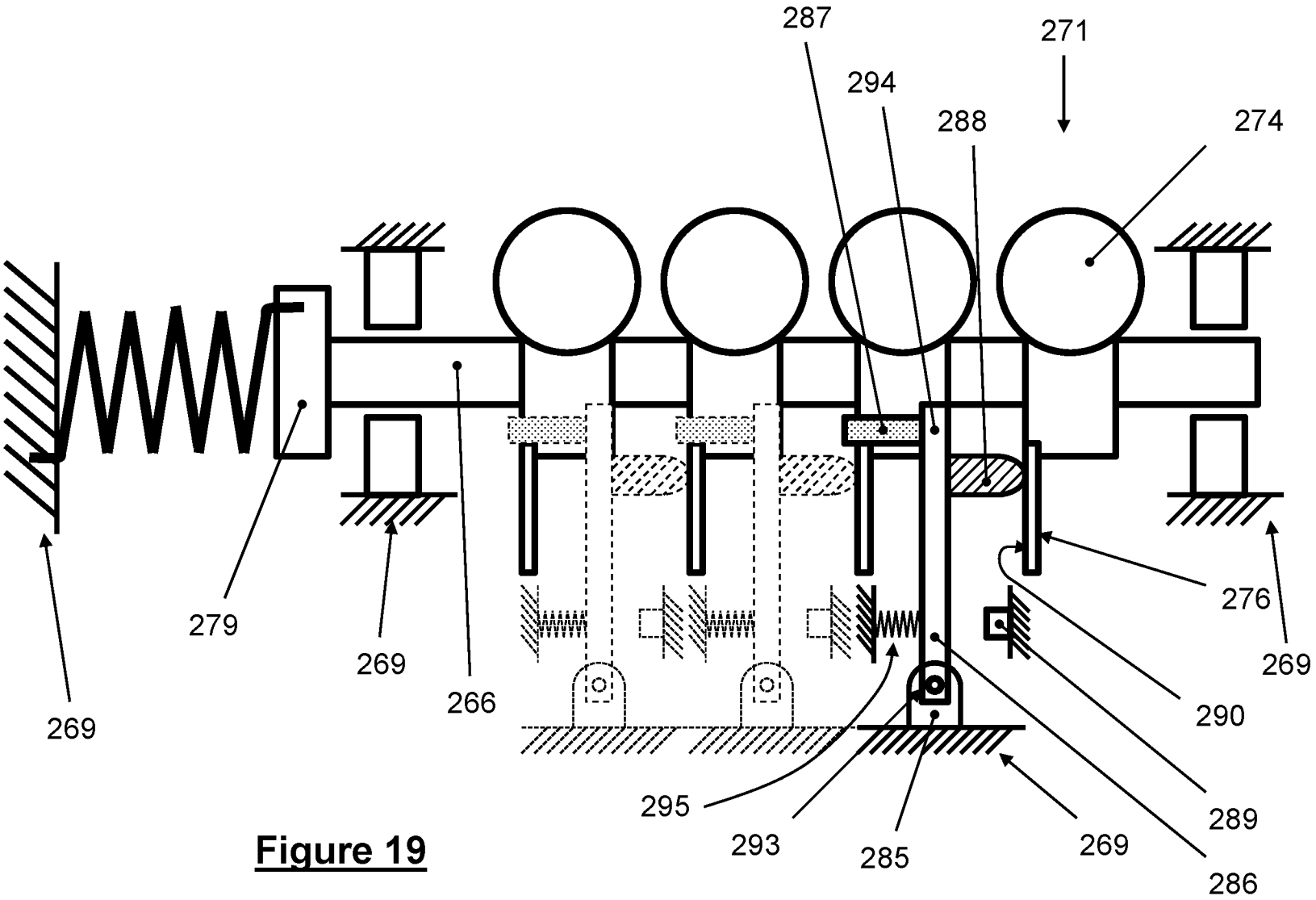
FIG. 19 illustrates the schematic of the top view of the "mechanical energy harvesting device" embodiment of FIG. 17.

The top view of the "mechanical energy harvesting device" embodiment 270 of FIG. 17 (as viewed in the opposite direction of the arrow 277 is shown in the schematic of FIG. 19. In this view, four "mechanical energy collecting" units 271 are shown as mounted as was previously described on the shaft 266. In the top view of FIG. 19, all four "mechanical energy collecting" units 271 are in the position seen in FIGS. 17 and 18.

The "mechanical energy harvesting device" embodiment 270 is provided with a mechanism to sequentially release the "mechanical energy collecting" units 271. In the schematic of FIG. 19, for the sake of clarity, the mechanism is shown with solid lines between the first (right hand side) and the second "mechanical energy collecting" units 271 and with light dashed lines between the second and third units 271 and between the third and fourth units 271, and would be provided similarly between other units when present. Also, for the sake of clarity, the mechanisms used for sequential release of the "mechanical energy collecting" units 271 are not shown in the schematics of FIGS. 17 and 18.

The mechanism for sequential release of the "mechanical energy collecting" units 271 consists of a link 286, which is attached to the structure 269 of the "mechanical energy harvesting device" embodiment 270 by the joint 293 via the support 285 as shown in FIG. 19. To one side of the free end 294 of the link 286 is attached the member 288, which can be a small diameter element with a rounded tip as can be seen in FIG. 19 for ease of sliding against the surface 290 of the release plate 276 of the first (right hand side) "mechanical energy collecting" unit 271 in the "mechanical energy harvesting device" embodiment 270 configuration depicted in FIGS. 17, 18 and 19. In this configuration, the preloaded compressive spring 295 is provided to bias the link 286 to keep the rounded tip of the member 288 in contact against the surface 290 of the release plate 276 of the first "mechanical energy collecting" unit 271 as shown in FIG. 19. The positioning of the member 288 relative to the release plate 276 is shown by dashed line circle 296 in the view A-A of FIG. 18. The preloaded compressive spring 295 is attached to the structure 269 of the "mechanical energy harvesting device" embodiment 270 as seen in FIG. 19. To the other side of the free end 294 of the link 286 is attached the member 287, which in the "mechanical energy harvesting device" embodiment 270 configuration depicted in FIGS. 17, 18 and 19, is positioned in front of the edge 291 (FIG. 18) of the release plate 276 of the second "mechanical energy collecting" unit 271 as shown in FIG. 19.

Identical mechanisms for sequential release of the "mechanical energy collecting" units 271 are provided between each pair of units 271, in the case of the embodiment 270 shown in the top view of FIG. 19, between the second and third and third and forth "mechanical energy collecting" units 271 as shown with dashed lines.

The "mechanical energy harvesting device" embodiment 270 of with multiple "mechanical energy collecting" units 271 shown in the top view of FIG. 19 would then function as follows. Initially, all "mechanical energy collecting" units 271 are in the configuration shown in the top view of FIG. 19, as also seen in the view A-A of FIG. 18, i.e., with the mass elements 274 slightly to the left of the axis of the shaft 266. When the object to which the device is attached (indicated by the ground 269 in FIG. 17) is accelerated in the direction of the arrow 277, FIGS. 17 and 18, the acceleration acts on the mass (inertia) of the first (right most) mass element 274 (neglecting the inertia of the connecting member 275 and the release plate 276), resulting in a dynamic force that is applied to the center of mass of the mass element 274, generating a torque that tends to rotate the shaft 266 in the counter-clockwise direction as viewed in FIG. 18 as was previously described. Now as the first "mechanical energy collecting" unit 271 is rotating in the counter-clockwise direction (FIG. 18), the "mechanical energy collecting" units 271 stays in contact with the surface 290 of the release plate 276, FIG. 19, thereby keeping the member 287 in front of the edge 291 (FIG. 18) of the release plate of the second "mechanical energy collecting" unit 271, thereby preventing the dynamic force acting on the mass 274 of the second "mechanical energy collecting" unit 271 to cause it to similarly rotate in the counter-clockwise direction. The third and fourth "mechanical energy collecting" unit 271 are similarly prevented from being forced to rotate in the counter-clockwise direction. As the first "mechanical energy collecting" unit 271 is rotating in the counter-clockwise direction (FIG. 18), the one-way clutch 273 (FIG. 17) forces the shaft 266 to rotate with the unit 271. The torsion spring 278 is thereby wound and the work done by the generated dynamic force is stored in the torsion spring 278 as mechanical potential energy.

Now as the mass element 274 of the first "mechanical energy collecting" unit 271 reaches close to its lowest position 284 (FIG. 18) indicated by dashed lines, the edge 292 of the release plate passes the member 288 (shown by dashed lined circle 296 in FIG. 18), thereby allowing the link 286, FIG. 19, to be rotated in the clockwise direction by the preloaded compressive spring 295, thereby disengaging the member 287 from the release plate 276 of the second "mechanical energy collecting" unit 271. The second "mechanical energy collecting" unit 271 is thereby freed to begin to rotate as was described for the first "mechanical energy collecting" unit 271, thereby storing more mechanical energy in the torsion spring 278 as mechanical potential energy. The link 286 in the meanwhile rotates in the clockwise direction until it is stopped against the provided stop 289, FIG. 19. The third and the fourth "mechanical energy collecting" units 271 are similarly released to further harvest mechanical energy from the applied acceleration and accumulate it in the torsion spring 278.

It is appreciated that in the "mechanical energy harvesting device" embodiment 270 as shown in the schematics of FIGS. 17 and 18, when the acceleration of the device in the direction of the arrow 277 has ceased or has dropped below a level that the generated dynamic forces on the mass members 274 cannot overcome the reacting torque of the mechanical potential energy accumulated in the torsion spring 278, then the torsion spring would tend to rotate the shaft 266 together with the mass members 274 in the clockwise direction as viewed in FIG. 18 (here the effect of gravity is not being considered). To prevent the mechanical potential energy from being released to rotate the shaft 266, a one-way clutch or ratchet mechanism may be provided between the shaft 266 and one of the bearings 267 or 268 (not shown) that would allow for counter-clockwise rotation of the shaft 266 relative to the said bearings but prevents its rotation in the clockwise direction as viewed in FIG. 18.

It is appreciated by those skilled in the art that the in the "mechanical energy harvesting device" embodiment 270 of FIGS. 17-19, the mechanical potential energy stored in the mechanical energy storage spring 278 and then be released to perform a desired function, such as generate electrical energy. As an example, the base 269 (FIGS. 17 and 19) may be provided with a ratchet or a one-way clutch (not shown), that once released would transfer the mechanical potential energy stored in the spring 278 to a flywheel, which would rotate an electrical generator to generate electrical energy. Such arrangements for transferring stored mechanical potential energy in torsion springs to electrical energy generation devices are well known in the art.

It is appreciated that in certain applications, such as in gun-fired munitions applications, the "mechanical energy harvesting device" must be capable of differentiating a prescribed minimum acceleration level with minimum duration (prescribed firing setback acceleration profile in munitions) from all accidental acceleration events, such as short duration but high acceleration levels due to accidental drops on hard surfaces or other object impacts or low peak accelerations due to transportation vibration or the like. The "mechanical energy harvesting device" embodiment 270, however, due to the provided one-way clutches 273, FIG. 17, does not allow the return of the mass member 274 back to its initial configuration shown in FIG. 18 after experiencing an acceleration event in the direction of the arrow 277 and rotating the shaft 266 in the counter-clockwise direction. A modification of the design of the "mechanical energy harvesting device" embodiment 270 presented in FIG. 20 and indicated as the "mechanical energy harvesting device" embodiment 300 provides the capability of harvesting and accumulating mechanical energy only when a prescribed acceleration profile with a minimum acceleration level and minimum duration is detected.

Figure 20:
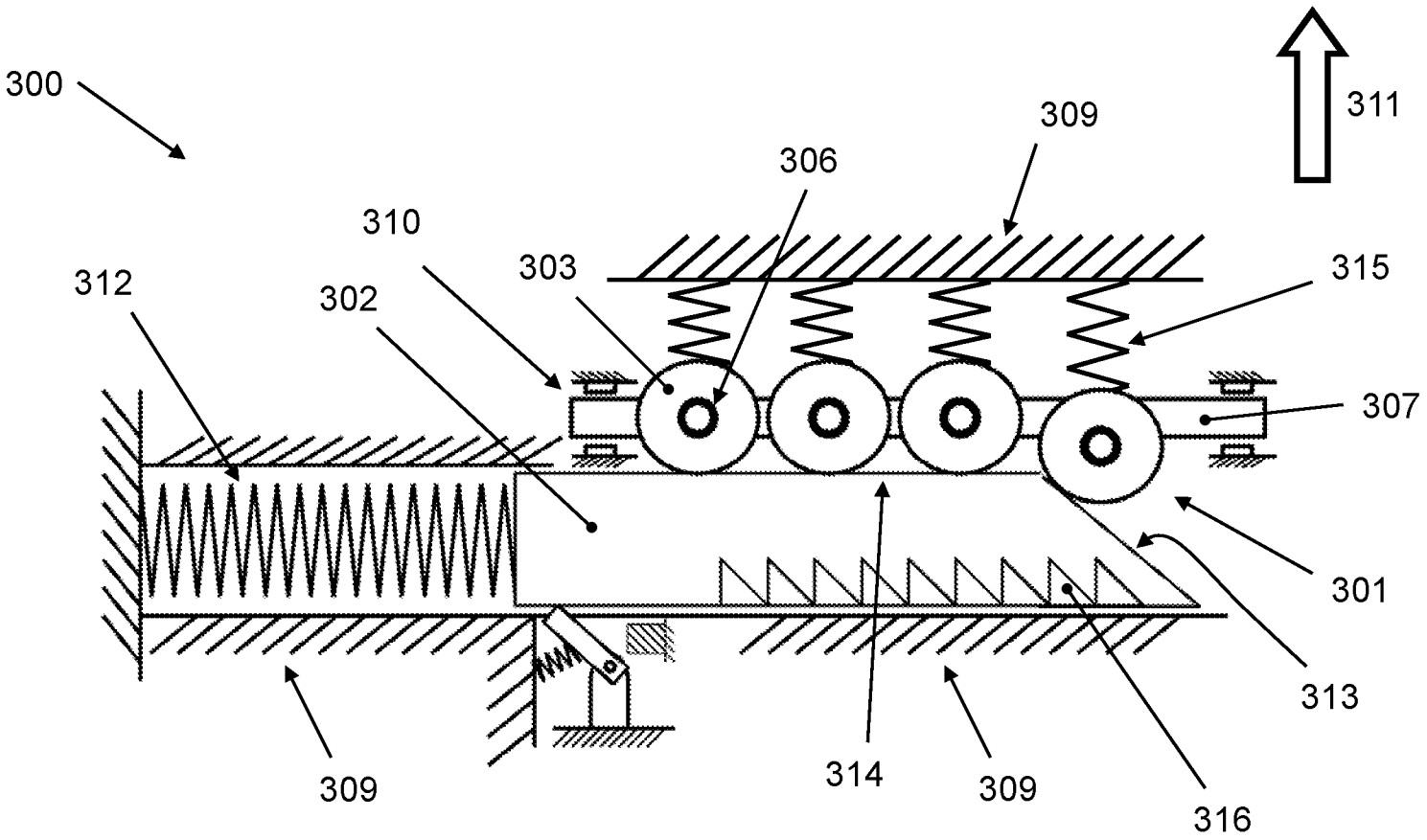
FIG. 20 illustrates the schematic of the sixth "mechanical energy harvesting device" embodiment.

The "mechanical energy harvesting device" embodiment 300 uses a combination of features from the above described embodiments as shown in the side view of FIG. 20. As can be seen in the side view of the "mechanical energy harvesting device" embodiment 300 of FIG. 20, this embodiment is constructed by modification of the embodiment of FIG. 10. In the embodiment of FIG. 20, the actuating rollers or balls 217 of the embodiment of FIG. 10 are replaced by the "rotary actuators" 301. The remaining elements of the embodiment 300 of FIG. 20 are identical to those of the embodiment of FIG. 10 and perform the same functions. The top view of the embodiment 300 showing only the "rotary actuators" 301 components and the actuated sliding member 302 (156 in FIG. 10) are shown in FIG. 21.

Figure 21:
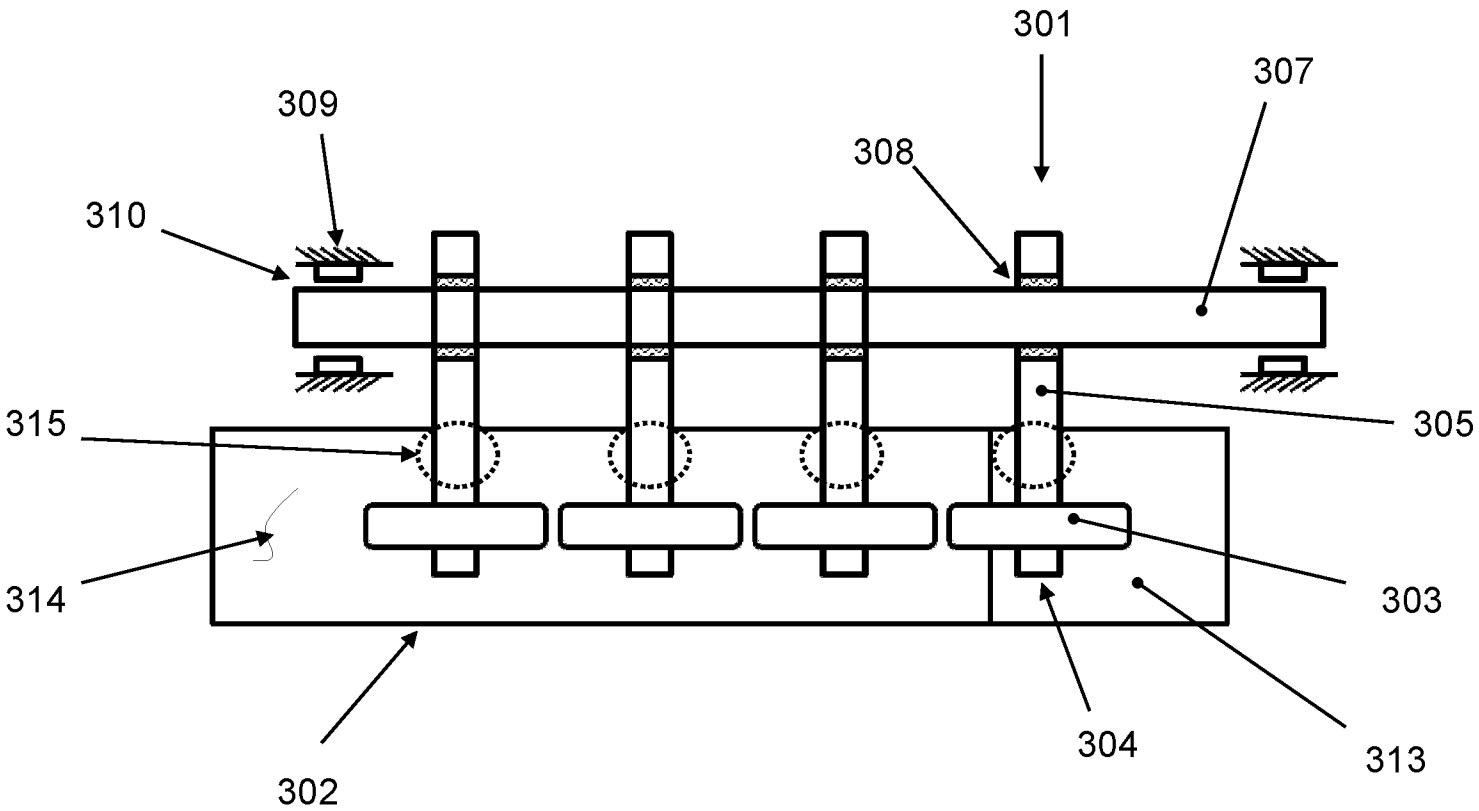
FIG. 21 illustrates the schematic of the top view of the "mechanical energy harvesting device" embodiment of FIG. 20.

As can be seen in the side view of FIG. 20 and the top view of FIG. 21 of the "mechanical energy harvesting device" embodiment 300, the "rotary actuators" 301 consists of a cylindrical or spherical roller 303, which is mounted on the shaft 304 which is an extension of the link 305. A sleeve or anti-friction bearing 306 (FIG. 20) can be used to mount the roller 303 to the shaft 304 to allow for its rotation with minimal friction. The links 305 are in turn mounted on the shaft 307 by sleeve or anti-friction bearings 308 to allow for their rotation with respect to the shaft with minimal friction resistance, FIG. 21. The shaft 307 is attached to the structure 309 of the "mechanical energy harvesting device" embodiment 300 by bearings 310 for ease of device assembly or is fixedly attached to the structure 309.

The "mechanical energy harvesting device" embodiment 300 is also configured to harvest mechanical energy from acceleration of the object to which the device is attached in the direction of the arrow 311 (FIG. 20) and store it in the compressive spring 312 (154 in FIG. 10) as mechanical potential energy. The compressive spring 312 is appropriately preloaded as was previously described, for example for the embodiments of FIGS. 5, 8A and 10, to maximize the amount of mechanical energy that can be harvested from the device acceleration.

The "mechanical energy harvesting device" embodiment 300 of FIGS. 20 and 21 functions as follows. Initially, the right most roller (ball) 303 is in contact with the inclined surface 313 (170 in FIG. 10) of the sliding member 302 (156 in FIG. 10), while the other rollers (second to fourth) are in contact with the top straight surface (171 in FIG. 10) of the sliding member 302. When the object to which the device is attached is accelerated in the direction of the arrow 311, the acceleration acts on the effective inertia of the roller (ball) 303 and link 305 and shaft 304 assembly, resulting in a dynamic force that is applied by the roller (ball) 303 to the inclined surface 313 of the sliding member 302. The horizontal component (as seen in the view of the FIG. 20) of the dynamic force applied to the inclined surface 313 will then tend to displace the sliding member 302 to the left, thereby further deflecting the mechanical potential energy storage spring 312 in compression. The work done by the roller (ball) 303 force on the sliding member 302 is thereby stored in the spring 312 as mechanical potential energy.

It is appreciated that similar to, for example, the embodiment 160 of FIG. 5, preloaded compressive springs 315 (169 in FIG. 5), which are positioned between the link 305 and the structure 309 of the device, may be provided to keep the roller 303 in contact with top surface 314 of the sliding member 302 as shown in FIG. 20. The preloaded compressive spring 315 is usually selected to have low spring rate and is slightly preloaded in compression to ensure roller contact with the top surface 314 of the sliding member 302.

In certain applications, such as in gun-fired munitions applications, the "mechanical energy harvesting device" embodiment 300 must be capable of differentiating a prescribed minimum acceleration level with minimum duration (prescribed firing setback acceleration profile in munitions) from all accidental acceleration events, such as short duration but high acceleration levels due to accidental drops on hard surfaces or other object impacts or low peak accelerations due to transportation vibration or the like. Such a capability is provided for the "mechanical energy harvesting device" embodiment 300 of FIG. 20 as was described for the embodiment of FIG. 8A. If such a is feature is not desired, then the notches 316 (158 in FIG. 8A) in the sliding member 302 (156 in FIG. 8A) would be arranged as shown in the embodiment 160 of FIG. 5 to allow accumulation of the harvested mechanical energy.

Figure 22:
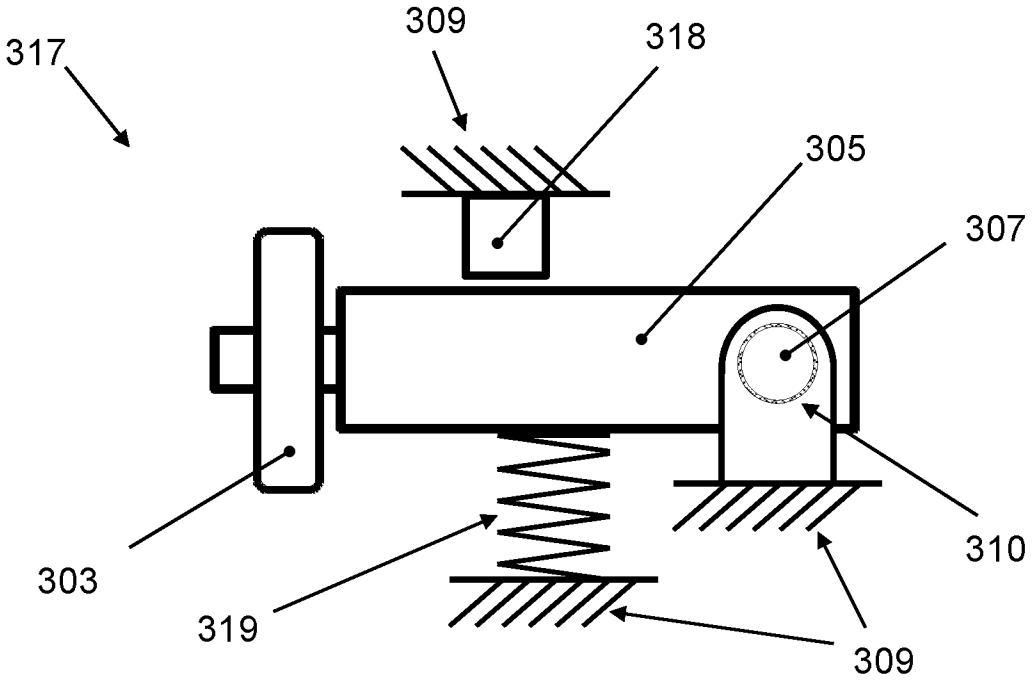
FIG. 22 illustrates the schematic of a mechanical rotary actuator unit for the "mechanical energy harvesting" embodiment of FIG. 20 that begins energy harvesting only after an acceleration threshold has been reached.

To prevent the "rotary actuator" units 301 (FIGS. 20 and 21) from applying a force to the sliding member 302 before a prescribed acceleration threshold has been reached, the design of the units can be modified to as shown in the schematic of FIG. 22 and indicated by the numeral 317. Each "rotary actuator" units 317 are constructed with the same components as the "rotary actuator" units 301, with the exception that the preloaded compressive spring 315 is removed and a stop element 318, which is fixedly attached to the structure 309 of the "mechanical energy harvesting device" embodiment 300 (FIG. 20), is added together with a preloaded compressive spring 319, which is used to bias the link 305 of the "rotary actuator" units 301 against the stop 318.

The "rotary actuator" units 317 will then function as follows. When the "mechanical energy harvesting device" 300 (FIGS. 20 and 21) in which the units 317 are used to actuate their sliding members 302 is subjected to acceleration in the direction of the arrow 311, the acceleration acts on the effective inertial of the entire rotating assembly of the "rotary actuator" unit 317 and generate a dynamic force that is initially applied to the compressively preloaded spring 319. If the level of acceleration in the direction of the arrow 311 generates a dynamic force that is below the resisting preloading level of the compressive spring 319, i.e., below the previously indicated prescribed acceleration threshold, the preloading force of the compressive spring 319 will not be overcome and the roller 303 is not displaced downward. However, if the level of acceleration is above the prescribed acceleration threshold, the preloading force level of the spring 319 is overcome, and the roller 303 begins to be displaced downward and if the acceleration level is high enough, the roller 303 will reach the surface 313 of the sliding member 302, FIG. 20, and begins to cause mechanical potential energy to be accumulated in the device as was previously described for the embodiment 300 of FIGS. 20 and 21. As a result, the "mechanical energy harvesting device" embodiments 300 would harvest mechanical energy only if the applied acceleration is above the prescribed threshold.

It is appreciated by those skilled in the art that the mechanical energy storage spring 312 may be preloaded as was described for the embodiments of FIGS. 5 and 8A to increase the amount of mechanical potential energy that can be stored. The stored mechanical potential energy may then be used to perform the same functions as were described for these mechanical energy harvesting devices.

It is also appreciated by those skilled in the art that the mechanical energy storage springs as well as the actuating unit springs (e.g., 169 in FIGS. 5 and 315 in FIG. 20) may be designed with nonlinear stiffness characteristics to maximize the harvested mechanical energy for a given device acceleration profile.

Figure 23:
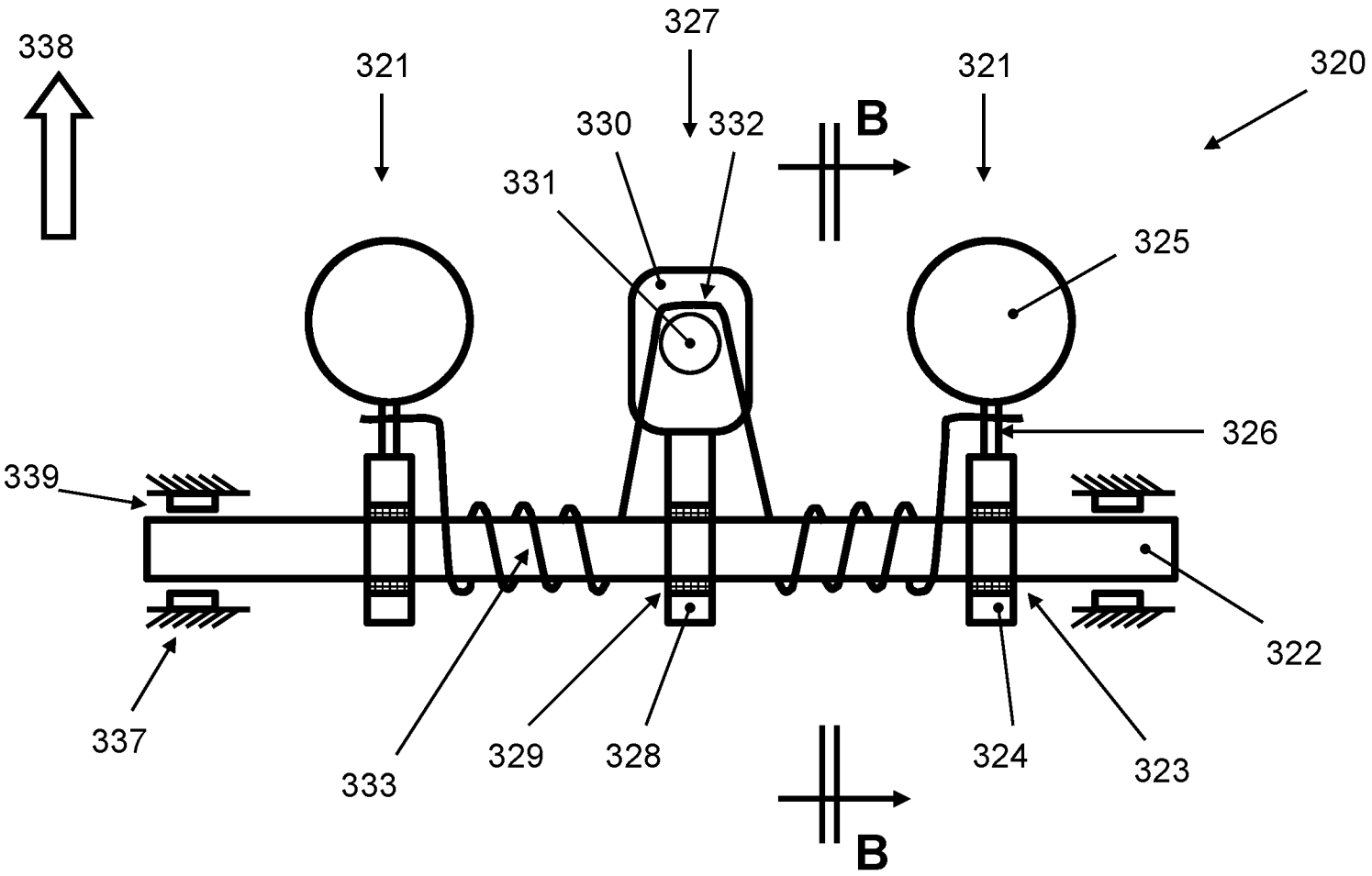
FIG. 23 illustrates the schematic of the side view of the seventh "mechanical energy harvesting device" embodiment that is used to initiate a percussion primer or pyrotechnic material.

FIG. 23 is the schematic of the side view of the seventh embodiment 320 of the mechanical energy harvesting embodiment that is used to initiate a percussion primer or properly configure pyrotechnic material via impact. The view B-B, which shows the lateral view of the various components of the embodiment 320 is shown in FIG. 24.

The "mechanical energy harvesting device" embodiment 320 that is configured for initiating percussion primer or properly configure pyrotechnic material via impact shown in FIG. 23 uses at least one "mechanical energy collecting" units 321, which is similar to the "mechanical energy collecting" units 271 of embodiment 270 of FIG. 17. Similarly, the "mechanical energy collecting" units 321 are mounted on the shaft 322 by bearings 323, which allow for free rotation of the units 277 relative to the shaft 322. The bearings 323 may be an anti-friction bearing, such as a ball bearing, or may be a clearance that is provided in the cylindrical sleeve 324, FIGS. 23 and 24. The shaft 322 is either fixedly attached to the structure 337 of the embodiment 320 or is mounted in the bearings 329 as shown in FIG. 23.

Figure 24:
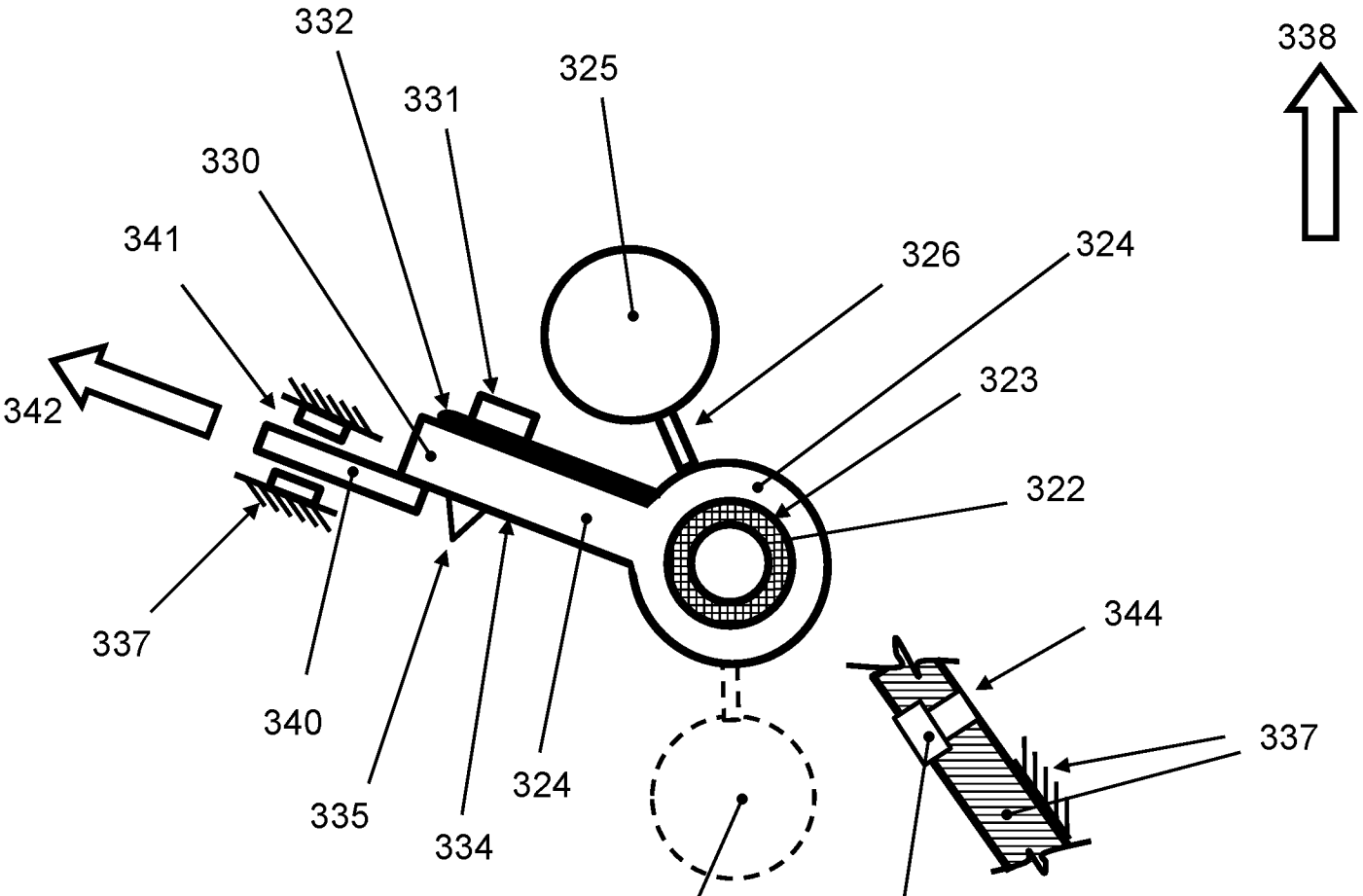
FIG. 24 illustrates the schematic of the view B-B of the embodiment of FIG. 23 as used to initiate a percussion primer or pyrotechnic material.

The view B-B of the "mechanical energy collecting" units 321 is shown in FIG. 24. Each unit consist of a cylindrical sleeve 324, which is are mounted on the shaft 322 via the bearing 323. The "mechanical energy collecting" units 321 are provided with mass elements 325, which are fixedly attached to the cylindrical sleeve 324 by the relatively rigid member 326. In the configuration of the "mechanical energy harvesting device" embodiment 320 shown in the schematic of FIG. 23, the mass element 325 is positioned as shown in the view B-B of FIG. 24, as slightly to the left of a vertical plane passing through the center of the shaft 322.

The "mechanical energy harvesting device" embodiment 320 is also provided with the striker unit 327, which is similarly mounted on the shaft 322 by the member 328 via the bearing 329. The bearing 329 allows for free rotation of the striker unit 327 relative to the shaft 322. The bearings 323 may be an anti-friction bearing, such as a ball bearing, or may be a clearance that is provided in the member 328. The striker unit 327 is provided with a striker mass 330, which is fixedly attached to the member 328. On the striker mass 330 side seen in the side view of FIG. 23, the striker mass is provided with the extension 331 over which the middle loop 332 of the "double wound" torsion spring 333 rests as shown in FIGS. 23 and 24 (the helical section of the torsion spring 333 is not shown in the view B-B of FIG. 24 for sake of clarity). On the other side of the striker mass 330 (indicated by the numeral 334 in FIG. 24), the striker mass is provided with the sharp member 335, which is designed for initiating the percussion primer 336 upon impact as described below.

The "mechanical energy harvesting device" embodiment 320 is considered to be fixedly attached to the intended object 337 (shown as ground in FIGS. 23 and 24), which is subjected to the acceleration in the direction of the arrow 338 as shown in the schematics of FIGS. 23 and 24, from which mechanical energy is to be harvested and used to initiate the primer 336.

The "mechanical energy harvesting device" embodiment 320 of FIGS. 23 and 24 functions as follows. Initially, "mechanical energy collecting" units 321 and the striker unit 327 are in the configuration shown in the view B-B of FIG. 24 and the torsion spring 333 is in free configuration shown in FIG. 23. The counter-clockwise rotation of the striker unit 327 is limited by the removable stop 340 that as shown in the configuration of FIG. 24, engages the top of the striker mass 330. In the initial configuration shown in FIG. 24, the mass elements 325 of the "mechanical energy collecting" unit 321 are seen to be positioned slightly to the left of the axis of the shaft 322. When the object to which the embodiment 320 is attached is accelerated in the direction of the arrow 338, the acceleration acts on the mass (inertia) of the mass elements 325 (neglecting the inertia of the connecting member 326), resulting in a dynamic force that is applied to the center of mass of the mass element 325, generating a torque that tends to rotate the "mechanical energy collecting" units 321 in the counter-clockwise direction as viewed in FIG. 24. It is noted that as can be seen in the schematic of FIG. 24, the distance between the center of mass of the mass element 325 and the center of the shaft 322, i.e., the moment arm of the generated dynamic force (indicated by the numeral 282 in FIG. 18) is relatively small, thereby causing the acceleration in the direction of the arrow 338 to generate a relatively small torque, but the moment arm increases as the shaft 322 is rotated by the generated torque, reaching a peak when the moment arm is perpendicular to the direction of the applied acceleration and diminishing as the moment arm becomes parallel to the direction of acceleration at the mass element position 343 shown by dashed lines in FIG. 24. The torsion spring 333 is thereby wound and the work done by the generated dynamic forces is stored in the torsion spring 333 as mechanical potential energy. The mechanical potential energy stored in the torsion spring 333 can then be used to perform a prescribed function, such as to generate electrical energy as was described for the previous embodiments.

The "mechanical energy harvesting device" embodiment 320 as illustrated in the view B-B of FIG. 24 is used to initiate a percussion primer. To perform this task, the embodiment 320 is usually designed so that as the device using the embodiment 320 is accelerated in the direction of the arrow 338 and the "mechanical energy collecting" units 321 in the counter-clockwise direction, as the mass element 325 approaches the position 343 and that the torsion spring has stored enough mechanical potential energy, the striker mass 330 is released by the displacing the removable stop 340 in the direction of the arrow 342. The striker unit 327 is thereby accelerated in the counter-clockwise direction as viewed in the schematic of FIG. 24. The striker mass would thereby gain certain velocity and impact the percussion primer 336 by the sharp member 335. The percussion primer 336 would then initiate and the ignition flames and sparks would exit from the hole 344 that is provided in the structure of the embodiment 320.

In general, a mechanical mechanism, such as a cable mechanism (not shown) may be used to pull the removable stop 340 in the direction of the arrow 342 or a link mechanism (not shown) that is actuated by the mass element 325 when it has rotated in the counter-clockwise direction to the desired location (at which position enough mechanical potential energy is stored in the torsion spring 33 for initiating the percussion primer 336). Such mechanical mechanisms are well known in the art and may be used. However, a simpler alternative mechanism for releasing the striker mass is shown in the schematic of FIG. 25.

Figure 25:
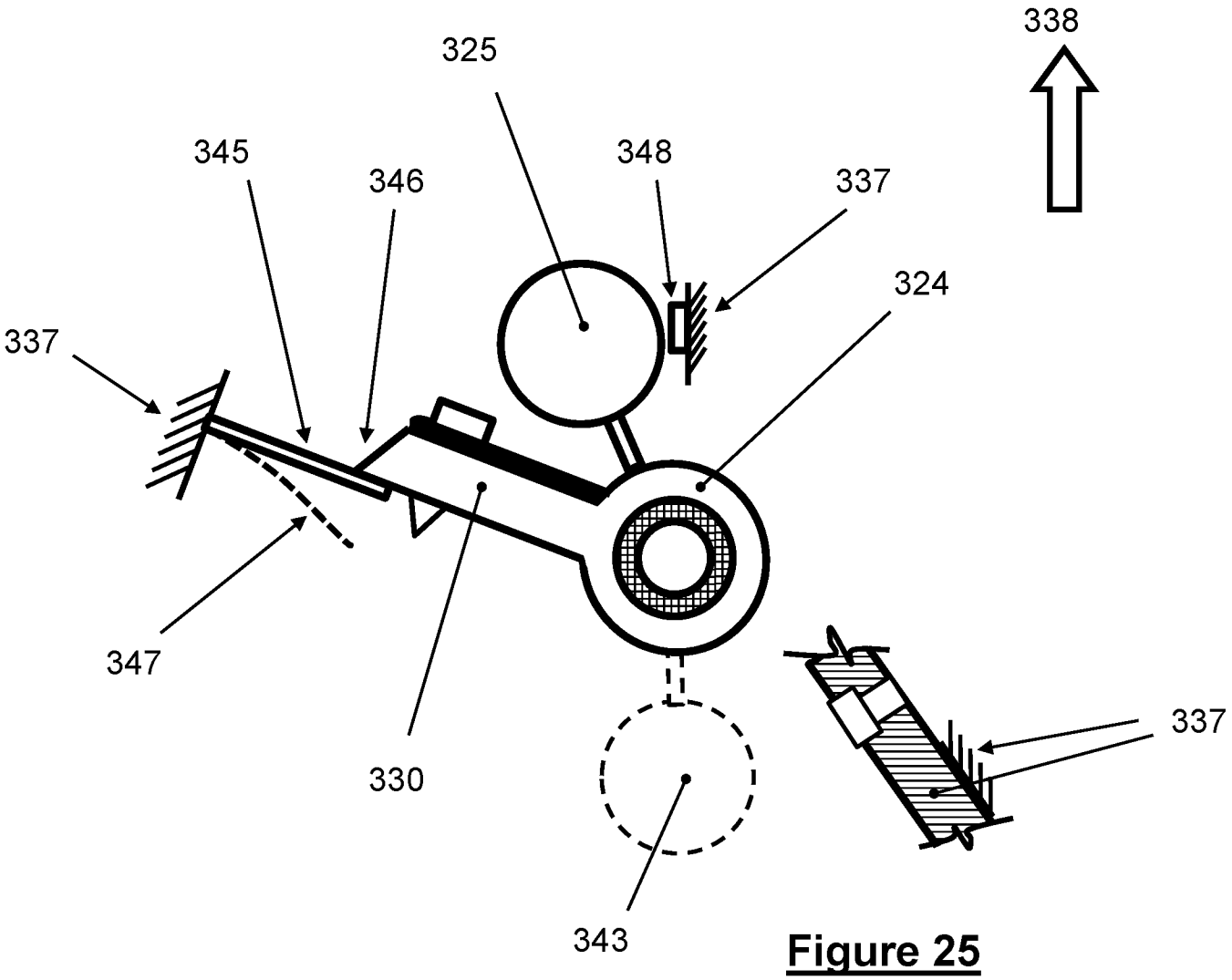
FIG. 25 illustrates an alternative release mechanism for the "mechanical energy harvesting device" embodiment of FIG. 23 that is used to initiate a percussion primer or pyrotechnic material.

In the alternative release mechanism shown in the schematic of FIG. 25, the removable stop 340, FIG. 24, is replaced by a relatively flexible beam element 345, which is fixedly attached to the structure 337 of the embodiment 320. The tip 346 of the striker mass 330, which is in contact with the flexible beam stop is also provided with a sharp edge as seen in FIG. 25. Then as the "mechanical energy harvesting device" embodiment 320 is subjected to acceleration in the direction of the arrow 338 and the "mechanical energy collecting" units 321 is rotated in the counter-clockwise direction as was previously described and when the torque level in the torsion spring 333 reaches a prescribed level, the stiffness of the flexible stop beam element 345 is designed to allow the beam element 345 to bend enough (as shown by the dashed line 347) to release the striker mass 330. The striker unit 327 is thereby accelerated in the counter-clockwise direction as viewed in the schematic of FIG. 25 as was previously described and the striker mass 330 would thereby gain certain velocity and impact the percussion primer 336 by the sharp member 335. The percussion primer 336 would then initiate and the ignition flames and sparks would exit from the hole 344 that is provided in the structure of the embodiment 320.

It is appreciated that the level of force that needs to be applied to the flexible beam element 345 to release the striker mass 330 can be designed to correspond to an acceleration level in the direction of the arrow 338, which must also be applied long enough for the striker unit 327 to rotate far enough in the counter-clockwise direction for the torsion spring to apply the said designed force level to the beam element 345. The "mechanical energy harvesting device" embodiment 320 would then only initiate the percussion primer 336 if the acceleration in the direction of the arrow that is applied to the device has the prescribed minimum level and duration. Otherwise the striker unit 327 would return back to its initial positioning following an acceleration event that lower than the prescribed level or is relatively short in duration even if its level is relatively high.

It is appreciated by those skilled in the art that the torsion spring 333 may be preloaded with the "mechanical energy collecting" units 321 positioned as shown in FIG. 25, in which case, a stop 348 must be provided in the structure 337 of the embodiment 320 to constrain clockwise rotation of the "mechanical energy collecting" units 321. By preloading the torsion spring, the "mechanical energy collecting" units 321 would then begin its counter-clockwise rotation only after acceleration in the direction of the arrow 338 has reached the level at which the torque generated by the dynamic force acting on the mass element 325 would overcome the preloading torque of the torsion spring.

It is also appreciated by those skilled in the art that the "mechanical energy harvesting device" embodiment 320 may also be used to construct normally open and normally closed electrical switches as was described for the embodiments of FIGS. 9A and 9B, respectively. To this end, for the normally open electrical switches, the electrically non-conductive member 187 with contacts 193 and 194, FIG. 9A, replaces the percussion primer 336 and the flexible electrically conductive strip 189 will be attached to the striker mass 330 in place of the sharp member 335. For the normally closed electrical switches, flexible conductive strips 201 and 202 as mounted in the electrically non-conductive member 187, FIG. 9B, replaces the percussion primer 336 and the non-conductive element 203 will be attached to the striker mass 330 in place of the sharp member 335. Both electrical switches will then operate as was described for the embodiments 9A and 9B.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. An energy storage device comprising:

a first movable member configured to be movable in a first direction relative to a base;

a first biasing member configured to bias the first movable member in a second direction opposed to the first direction;

a plurality of second movable members, each movable towards an engagement surface of the first movable member when subjected to a predetermined acceleration event in a direction offset from the first direction; and wherein the engagement surface having a portion which when pressed causes a movement of the first movable member in the first direction against a biasing force of the first biasing member; and the plurality of second movable members are configured to sequentially engage the engagement surface upon an increasing acceleration of the base such that energy is stored in the first biasing member.

2. The energy storage device of claim 1, wherein the first movable member is movable in translation relative to the base.

3. The energy storage device of claim 2, wherein the first biasing member is one of a compression or tension spring having one end connected to the first movable member and another end connected to the base.

4. The energy storage device of claim 1, wherein the first movable member is movable in rotation relative to the base.

5. The energy storage device of claim 4, wherein the first biasing member is a torsion spring having one end connected to the first movable member and another end connected to the base.

6. The energy storage device of claim 1, wherein at least one of the plurality of second movable members comprises a surface that rolls over the engagement surface of the first movable member.

7. The energy storage device of claim 1, wherein at least one of the plurality of second movable members comprises a surface that rides over the engagement surface of the first movable member.

8. The energy storage device of claim 1, further comprising a second biasing member corresponding to each of the plurality of second movable members, each second biasing member being configured to bias a corresponding one of the plurality of second movable members toward the engagement surface of the first movable member.

9. The energy storage device of claim 8, wherein the second biasing member is a compression spring connected between the at least one of the plurality of second movable members and the base.

10. The energy storage device of claim 8, wherein the second biasing member is a flexible member connected between the at least one of the plurality of second movable members and the base.

11. The energy storage device of claim 1, further comprising a second biasing member corresponding to each of the plurality of second movable members, each second biasing member being configured to bias a corresponding one of the plurality of second movable members away the engagement surface of the first movable member such that each second biasing member is configured to move towards the engagement surface only when subjected to the predetermined acceleration event having a magnitude and duration greater than a predetermined acceleration event;

wherein upon the acceleration event being greater than the predetermined acceleration event, the plurality of second movable members are configured to sequentially engage the engagement surface upon the increasing acceleration of the base to store the energy in the first biasing member.

12. The energy storage device of claim 1, wherein the portion of the engagement surface is a tapered surface relative to other portions of the engagement surface.

13. The energy storage device of claim 1, further comprising a ratchet mechanism for preventing the first movable member from moving in the second direction.

14. The energy storage device of claim 13, wherein the ratchet mechanism is configured to be engaged with the first movable member only after a predetermined amount of movement of the first movable member in the first direction.

15. The energy storage device of claim 1, further comprising a release mechanism configured to release the energy stored in the first biasing member when the first movable member is moved a predetermined amount in the first direction.

16. The energy storage device of claim 15, wherein the release mechanism includes a first release member configured to release engagement of the release mechanism with a second release member such that the energy stored in the first biasing member acts on the second release member.

17. The energy storage device of claim 15, further comprising an electrical switch that is one of opened or closed upon release of the energy stored in the first biasing member.

18. The energy storage device of claim 15, further comprising a primer that is activated upon release of the energy stored in the first biasing member to generate one of a flame or spark.

19. The energy storage device of claim 15, further comprising an electrical generator that is activated upon release of the energy stored in the first biasing member to convert the energy stored in the first biasing member to electrical energy.

* * * * *